US010955124B2

(12) United States Patent
Carney et al.

(10) Patent No.: US 10,955,124 B2
(45) Date of Patent: Mar. 23, 2021

(54) LED LINK SYSTEM WITH DISTRIBUTIVE POWERING SCHEME

(71) Applicant: SIGNIFY HOLDING B.V., Eindhoven (NL)

(72) Inventors: Anthony James Carney, Fayetteville, GA (US); Chun Wah Chan, Peachtree City, GA (US); Jerold Alan Tickner, Newnan, GA (US); Christopher Lee Bohler, Peachtree City, GA (US); Kenneth Walma, Peachtree City, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/868,318

(22) Filed: May 6, 2020

(65) Prior Publication Data

US 2020/0263861 A1 Aug. 20, 2020

Related U.S. Application Data

(63) Continuation of application No. 16/017,572, filed on Jun. 25, 2018, now Pat. No. 10,648,652, which is a (Continued)

(51) Int. Cl.
*F21V 23/00* (2015.01)
*F21V 29/70* (2015.01)
(Continued)

(52) U.S. Cl.
CPC ..... *F21V 23/003* (2013.01); *E04B 9/006* (2013.01); *F21K 9/27* (2016.08); *F21S 2/005* (2013.01);
(Continued)

(58) Field of Classification Search
CPC ..... F21V 23/003; F21V 23/005; F21S 4/28; F21S 2/005
See application file for complete search history.

(56) References Cited

U.S. PATENT DOCUMENTS

2007/0047243 A1* 3/2007 Hacker ..... F21V 23/06 362/382
2007/0068055 A1* 3/2007 Segan ..... G09F 9/33 40/544
(Continued)

*Primary Examiner* — Evan P Dzierzynski
(74) *Attorney, Agent, or Firm* — Patrick T. Driscoll

(57) ABSTRACT

A linkable linear light emitting diode (LED) system provides apparatus and methods for mechanically, optically, and electrically linking multiple LED modules disposed over a wide and separated area of a ceiling system. Openings can be cut in ceiling tiles of a drop ceiling system and the LED lighting modules are coupled to the tile through the opening, with the tile being sandwiched between different portions of the module. A remote driver system is placed within the drop ceiling above the tiles and provides multiple connectors for powering a multitude of lighting modules. Certain of the LED lighting modules include both input and output connectors for both receiving power or data and providing power or data to other modules. In this manner, some of the modules act as master LED lighting modules and those receiving power and/or data therefrom are act as slave modules.

20 Claims, 47 Drawing Sheets

Related U.S. Application Data continuation of application No. 15/067,925, filed on Mar. 11, 2016, now Pat. No. 10,006,592, which is a continuation of application No. 14/134,943, filed on Dec. 19, 2013, now Pat. No. 9,285,085, which is a continuation of application No. 13/095,394, filed on Apr. 27, 2011, now Pat. No. 8,616,720.

(60) Provisional application No. 61/328,497, filed on Apr. 27, 2010, provisional application No. 61/328,875, filed on Apr. 28, 2010, provisional application No. 61/410,204, filed on Nov. 4, 2010.

(51) Int. Cl.

| | |
|---|---|
| ***F21K 9/27*** | (2016.01) |
| ***E04B 9/00*** | (2006.01) |
| ***F21S 2/00*** | (2016.01) |
| ***F21S 8/02*** | (2006.01) |
| ***F21S 8/04*** | (2006.01) |
| ***F21V 21/04*** | (2006.01) |
| ***F21V 23/06*** | (2006.01) |
| ***F21S 4/28*** | (2016.01) |
| *F21Y 103/10* | (2016.01) |
| *F21Y 115/10* | (2016.01) |
| *F21S 8/00* | (2006.01) |
| *F21S 8/06* | (2006.01) |
| *F21V 21/005* | (2006.01) |
| *F21V 21/096* | (2006.01) |
| *F21V 21/03* | (2006.01) |

(52) U.S. Cl.

CPC ..... *F21S 4/28* (2016.01); *F21S 8/026* (2013.01); *F21S 8/04* (2013.01); *F21V 21/04* (2013.01); *F21V 23/005* (2013.01); *F21V 23/06* (2013.01); *F21V 29/70* (2015.01); *F21S 8/038* (2013.01); *F21S 8/06* (2013.01); *F21V 21/005* (2013.01); *F21V 21/03* (2013.01); *F21V 21/096* (2013.01); *F21V 23/008* (2013.01); *F21V 23/009* (2013.01); *F21Y 2103/10* (2016.08); *F21Y 2115/10* (2016.08)

(56) References Cited

U.S. PATENT DOCUMENTS

2008/0266843 A1* 10/2008 Villard ..... F21V 29/74 362/147
2009/0086488 A1* 4/2009 Lynch ..... F21V 29/83 362/249.02

* cited by examiner

LED LINK SYSTEM WITH DISTRIBUTIVE POWERING SCHEME

RELATED APPLICATIONS

This application is a continuation of and claims priority under 35 U.S.C. § 120 to U.S. patent application Ser. No. 16/017,572, filed on Jun. 25, 2018, and titled "LED Lighting System With Distributive Powering Scheme," which is a continuation of and claims priority under 35 U.S.C. § 120 to U.S. patent application Ser. No. 15/067,925, filed on Mar. 11, 2016, and titled "LED Lighting System With Distributive Powering Scheme," which issued as U.S. Pat. No. 10,006,592 on Jun. 26, 2018 and which is a continuation of and claims priority under 35 U.S.C. § 120 to U.S. patent application Ser. No. 14/134,943, filed on Dec. 19, 2013, and titled "LED Lighting System With Distributive Powering Scheme," which issued as U.S. Pat. No. 9,285,085 on Mar. 15, 2016 and is a continuation of and claims priority under 35 U.S.C. § 120 to U.S. patent application Ser. No. 13/095,394, filed on Apr. 27, 2011, titled "Linkable Linear Light Emitting Diode System," which issued as U.S. Pat. No. 8,616,720 on Dec. 31, 2013 and which claims priority under 35 U.S.C. § 119 to U.S. Provisional Patent Application No. 61/328,497, titled "Linkable Linear Light Emitting Diode System," filed on Apr. 27, 2010, U.S. Provisional Patent Application No. 61/328,875, titled "Systems, Methods, and Devices for a Linear LED Light Module," filed on Apr. 28, 2010, and U.S. Provisional Patent Application No. 61/410,204, titled "Linear LED Light Module," filed on Nov. 4, 2010. The entire contents of each of the foregoing applications are hereby fully incorporated herein by reference.

TECHNICAL FIELD

The present invention relates generally to luminaires. More specifically, the embodiments of the invention relate to systems, methods, and devices for linking linear light emitting diode (LED) fixtures in a ceiling or wall space.

BACKGROUND

The use of LED's in place of conventional incandescent, fluorescent, and neon lamps has a number of advantages. LED's tend to be less expensive and longer lasting than conventional incandescent, fluorescent, and neon lamps. In addition, LED's generally can output more light per watt of electricity than incandescent, fluorescent, and neon lamps. Linear light fixtures are popular for a variety of different residential and commercial lighting applications, including cabinet lighting, shelf lighting, cove lighting, and signage. Linear light fixtures can provide primary lighting in an environment or serve as aesthetic accents or designs that complement other lighting sources.

Conventional linear LED light fixtures only extend in a single direction. Furthermore, when one or more conventional linear LED light fixtures are coupled together, these fixtures have a break in the light source at the point were one two fixtures are connected, creating an undesirable lighting effect. In addition, when the fixtures are coupled, the electrical and or mechanical coupling is typically occurring near or adjacent to the LEDs along the LED substrate. The connections have a tendency to create shadows and thus, an undesirable light output.

In buildings where a great many linear LED light fixtures are used as the primary light source, the number of fixtures may be more than is necessary with current conventional light sources. This increased number of LED fixtures, can create problems because the positioning of the fixtures is often limited based on the need to couple the fixture to a secure area and the problems manifest in running electrical power to each individual light fixture from a general source of A/C power.

SUMMARY

The present invention provides novel apparatus, systems, and methods for electrically, optically and mechanically coupling LED light modules. The present invention also provides novel apparatus, systems, and methods for employing the LED light modules in a drop ceiling system which may have a multitude of ceiling tiles. For one aspect of the present invention, a novel illumination system can include a first linear LED module coupled to a ceiling. The system can also include another LED linear lighting module coupled to the ceiling and placed in an area that is remote from the first linear LED module. It should be understood that the reference to being remote is intended only to mean that the devices are not within the same luminaire or immediately adjacent to one another. For example, if the first LED linear lighting module was coupled to a first ceiling tile in a drop ceiling system and the second linear LED module were coupled to an adjacent ceiling tile, the two modules would be remote from one another. The illumination system can further include an LED driver positioned in an area above the ceiling. The driver can be remote from both the first and second linear LED modules and can provide electrical power to both the first and second linear LED modules.

For another aspect of the present invention, a luminaire system can include a first linear LED module, a second linear LED module and a connector module. The first linear LED module can include a first end and an opposing second end. The first linear LED module can also include a first substrate extending between the first and second ends of the first module and a first multitude of LEDs disposed in a longitudinal row on the first substrate. The first LED module can also include a first electrical connector positioned below the top surface of the first substrate and along the first end of the first module. The first electrical connector can be electrically coupled to the first multitude of LEDs. The second linear LED module can include a first end and an opposing second end. The second LED module can also include a substrate extending between the first and second ends and a multitude of LEDs positioned in a longitudinal row on the substrate of the second LED module. The second LED module can also include an electrical connector positioned below the top surface of the substrate and along the first end of the second module. The electrical connector for the second LED module can be electrically coupled to the LEDs for the second LED module. The connector module can include a substrate having a row of LEDs. The connector module can be electrically and mechanically coupled to the electrical connector of the first LED module and the electrical connector of the second LED module and can provide an electrical pathway between the first and second LED modules.

For yet another aspect of the present invention, an illumination system can include a first LED module, multiple second LED modules, and multiple wires. The first LED module can include a longitudinally extending heat sink, a substrate positioned along one side of the heat sink, and multiple LEDs placed on the substrate. An LED driver can be electrically coupled to the substrate and positioned along the second side of the heat sink. The LED driver can include multiple wire connector receptacles positioned along and electrically coupled to the LED driver. The second LED module can include a longitudinally extending heat sink, a substrate positioned along one side of the heat sink, multiple LEDs placed on the substrate; and a wire connector receptacle electrically coupled to the substrate to power the LEDs. The wires can have connectors at opposing ends and one end of the wire can be positioned in the connector receptacle at the driver and the opposing end connector can be positioned in the connector receptacle at one of the second LED modules.

These and other aspects, features, and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the exemplary embodiments of the present invention and the advantages thereof, reference is now made to the following description in conjunction with the accompanying drawings, which are not necessarily drawn to scale, and wherein.

DETAILED DESCRIPTION OF THE EXEMPLARY EMBODIMENTS

Figure 1:
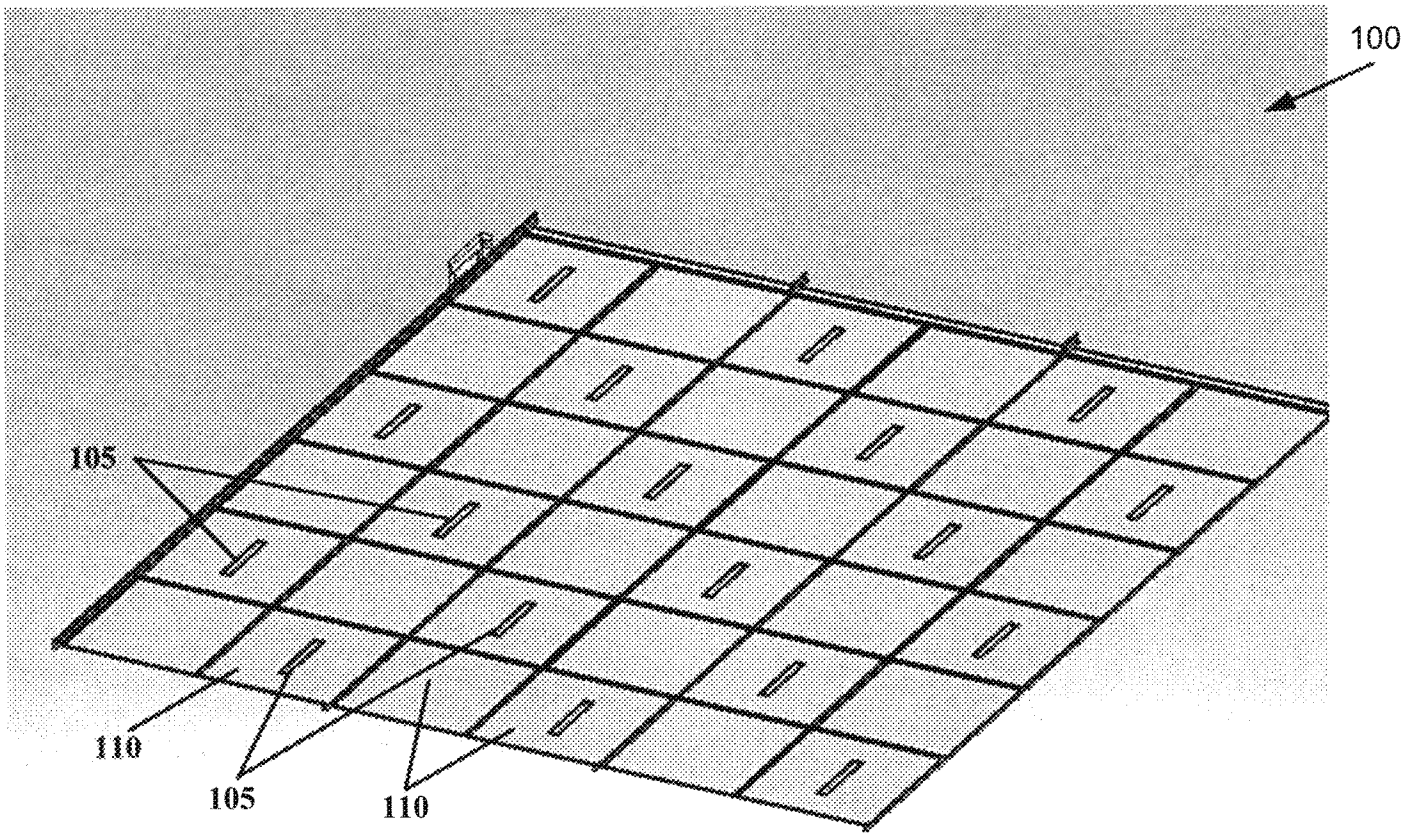
FIG. 1 is a perspective view of a tiled ceiling with linked LED linear lighting modules in accordance with one exemplary embodiment of the present invention.

Embodiments of the present invention are directed to an attachable and linkable system of LED linear lighting modules for use in tiled ceiling systems as well as plaster ceilings and walls. Referring now to the drawings in which like numerals represent like elements throughout the several figures, aspects of the present invention will be described. Referring now to FIG. 1, the exemplary lighting system 100 includes a tiled ceiling system having one or more ceiling tiles 110. Coupled to and inserted into one or more of the ceiling tiles are LED linear lighting modules 105. In one exemplary embodiment, an aperture is cut into the ceiling tile 110 and the lighting module 105 is attached thereto or positioned within the aperture. The LED linear lighting module 105 emits light down from an area at the aperture and substantially adjacent to the ceiling surface. Alternatively, ceiling tiles 110 are constructed with the LED linear lighting modules 105 already attached and marketed in combination with one-another. In one exemplary embodiment, the ceiling tiles 110 are two foot-by-two foot ceiling tiles, however, other shapes and sizes of tiles are within the scope and spirit of this disclosure. While the exemplary system of FIG. 1 presents the linear lighting modules 105 as all extending longitudinally in the same direction on the ceiling tiles 110, several alternatives exist for shaping and combining the LED linear lighting modules 105 including, but not limited to, the alternative lighting designs presented in FIGS. 34-38.

Figure 2:
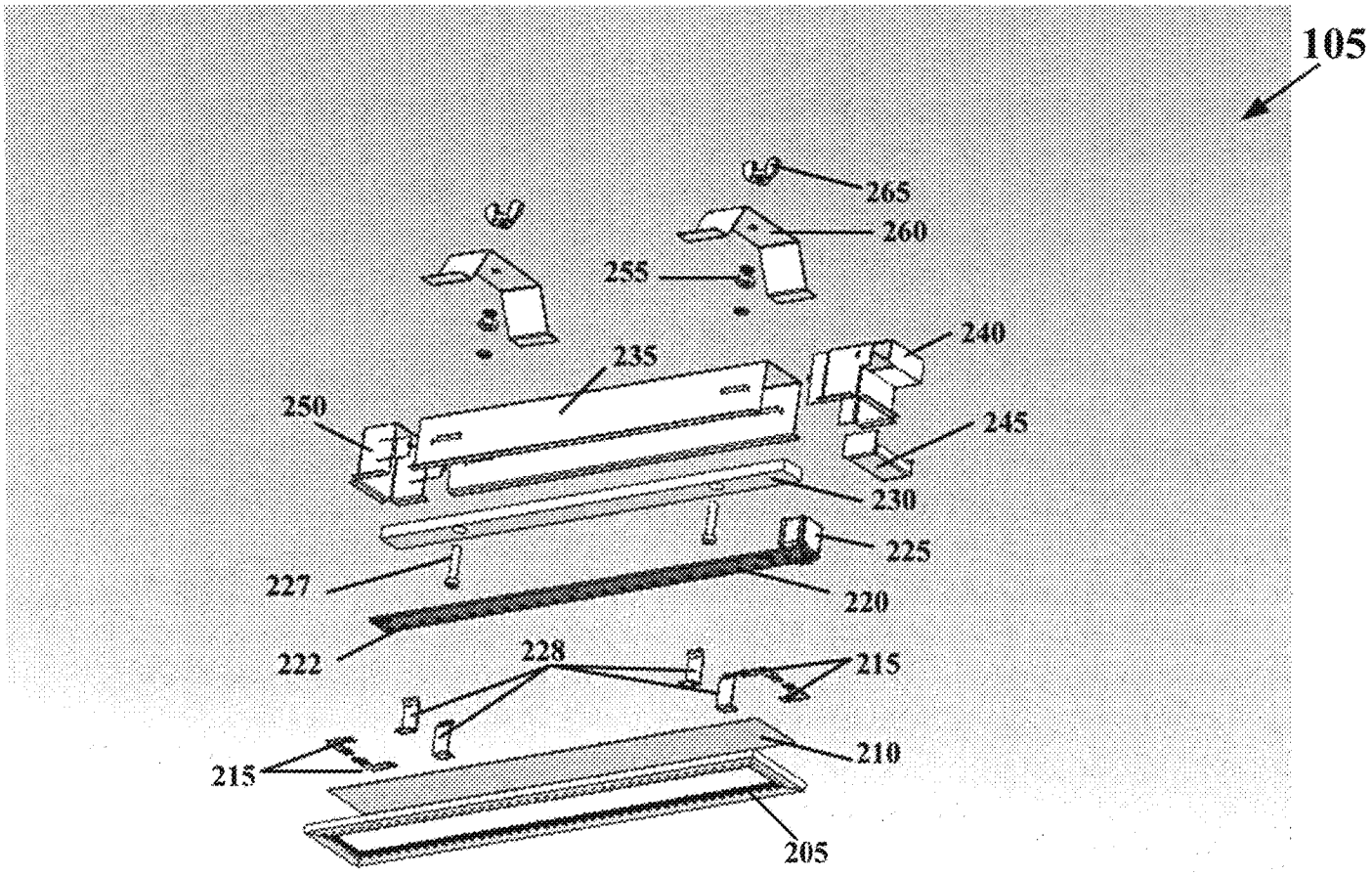
FIG. 2 is an exploded view of the LED linear lighting module in accordance with one exemplary embodiment of the present invention.

FIG. 2 presents an exploded view of and exemplary embodiment of the LED linear lighting module 105 of FIG. 1. Now referring to FIG. 2, the LED linear lighting module 105 includes a housing 235 configured in a generally U-shaped manner having a generally horizontal cap and walls extending downward in a generally orthogonal manner from two opposing sides of the cap to create a cavity. A horizontal flange extends outward in a generally orthogonal manner from the ends of the walls. The flanges are typically positioned adjacent to and apply a force against the top surface of the ceiling tile 110 to provide structural support for the LED linear lighting module 105. The housing 235 is constructed of pre-coated steel and includes multiple apertures (described below). Disposed within the cavity of the housing 235 is a heat sink 230 and an LED board 220. Each LED board 220 is configured to create artificial light or illumination via multiple LED's 222. For purposes of this application, each LED 222 may be a single LED die, an LED package having one or more LED dies on the package, or an organic LED (OLED) having a sheet or planar shape.

Each LED board 220 includes at least one substrate to which the LEDs 222 are coupled. Each substrate includes one or more sheets of ceramic, metal, laminate, circuit board, flame retardant (FR) board, mylar, or other material. In an alternative embodiment, the LEDs 222 are mounted and/or coupled directly to the heat sink 230 without a board or substrate 220. Although depicted in FIG. 2 as having a substantially rectangular shape, a person of ordinary skill in the art having the benefit of the present disclosure will recognize that the LED board 220 can have any linear or non-linear shape. Each LED 222 is attached to its respective substrate by a solder joint, a plug, an epoxy or bonding line, or other suitable provision for mounting an electrical/optical device on a surface. Each LED 222 includes semi-conductive material that is treated to create a positive-negative (p-n) junction. When the LED's 222 are electrically coupled to a power supply (see FIG. 23), such as a driver, current flows from the positive side to the negative side of each junction, causing charge carriers to release energy in the form of incoherent light.

The wavelength or color of the emitted light depends on the materials used to make each LED 222. For example, a blue or ultraviolet LED typically includes gallium nitride (GaN) or indium gallium nitride (InGaN), a red LED typically includes aluminum gallium arsenide (AlGaAs), and a green LED typically includes aluminum gallium phosphide (AlGaP). Each of the LEDs 222 is capable of being configured to produce the same or a distinct color of light. In certain exemplary embodiments, the LEDs 222 include one or more white LED's and one or more non-white LED's, such as red, yellow, amber, green, or blue LEDs, for adjusting the color temperature output of the light emitted from the LED linear lighting module 105. A yellow or multi-chromatic phosphor may coat or otherwise be used in a blue or ultraviolet LED 222 to create blue and red-shifted light that essentially matches blackbody radiation. The emitted light approximates or emulates "white," light to a human observer. In certain exemplary embodiments, the emitted light includes substantially white light that seems slightly blue, green, red, yellow, orange, or some other color or tint. In certain exemplary embodiments, the light emitted from the LEDs 222 has a color temperature between 2500 and 6000 degrees Kelvin.

In certain exemplary embodiments, an optically transmissive or clear material (not shown) encapsulates at least some of the LEDs 222, either individually or collectively. This encapsulating material provides environmental protection while transmitting light from the LEDs 222. For example, the encapsulating material can include a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating white light.

Each LED board 220 includes one or more rows of LEDs 222. The term "row" is used herein to refer to an arrangement or a configuration whereby one or more LEDs 222 are disposed approximately in or along a line. LEDs 222 in a row are not necessarily in perfect alignment with one another. For example, one or more LEDs 222 in a row might be slightly out of perfect alignment due to manufacturing tolerances or assembly deviations. In addition, LEDs 222 in a row might be purposely staggered in a non-linear or non-continuous arrangement. Each row extends along a longitudinal axis of the LED board (also called a substrate) 220.

Although depicted in FIG. 2 as having a single row of LEDs 222, a person of ordinary skill in the art having the benefit of the present disclosure will recognize that the LEDs 222 can be arranged in any number of different rows, shapes, and configurations without departing from the spirit and scope of the invention. For example, the LEDs 222 can be arranged in two staggered rows. In certain exemplary embodiments, an individual module 105, each row of a module 105 and/or each LED 222 is separately controlled by the driver so that each can independently be dimmed, turned on and off, or otherwise reconfigured. In accordance with one embodiment of the invention, dimming may be performed by varying current across each LED 222 or LED module 105. In another embodiment, dimming may be performed by turning on and/or off each LED 222 or LED module 105 independently. In the exemplary embodiment depicted in FIG. 2, each substantially twelve-inch LED board 220 includes 24 LEDs 222. The number of LEDs 222 on each LED board 220 may vary depending on the size of the LED board 220, the size of the LEDs 222, the amount of illumination required from the LED board 220, and/or other factors. The exemplary LED board 220 also includes a class 2 wire connector receptacle or jack 225 for receiving a class 2 wire connector, such as, fore example, a CAT-6 connector. The class 2 wire receptacle or jack 225 is electrically coupled to the LED board 220 and provides a pathway for transmitting power and control signals from a control box or LED driver to the LED board 220. While the exemplary embodiment describes the use of an class 2 wore receptacle or jack for transmitting power to the LED board, other conventional power transfer options known to those of ordinary skill in the art, including, but not limited to, wires, jumper wires, and electrical connectors are within the scope and spirit of the present embodiment.

The LED board 220 is in thermal communication with and coupled to the heat sink 230. In one exemplary embodiment, the LED board 220 is coupled to the heat sink 230 with epoxy. The exemplary heat sink 230 is a substantially rectangular block of aluminum with one or more apertures for receiving machine screws 227 or other coupling devices for coupling the heat sink 230 to the housing 235. The apertures in the heat sink 230 are countersunk to provide a flat surface for mating with the LED board 220 and increasing the surface area contact between the heat sink 230 and the LED board 220.

Figure 12:
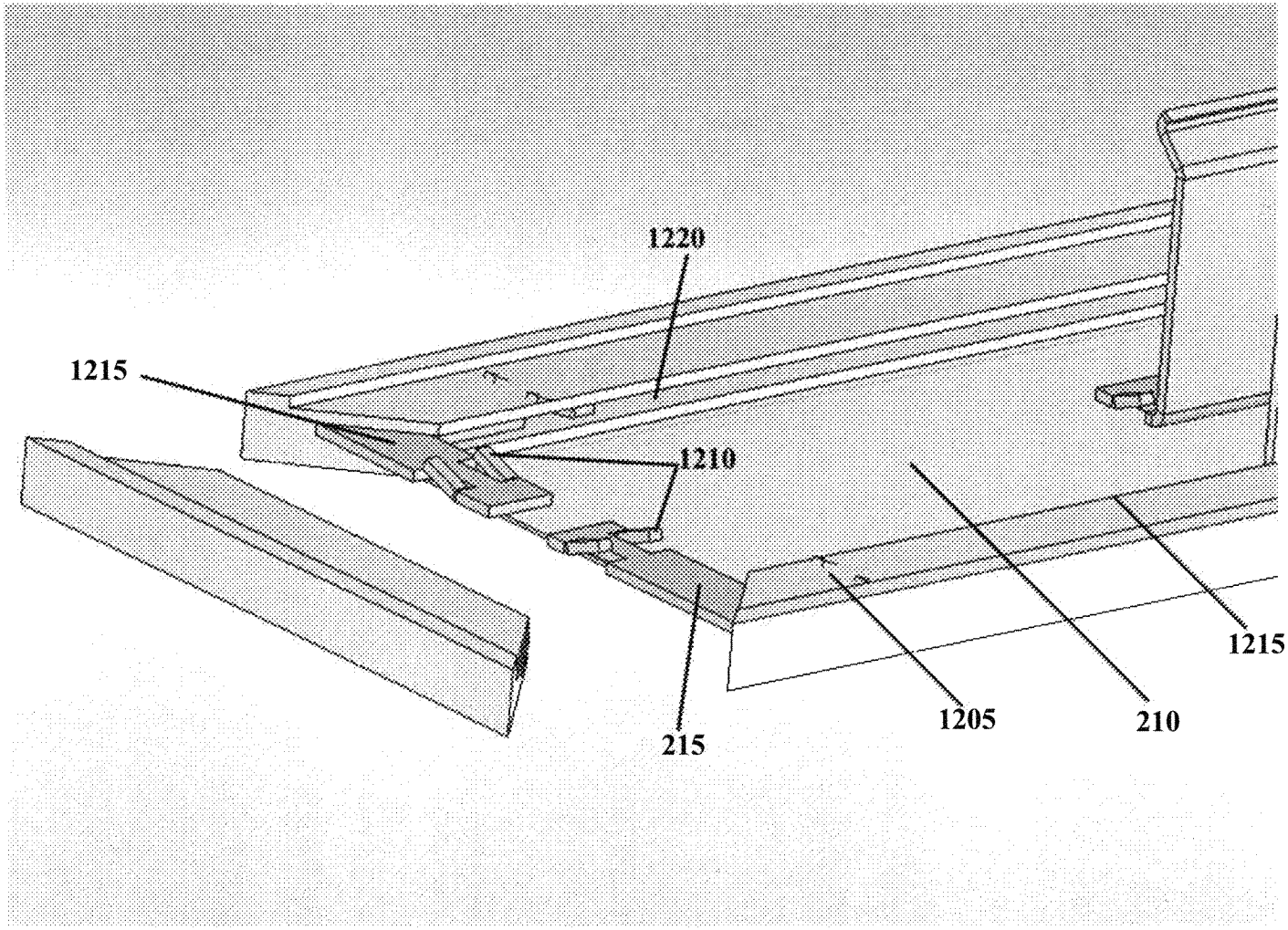
FIG. 12 is a partially-exploded view of a lens frame for the LED linear lighting module of FIG. 2 in accordance with an exemplary embodiment of the present invention.

Disposed between the LED board 220 and the area of illumination is a lens 210 and a lens frame 205. In one exemplary embodiment, the lens 210 is made of plastic and has a diffuse surface to obstruct an outside view of the point source for each LED 222. The lens 210 is held in position and surrounded along its perimeter by the lens frame 205, which is generally disposed along the bottom surface of the ceiling tile 110 or other mounting surface. As shown in FIG. 12, the lens 210 is held in position in the lens frame 205 by a pair of corner clips 215. Each corner clip 215 is slidable into a slot 1220 and has tabs 1205, 1210 that engage apertures 1215 in the slot 1220 to hold the corner clips 215 in place.

Figure 13:
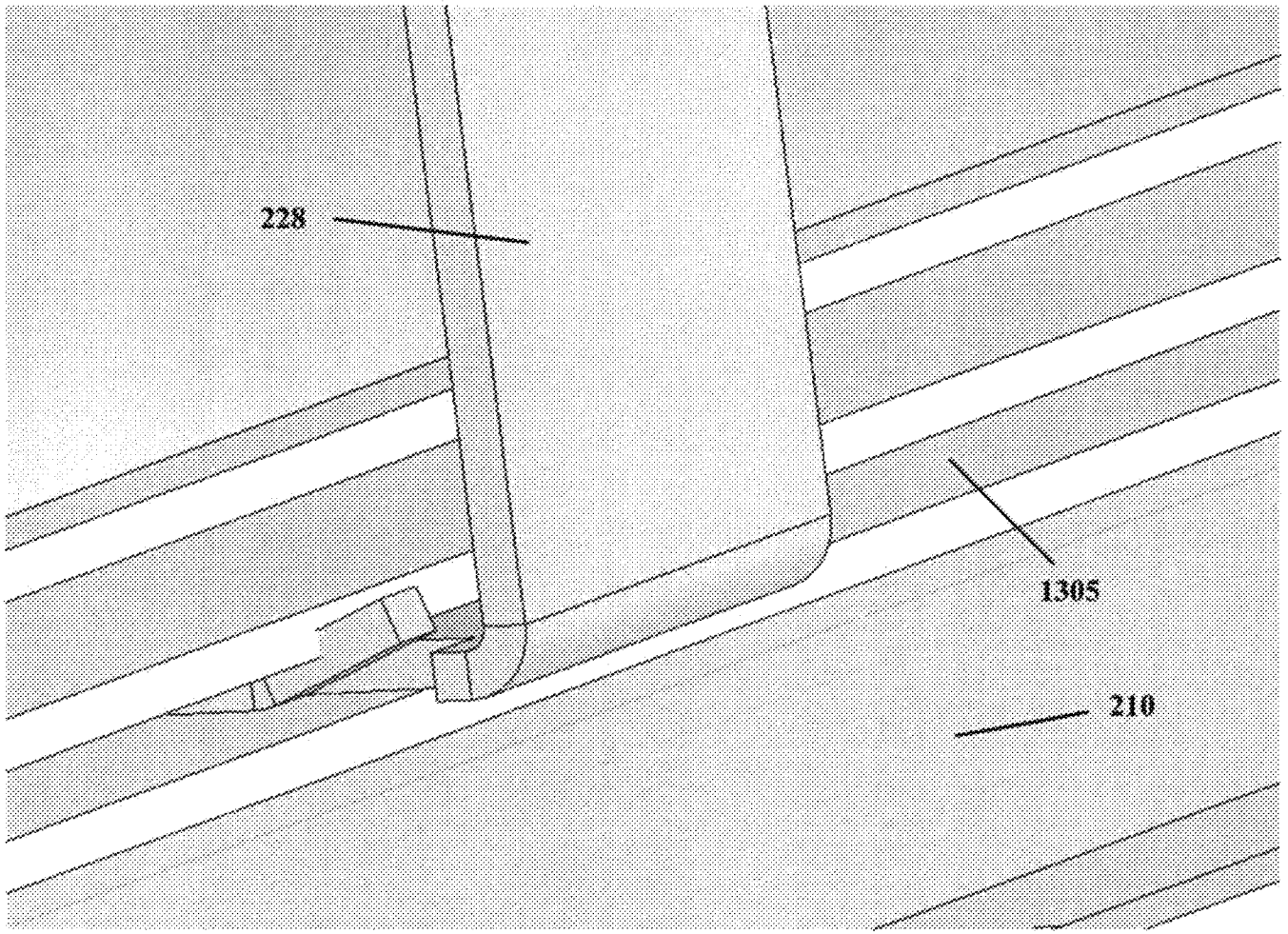
FIG. 13 is a partial view of a lens frame and vertical clip for the LED linear lighting modules in accordance with an exemplary embodiment of the present invention.

Returning to FIG. 2, the lens frame 205 is held in position with respect to the housing 235 with four vertical clips 220. As shown in FIG. 13, each vertical clip includes a horizontal section that engages a slot 1305 in the lens frame 205, a vertical section that provides the distance between the lens frame 205 and the housing 235 and a tab that is inserted into the aperture 1910 or 1930 (of FIG. 19) of the housing 235. While four vertical clips 220 and four corner clips 215 are shown in the exemplary embodiment of FIG. 2, greater or fewer of each may be substituted without departing from the scope or spirit of the exemplary embodiment.

Returning again to FIG. 2, each end of the housing 235 optionally includes an endcap or attachment structure. The exemplary embodiment of FIG. 2 includes an end cap 250 coupled to one end of the housing 235 and a feed end 240 coupled to the opposing end of the housing 235. The feed end 240 includes a cover 245 removably attached thereto. Alternative LED modules 105 will be described herein with reference to FIGS. 3-7 hereinafter. Alternative attachment structures will be described herein with reference to FIGS. 14-18 hereinafter.

The exemplary module 105 further includes mounting clips 260. Mounting clips 260 are generally made of steel and coupled to the housing 235 to provide support against the top side of the ceiling tile 110 or other mounting structure. Each mounting clip 260 includes a substantially flat center portion and flat end portions. Between the center an end portions is a downwardly disposed angle portion that sets the height of the module 105 in the ceiling, with the substantially flat end portions of the mounting clips 260 resting upon the top surface of the ceiling tile 110 or other mounting surface. In an alternative embodiment for installing in plaster or other mounting surfaces, the mounting clips do not include the substantially flat end portions. Instead the alternative mounting clips only include the center portion and the downwardly disposed angle portions having a desired spring constant. Returning to the exemplary embodiment of FIG. 2, each mounting clip 260 includes an aperture and is coupled to the housing 235 with the machine screws 227. For example, a jam nut 255 and one or more washers are positioned between each mounting clip 260 and the cap end of the housing 235. The machine screw 227 passes through the heat sink 230, the housing 235 the washer and jam nut 255, and the mounting clip 260 and is secured in place with a wing nut 265. While a wing nut 265 and jam nut 255 are described in reference to the exemplary embodiment, those of ordinary skill in the art will recognize that other conventional coupling means are within the scope and sprit of this disclosure.

Figure 3A:
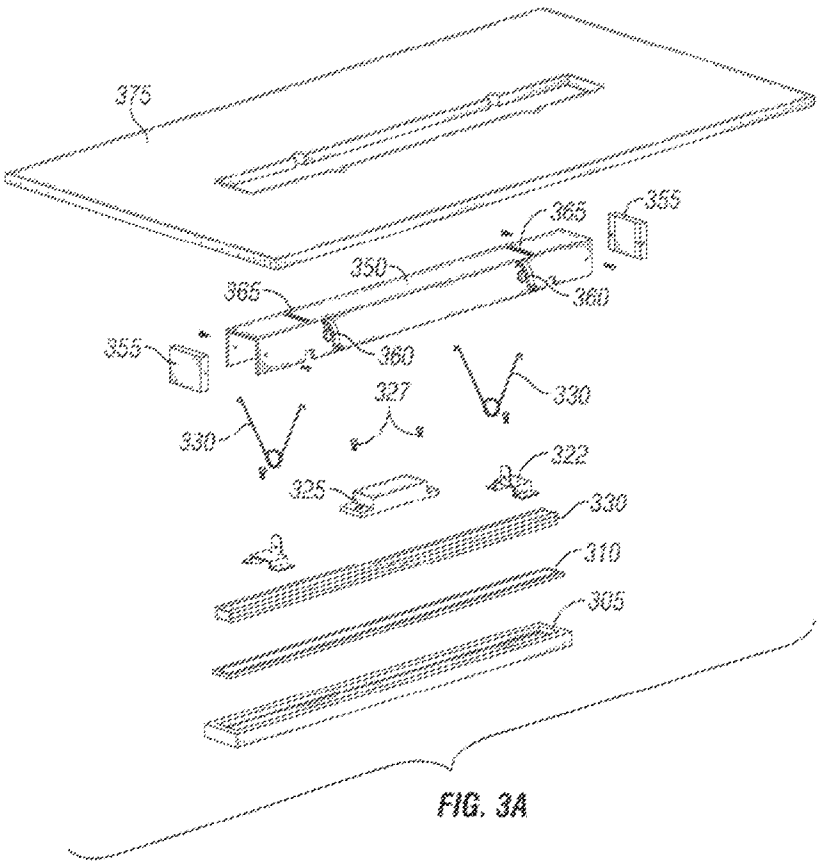
FIGS. 3A and 3B are views of another LED linear lighting module in accordance with an alternative exemplary embodiment of the present invention.
Figure 3B:
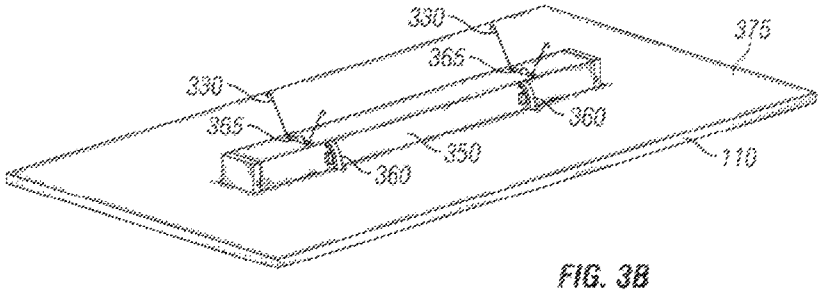

FIGS. 3A and 3B present views of an alternative LED linear lighting module 105A of FIG. 1. The elements of the LED linear lighting module 105A are substantially similar to those of module 105 of FIG. 2. Differences will be discussed herein, with the remainder of the disclosure of module 105 of FIG. 2 being incorporated herein. Now referring to FIGS. 3A and 3B, the LED linear lighting module 105A includes a housing 350 in certain embodiments and does not include the housing 350 in other embodiments. For example, when the module 105A includes a driver 325, the module 105A will also typically include the housing 350. Alternatively, when the module 105A does not include a driver 325, and instead draws power from control box (as discussed with reference to FIG. 23), from a magnetic track system (as discussed with reference to FIGS. 30 and 31), from a powered T-grid system (as discussed with reference to FIGS. 32 and 33) or from other modules 105 (as discussed with reference to FIGS. 9-11 and 42-44), the module 105A may not include a housing 350 and the torsion springs 330 will engage a top side 375 of the ceiling tile 110. The housing 350, if included, is configured in a generally U-shape manner having a generally horizontal cap and walls extending downward in a generally orthogonal manner from two opposing sides of the cap to create a cavity. The housing 350 is constructed of pre-coated steel and includes multiple apertures 365 (described below).

Removably positioned within the cavity of the housing 350 is a linear LED assembly 320. Each linear LED assembly 320 includes a plurality of LEDs and is configured to create artificial light with those LEDs. For purposes of this application, each LED on the linear LED assembly 320 may be a single LED die or may be an LED package having one or more LED dies on the package. Exemplary embodiments for the linear LED assembly 320 are described in more detail in FIGS. 8A-C. Each LED assembly 320 includes at least one substrate to which the LEDs are coupled, similar to that described with reference to FIG. 2. Each LED assembly 320 includes one or more rows of LEDs. Each row extends along a longitudinal axis of the linear LED assembly 320.

A person of ordinary skill in the art having the benefit of the present disclosure will recognize that the LEDs can be arranged in any number of different rows, shapes, and configurations on the linear LED assembly 320 without departing from the spirit and scope of the invention. The number of LEDs on each linear LED assembly 320 may vary depending on the length of the linear LED assembly 320, the size of the LEDs, the amount of illumination required from the assembly 320, and/or other factors. An LED driver 325 is removably coupled to or positioned adjacent to the assembly 320. For example, the LED driver 325 is coupled to the assembly 320 using screws 327. In certain exemplary embodiments, wires or a plug-in assembly (not shown) provides low voltage direct current power from the driver 325 to the assembly 320. In certain embodiments, the driver 325 receives power from an AC power source and converts the AC power to DC power.

The exemplary linear LED assembly 320 also includes one or more mounting brackets 322. In one exemplary embodiment, each mounting bracket 322 is coupled to a back side of the LED assembly 320 using screws or other known attachment devices. The mounting brackets are typically coupled near, but not necessarily at opposing ends of the assembly 320. The exemplary mounting bracket 322 includes a top generally horizontal base. Vertical members are coupled to or integral with and extend generally downward from each opposing end of the base in a substantially orthogonal manner. On the opposing end of each vertical member is another generally horizontal member. The horizontal member is coupled to or integral with the vertical member and extends generally horizontally outward from a centerline of the bracket 322 in a substantially orthogonal manner. Each horizontal member includes an aperture for receiving a screw or other coupling device therethrough. In certain exemplary embodiments a screw couples the lens frame 305 to the bracket 332, such that the opposing longitudinal sides of the lens frame 305 are attached to opposite horizontal members of the bracket 322.

Each bracket 322 also includes a torsion spring mounting bracket extending vertically up from the top horizontal base. The torsion spring mounting bracket is configured to receive, hold, and/or be coupled to a torsion spring 330. Each torsion spring has opposing arms that extend through apertures 365 along the horizontal cap of the housing 350, to hold the assembly 320, lens 310, and lens frame 305 in place in the housing 350.

Positioned between the linear LED assembly 320 and the area of illumination is a lens 310 and a lens frame 305. In one exemplary embodiment, the lens 310 is made of plastic and has a diffuse surface to obstruct an outside view of the point source for each LED on the assembly 320. The lens 310 is held in position and surrounded along its perimeter by the lens frame 305, which is generally disposed along the bottom surface of the ceiling tile 110 or other mounting surface.

Each end of the housing 350 optionally includes an endcap or attachment structure. The exemplary embodiment of FIG. 3A includes an end cap 355 coupled to one end of the housing 350 and another end cap 355 coupled to the opposing end of the housing 350. In embodiments where the module 105A is coupled in-line with another module 105A, one of the end caps 355 would not be included and the two modules will be coupled together as discussed hereinafter. In certain exemplary embodiments, the housing 350 also includes one or more spring clips 360. For example, two spring clips 360 in FIG. 3A are positioned along each longitudinal side of the housing 350. The spring clips 360 hold the housing 350 within the ceiling grid when the linear LED assembly 320, is not coupled thereto with the torsion springs 330. The spring clips 360 also provide support against the top side 375 of the ceiling tile 110 and, when installed, sandwiches the ceiling tile 110 between the spring clips 360 and the lens frame 305.

Figure 4:
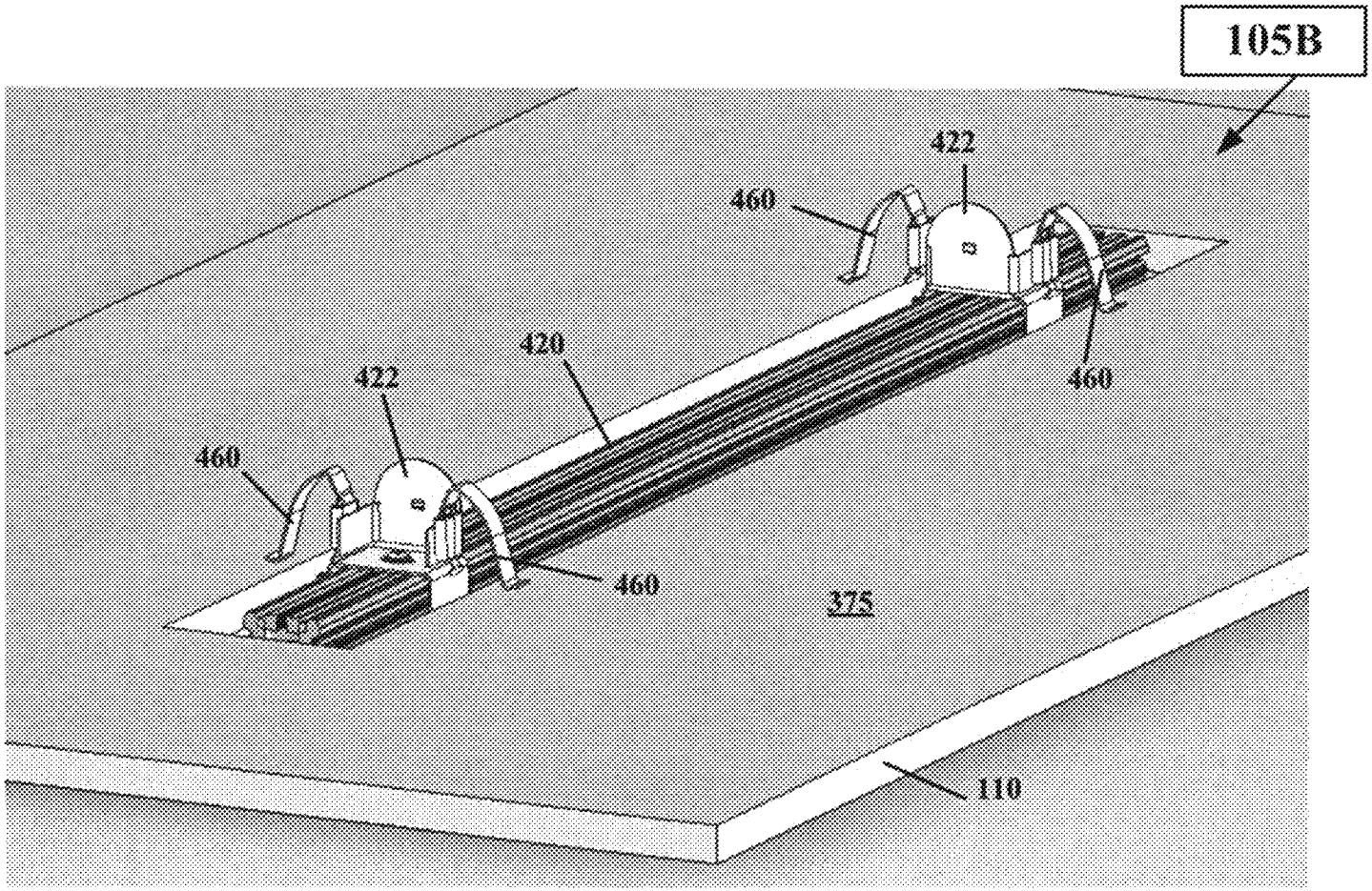
FIG. 4 is a perspective view of another LED linear lighting module in accordance with another alternative exemplary embodiment of the present invention.

FIG. 4 is a perspective view of another alternative LED linear lighting module 105B of FIG. 1. The elements of the LED linear lighting module 105B are substantially similar to those of module 105 and 105A of FIGS. 2-3B. Differences will be discussed herein, with the remainder of the disclosure of modules 105 and 105A being incorporated herein. Referring to FIG. 4, the LED linear lighting module 105B includes a linear LED assembly 420. Each linear LED assembly 420 includes multiple LEDs and is configured to create artificial light with those LEDs. Exemplary embodiments for the linear LED assembly 420 are described in more detail in FIGS. 8A-C. Each LED assembly 420 includes at least one substrate to which the LEDs are coupled, similar to that described with reference to FIG. 2. Each LED assembly 420 includes one or more rows of LEDs. Each row of LEDs extends along a longitudinal axis of the linear LED assembly 420.

The exemplary linear LED assembly 420 also includes one or more mounting brackets 422. In one exemplary embodiment, each mounting bracket 422 is coupled to a back side of the LED assembly 420 using screws or other known attachment devices. The mounting brackets 422 are typically coupled near, but not necessarily at opposing ends of the assembly 420. The exemplary mounting bracket 422 includes a top generally horizontal base. Vertical members are coupled to or integral with and extend generally downward from each opposing end of the base in a substantially orthogonal manner. On the opposing end of each vertical member is another generally horizontal member. The horizontal member is coupled to or integral with the vertical member and extends generally horizontally outward from a centerline of the bracket 422 in a substantially orthogonal manner. Each horizontal member includes an aperture for receiving a screw or other coupling device therethrough. In certain exemplary embodiments a screw couples the lens frame (not shown) to the bracket 422 (similar to that shown and described in FIG. 3A.

Each bracket 422 also includes a torsion spring mounting bracket extending vertically up from the top horizontal base. The torsion spring mounting bracket is configured to receive, hold, and/or be coupled to a torsion spring (not shown). In certain exemplary embodiments, each bracket 422 also includes one or more spring clips 460. The spring clips 460 also provide support against the top side 375 of the ceiling tile 110 and, when installed, sandwiches the ceiling tile 110 between the spring clips 460 and the lens frame (not shown). During installation, an installer provides an opposing inward force against the opposing spring clips 460 to reduce the dimension between the opposing ends of the two opposite spring clips 460 to a distance less than the width of the opening in the ceiling tile 110, thereby allowing the assembly 420 to be mounted into the ceiling. When the opposing force is reduced or eliminated, the dimension between the opposing ends of the two opposite spring clips 460 increases to an amount greater than the width of the opening in the ceiling tile 110. For example, two spring clips 460 are positioned along each opposing end of the top base. The spring clips 460 hold the assembly 420, lens and lens bracket in the ceiling tile 110.

Positioned between the linear LED assembly 420 and the area of illumination is a lens (not shown) and a lens frame (not shown). In one exemplary embodiment, the lens is made of plastic and has a diffuse surface to obstruct an outside view of the point source for each LED on the assembly 420. The lens is held in position and surrounded along its perimeter by the lens frame (not shown), which is generally disposed along the bottom surface of the ceiling tile 110 or other mounting surface similar to that shown in FIGS. 2 and 3A.

Figure 5:
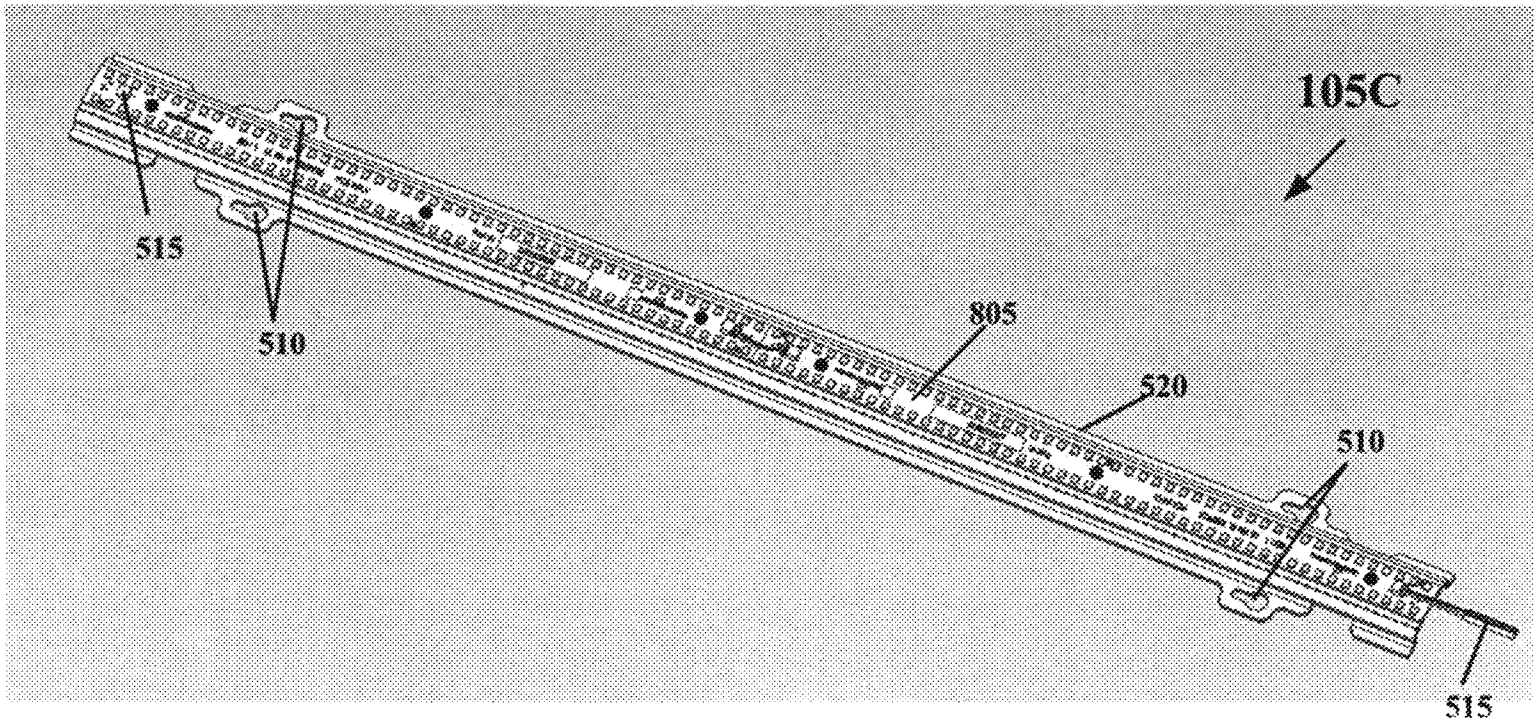
FIG. 5 is a perspective view of yet another LED linear lighting module in accordance with another alternative exemplary embodiment of the present invention.

FIG. 5 is a perspective view of yet another LED linear lighting module 105C in accordance with an alternative exemplary embodiment. The LED linear lighting module 105C is substantially similar to those of modules 105, 105A, and 105B of FIGS. 2-4. Differences will be discussed herein, with the remainder of the disclosure of modules 105, 105A and 105B being incorporated herein. The exemplary module 105C includes a linear LED assembly 520. Each linear LED assembly 520 includes multiple LEDs 805 and is configured to create artificial light with those LEDs 805. Exemplary embodiments for the linear LED assembly 520 are described in more detail in FIGS. 8A-C. Each LED assembly 520 includes at least one substrate to which the LEDs 805 are coupled, similar to that described with reference to FIG. 2. Each LED assembly 520 includes one or more rows of LEDs 805. Each row of LEDs 805 extends along a longitudinal axis of the linear LED assembly 520.

The linear LED assembly 520 is coupled to bracket 520. In one exemplary embodiment, the bracket 520 is made of sheet metal. The bracket 520 includes one or more apertures 510, such as, for example, a circular aperture. In one exemplary embodiment, each aperture 510 includes a slot extending from the aperture and having a diameter that is less than that of the aperture. In this configuration, a head of a screw or other coupling device that is already coupled to a mounting surface can fit through the aperture 510 and then slide along the slot to hold the module 105C in place. This makes the module 105C well-suited for surface mounting the module 105C to the ceiling, under cabinet, or any other flat or substantially flat surface.

Figure 6:
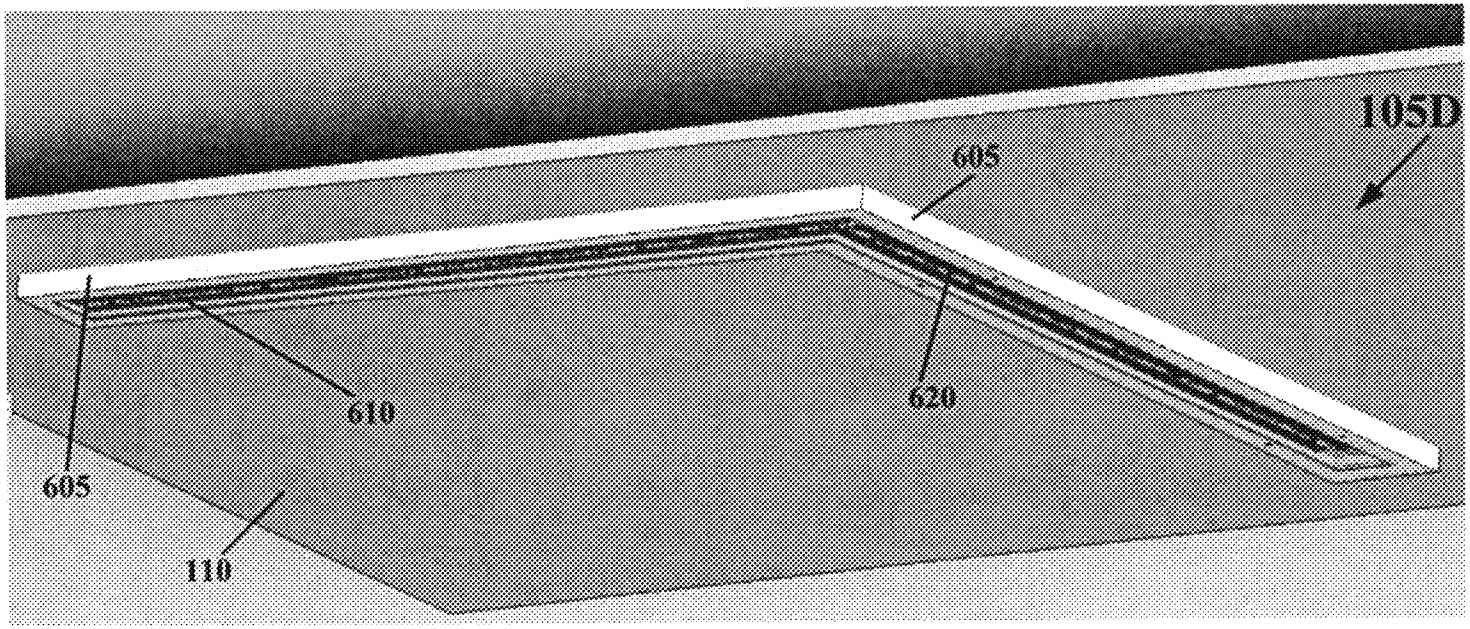
FIG. 6 is a perspective view of one of the LED linear lighting modules in a surface mounted orientation in accordance with an exemplary embodiment of the present invention.

FIG. 6 is a perspective view of another exemplary LED linear lighting module 105D in a surface-mounted orientation. The LED linear lighting module 105D is substantially similar to those of modules 105, 105A, 105B and 105C of FIGS. 2-5. Differences will be discussed herein, with the remainder of the disclosure of modules 105, 105A, 105B, and 105C being incorporated herein. Referring now to FIG. 6, the LED linear lighting module 105D includes a linear LED assembly 620. Each linear LED assembly 620 includes multiple LEDs and is configured to create artificial light with those LEDs. Exemplary embodiments for the linear LED assembly 620 are described in more detail in FIGS. 8A-C. Each LED assembly 620 includes at least one substrate to which the LEDs are coupled, similar to that described with reference to FIG. 2. Each LED assembly 620 includes one or more rows of LEDs. Each row of LEDs extends along a longitudinal axis of the linear LED assembly 620.

All or a portion of the linear LED assembly 620 is positioned inside of or surrounded by a frame 605. In certain exemplary embodiments, the frame 605 includes one or more apertures for coupling the module 105D directly to the bottom surface of the ceiling tile 110 instead of through an opening in the ceiling tile, as discussed in FIGS. 1-4. In this surface-mounted embodiment, a smaller hole or opening in the ceiling tile 110 is made to route electrical power through the ceiling tile 110 to the module 105D. In an alternative embodiment, the linear LED assembly 620 includes one or more through-holes or threaded apertures for receiving a fastener, such as a screw, to fasten the assembly 620 and frame 605 to the ceiling tile 110. In yet another exemplary embodiment, one or more magnets are provided along the top side of or near the top side of the assembly 620 and/or frame 605. A metal plate (not shown) or magnets of opposite polarity are be attached to the bottom surface of the ceiling tile 110 and the magnets on the module 105D are attached to the plate or opposite polarity magnets to surface-mount the module 105D. In certain exemplary embodiments, the magnets provide both a mechanical connection to the ceiling for the module 105D and also provide low-voltage DC power to the linear LED assembly 620. In the exemplary embodiment of FIG. 6, two linear LED assemblies 610, 620 are coupled to one another at a right-angle. Means for coupling adjacent LED assemblies are discussed hereinafter in, for example, FIGS. 8-11.

Figure 7:
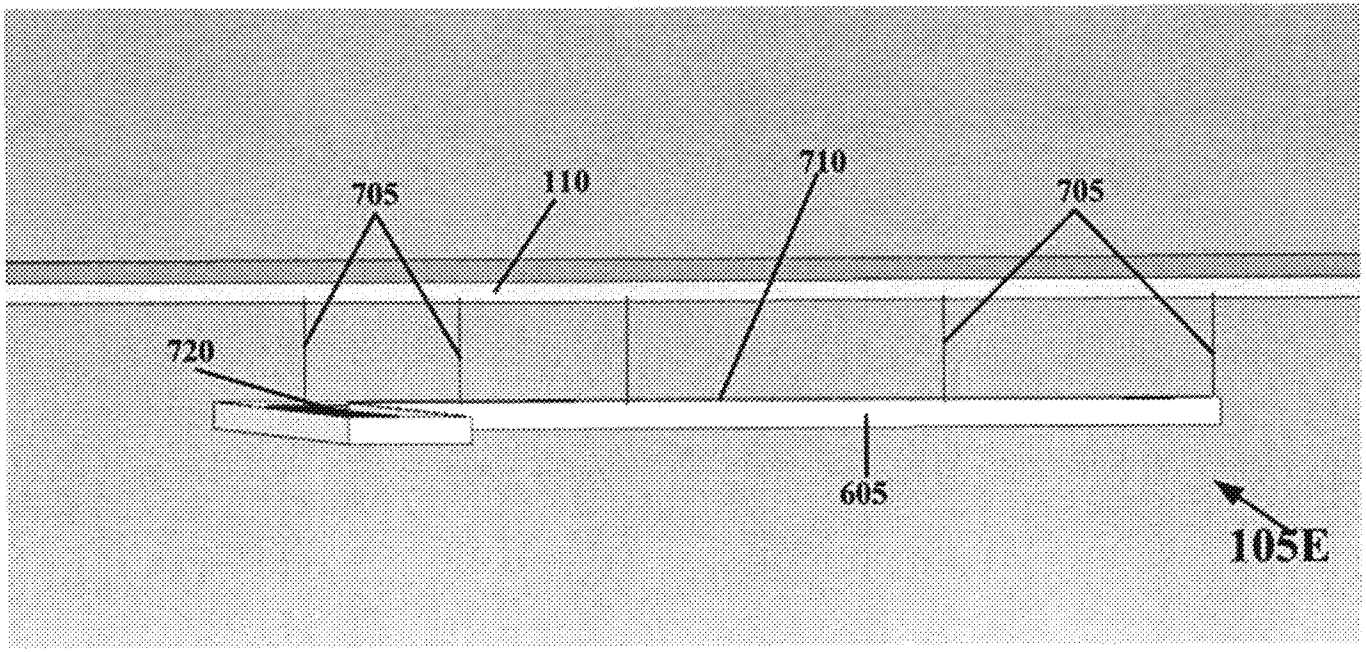
FIG. 7 is a perspective view of one of the LED linear lighting modules in a pendant mounted orientation in accordance with an exemplary embodiment of the present invention.

FIG. 7 is a perspective view of another exemplary LED linear lighting module 105E in a pendant-mounted orientation. The LED linear lighting module 105E is substantially similar to those of modules 105, 105A, 105B, 105C, and 105D of FIGS. 2-6. Differences will be discussed herein, with the remainder of the disclosure of modules 105, 105A, 105B, 105C, and 105D being incorporated herein. Referring now to FIG. 7, the LED linear lighting module 105E includes a linear LED assembly 720. Each linear LED assembly 720 includes multiple LEDs and is configured to create artificial light with those LEDs. Exemplary embodiments for the linear LED assembly 720 are described in more detail in FIGS. 8A-C. Each LED assembly 720 includes at least one substrate to which the LEDs are coupled, similar to that described with reference to FIG. 2. Each LED assembly 720 includes one or more rows of LEDs. Each row of LEDs extends along a longitudinal axis of the linear LED assembly 720.

All or a portion of the linear LED assembly 720 is positioned inside of or surrounded by a frame 605. In certain exemplary embodiments, the linear LED assembly 620 includes one or more threaded apertures, eyelets or hooks for coupling one end of a suspended line 705. The opposing end of the suspended line 705 is coupled to the ceiling or ceiling tile 110 to place the module 105E in a pendant mounted orientation. In certain exemplary embodiments, the one or more of the suspended lines 705 provides both mechanical support and electrical power to the linear LED assembly 720. In one exemplary embodiment, the suspended line is aircraft cable. In the exemplary embodiment of FIG. 7, two linear LED assemblies 710, 720 are coupled to one another at a right-angle. Means for coupling adjacent LED assemblies 710, 720 are discussed hereinafter in, for example, FIGS. 8-11.

Figure 8A:
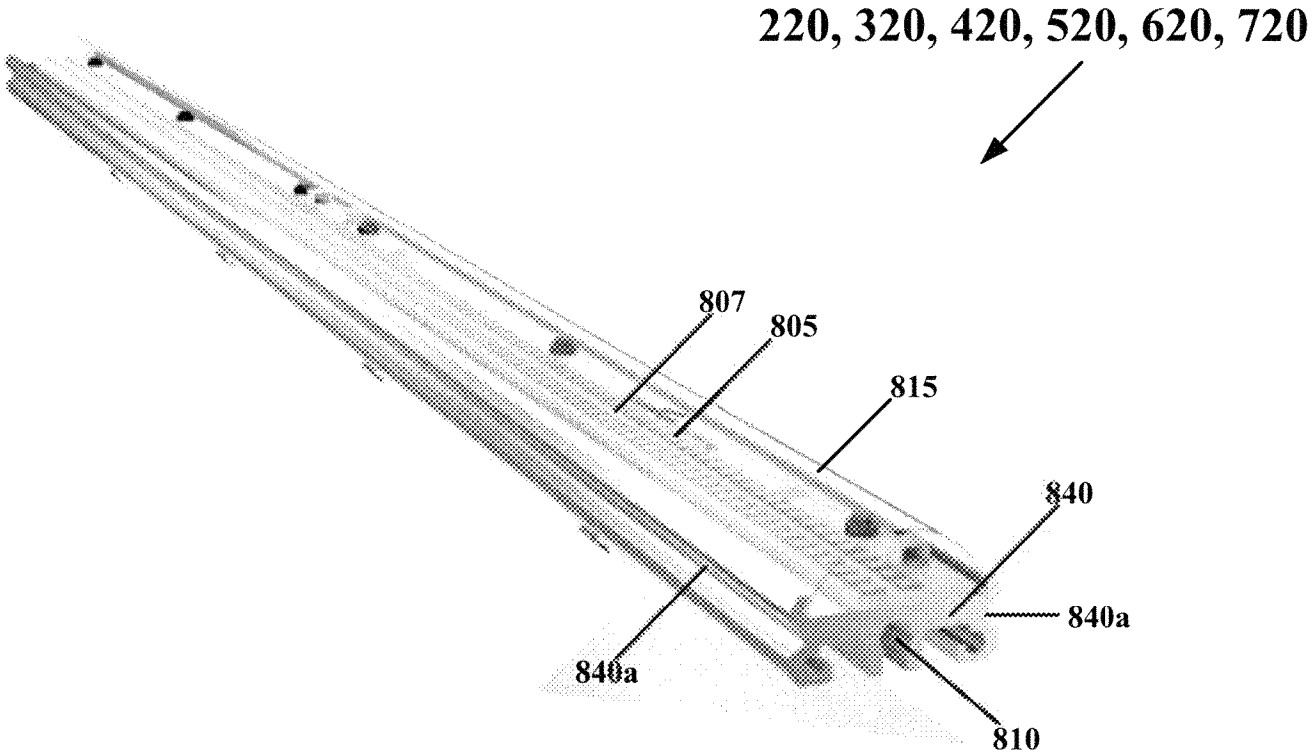
FIGS. 8A-8C are different views of an linear LED assembly for use in one or more of the LED linear lighting modules in accordance with an exemplary embodiment of the present invention.
Figure 8B:
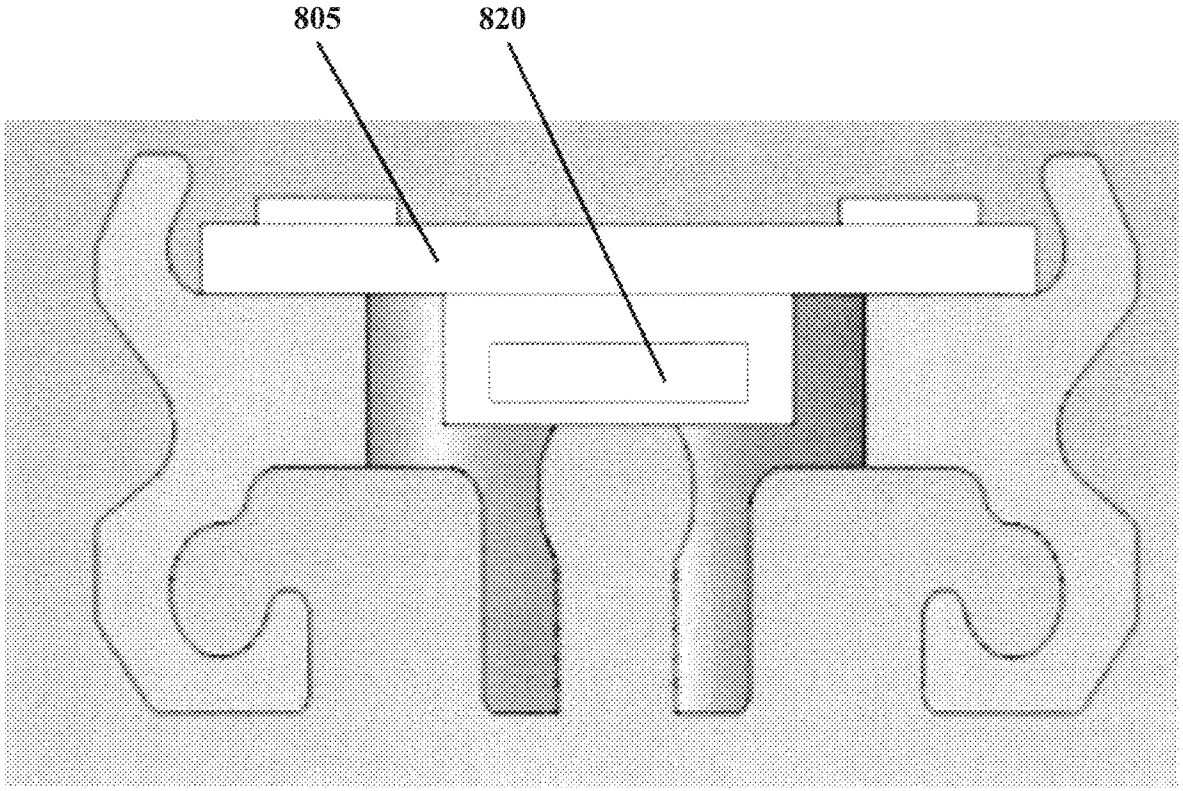
Figure 8C:
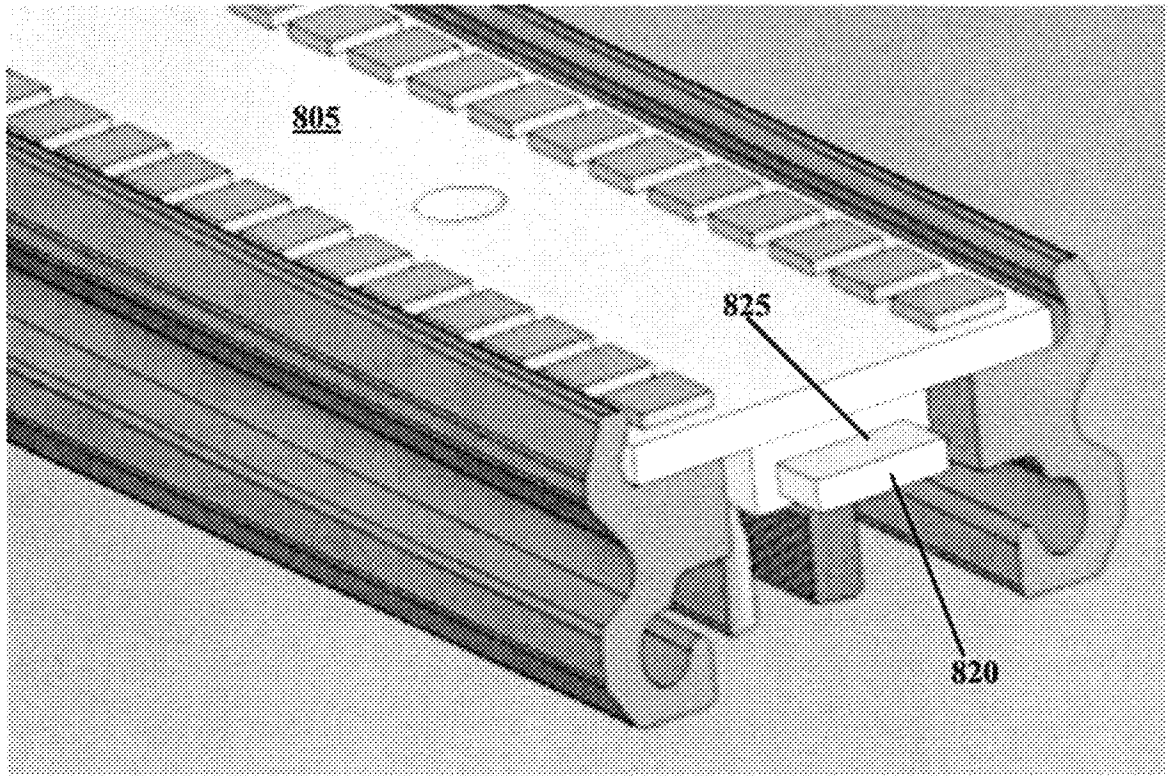

FIGS. 8A-8C illustrate a linear LED assembly 220, 320, 420, 520, 620, 720 in accordance with certain exemplary embodiments. For the sake of brevity, hereinafter the linear LED assembly will be referred to using reference number 220 but will provide support for each of the other embodiments 320, 420, 520, 620, and 720. Now referring to FIGS. 8A-C each linear LED assembly 220 is configured to create artificial light or illumination via multiple LEDs 805. Each LED 805 may be a single LED die, an LED package having one or more LED dies on the package or an OLED.

The linear LED assembly 220 includes at least one substrate 807 to which the LEDs 805 are coupled. Each substrate 807 includes one or more sheets of ceramic, metal, laminate, circuit board, flame retardant (FR) board, mylar, or another material. Although depicted in FIG. 8A as having a substantially rectangular shape, a person of ordinary skill in the art having the benefit of the present disclosure will recognize that the substrate 807 can have any linear or non-linear shape. Each LED 805 is attached to its respective substrate 807 by a solder joint, a plug, an epoxy or bonding line, or other suitable provision for mounting an electrical/optical device on a surface.

In certain exemplary embodiments, an optically transmissive or clear material (not shown) encapsulates at least some of the LEDs 805, either individually or collectively. This encapsulating material provides environmental protection while transmitting light from the LEDs 805. For example, the encapsulating material can include a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating white light.

Each linear LED assembly 220 includes one or more rows of LEDs 805. The term "row" is used herein to refer to an arrangement or a configuration whereby one or more LEDs 805 are disposed approximately in or along a line. LEDs 805 in a row are not necessarily in perfect alignment with one another. For example, one or more LEDs 805 in a row might be slightly out of perfect alignment due to manufacturing tolerances or assembly deviations. In addition, LEDs 805 in a row might be purposely staggered in a non-linear or non-continuous arrangement. Each row extends along a longitudinal axis of the linear LED assembly 220.

Although depicted in FIG. 8A as having two rows of LEDs 805, a person of ordinary skill in the art having the benefit of the present disclosure will recognize that the LEDs 805 can be arranged in any number of different rows, shapes, and configurations without departing from the spirit and scope of the invention. For example, the LEDs 805 can be arranged in four different rows, with each row comprising LEDs 805 of a different color. In certain exemplary embodiments, each row and/or each LED 805 is separately controlled by the driver so that each row can independently be turned on and off or otherwise reconfigured. The number of LEDs 805 on each linear LED assembly 220 can vary depending on the size of the assembly 220, the size of the LEDs 805, the amount of illumination required from the assembly 220, and/or other factors.

Adjacent pairs of LEDs 805 are spaced apart from one another by an equal or substantially equal distance, even when coupling two assemblies 220 together. This equal or substantially equal spacing across the coupled assemblies 220 provides a continuous array of LEDs 805 across the LED modules 105. Because the array is continuous, light output from the coupled together LED modules 105 is continuous, without any undesirable breaks or shadows.

The level of light a typical LED 805 outputs depends, in part, upon the amount of electrical current supplied to the LED 805 and upon the operating temperature of the LED 805. Thus, the intensity of light emitted by an LED 805 changes when electrical current is constant and the LEDs temperature varies or when electrical current varies and temperature remains constant, with all other things being equal. Operating temperature also impacts the usable lifetime of most LEDs 805.

As a byproduct of converting electricity into light, LEDs 805 generate a substantial amount of heat that raises the operating temperature of the LEDs 805 if allowed to accumulate around the LEDs 805, resulting in efficiency degradation and premature failure. Each linear LED assembly 220 is configured to manage heat output by its LEDs 805. Specifically, each assembly 220 includes, in certain exemplary embodiments, a conductive member 840 that is coupled to the substrate 807 and assists in dissipating heat generated by the LEDs 805. Specifically, the member 840 acts as a heat sink for the LEDs 805. The member 840 receives heat conducted from the LEDs 805 through the substrate 807 and transfers the conducted heat to the surrounding environment (typically air) via convection.

The member 840 includes longitudinal side slots 240*a* which are configured to engage or receive portions of spring clips or power supply clips as discussed with reference to FIG. 31. The spring clips or power clips can secure the assembly 220 in place and or provide electrical power to the LEDs 805 via contacts on the substrate 807. The member 840 also includes a center rod mount 810. The center rod mount 810 includes a channel extending at least partially along a longitudinal axis of the member 840. The channel is configured to receive at least one rod or other member (not shown), which may be manipulated to rotate or otherwise move the member 840 and thereby the assembly 220. For example, the rod may be rotated to rotate the member 840 at least partially around an axis of the rod, thereby allowing for adjustment of the light output from the assembly 220.

As shown in FIGS. 8B and 8C, the linear LED assembly 220 includes connectors 820 disposed beneath the LED's 805. Each connector 820 includes one or more electrical wires, plugs, sockets, and/or other components that enable electrical transmission between the linear LED assemblies 220. For example, the connectors 820 may include one or more secure digital (SD) cards, universal series bus (USB) connectors, category 5 (Cat-5) or category 6 (Cat-6) connectors, etc.

In certain exemplary embodiments, one longitudinal end 825*a* of each assembly 220 can include a connector 820 and an opposite longitudinal end (not shown) of the LED assembly 220 can include a corresponding receptacle for the connector 820. Thus, the linear LED assemblies 220 may be connected end-to-end, with each connector 820 being disposed in its corresponding receptacle. Because the connectors 820 and receptacles are disposed beneath the LED's 805 and beneath the substrate 807, the connectors 820 and receptacles are generally not visible when the LED assemblies 220 are coupled to one-another. Thus, the connectors 820 do not create any shadows or other undesirable interruptions in the light output from the LED assembly 220.

Figure 9:
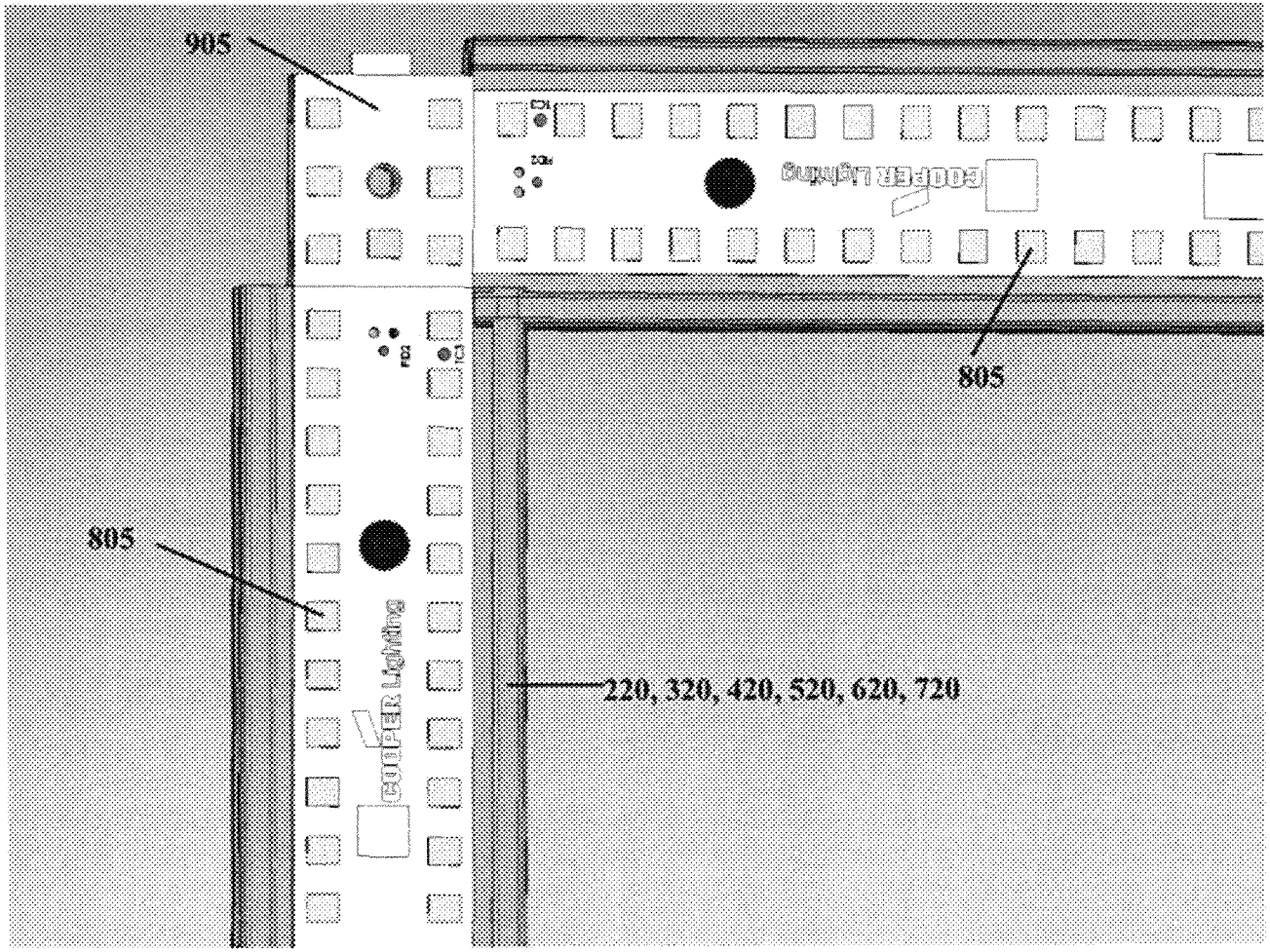
FIGS. 9 and 10 are views of a connector assembly for electrically, optically, and mechanically coupling adjacent LED assemblies in accordance with an exemplary embodiment of the present invention.
Figure 10:
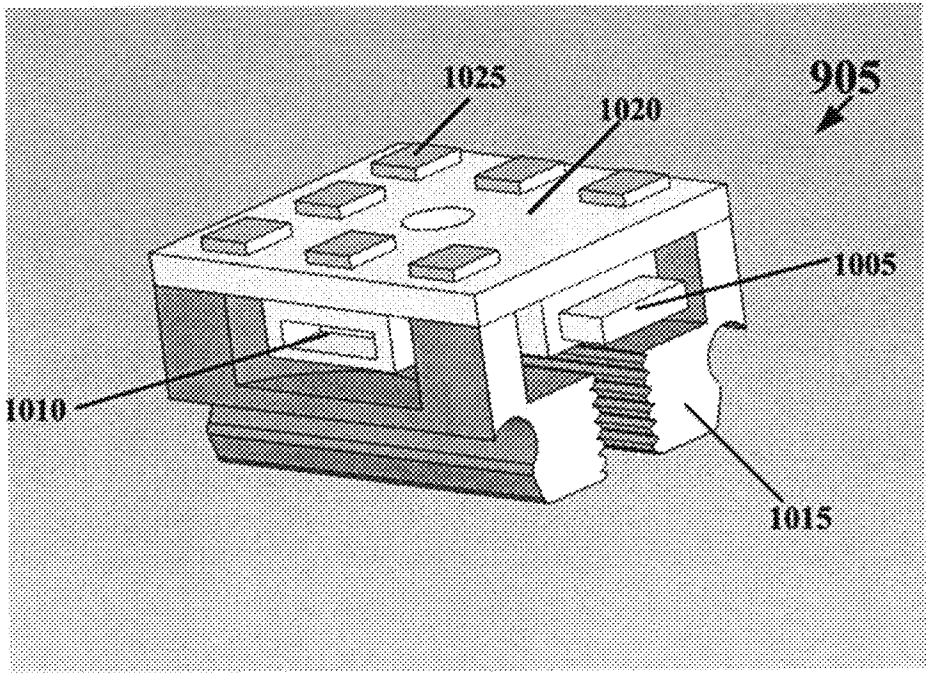

FIGS. 9 and 10 are views of a connector assembly for electrically, optically, and mechanically coupling adjacent LED assemblies 220 according to certain exemplary embodiments. Referring now to FIGS. 9 and 10, the connector 905 is similar to the LED assembly and connectors 820 of FIGS. 8B and 8C, except that the connector 905 includes multiple connection points for joining together multiple assemblies 220. For example, the connector 905 can include one or more male connectors 1005 and one or more female connectors or receptacles 1010, which are configured to couple together with corresponding female connectors and male connectors, respectively, of mating LED assemblies 220. For example, FIG. 9 illustrates LED assemblies 220 coupled together via a connector 905, in accordance with certain exemplary embodiments. While the exemplary connector 905 is shown with one receptacle 1010 and one male connector 1005 it should be understood that each side of the connector 905 can include a connector 1005 and/or receptacle 1010. In an alternative exemplary embodiment, all four sides of the connector 905 include a male connector 1005 and all of the assemblies 220 include female connectors or receptacles one each end thereof. Alternatively, in another exemplary embodiment, all four sides of the connector 905 include a female connector or receptacle 1010 and all of the assemblies 220 include male connectors for releasably coupling to the connector 905. Thus, it is understood that a different assembly 220 can be coupled to each side of the connector 905 at the same time. When the assembly 220 is connected to the connector 905, the combination provides a uniform output of light over the space due to the LEDs 805 being evenly distributed on the assembly 220, the connector 905 and across the transition between the assembly 220 and the connector 905. Thus when two assemblies 220 are linearly connected with the connector 905, there is a uniform output of light from one assembly 220 to the other 220 across the connector 905 due to even or substantially even spacing of the LEDs 805 across the entire three-piece connection.

Although depicted in the figures as a substantially rectangular member, which couples LED assemblies 220 together at right angles, a person of ordinary skill in the art will recognize that the connector 905 can have any shape and can couple the LED assemblies 220 together in any configuration disposed at angles from one-another ranging from 1-359 degrees. For example, the LED connector 905 may have a substantially curved shape in certain alternative exemplary embodiments and provide connector points 1005 and 1010 along an outer perimeter to provide for a hub and spoke configuration of linear LED assemblies 220. In addition, although depicted in the figures as having a substantially smaller length than the lengths of the LED assemblies 220, the LED connector 905 can have any length, whether longer or shorter than—or the same as—the length of the LED assemblies 220, in certain alternative exemplary embodiments. Further, the connection points 1005 and 1010 may be located somewhere other than along the bottom side of the connector 905 in certain alternative exemplary embodiments. For example, the connection points 1005 and 1010 may be located along a top side of the connector 905.

In the embodiment shown in FIG. 10, the connector 905 includes a bottom structure 1015, which may provide structural support, and/or dissipate heat from, the LEDs 1025 on the substrate 1020 of the connector 905, substantially similar to that described with respect to member 840 described above. In certain alternative exemplary embodiments, the connector 905 would not include LEDs 1025.

Figure 11:
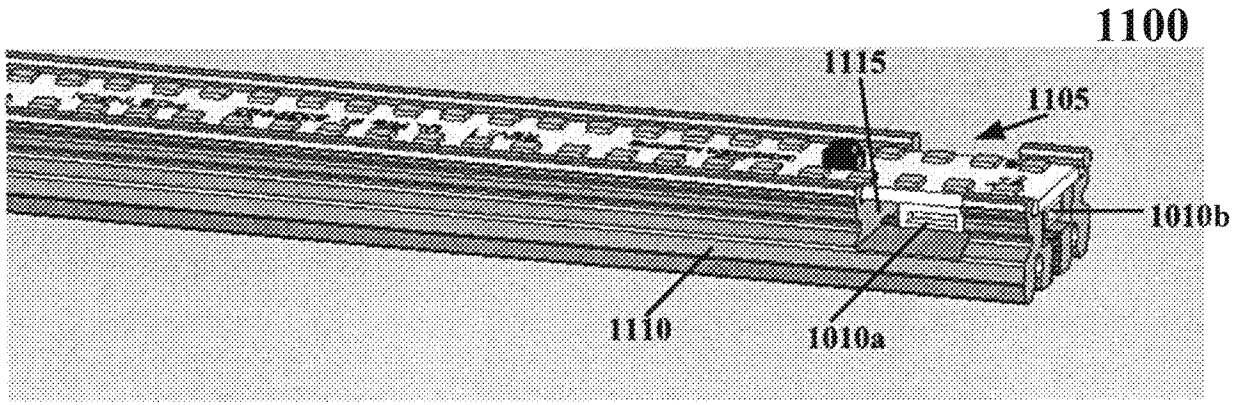
FIG. 11 is a perspective view of an alternative LED assembly that includes an integral connector feature in accordance with an alternative exemplary embodiment of the present invention.

FIG. 11 is a perspective view of an alternative LED assembly 1100 that includes an integral connector, in accordance with certain additional alternative exemplary embodiments. The linear LED assembly 1100 is similar to the linear LED assembly 220, except that the LED assembly 1100 includes an integral connector feature 1105, which enables multiple LED assemblies (that may or may not be similar to the linear LED assembly 1100 or the LED assembly 220) to be coupled to the LED assembly 1100. For example, one additional LED assembly (not shown) may couple to the LED assembly 1100 via a first connector 1010*a* integral in a side of the LED assembly 1100, and another additional LED assembly (not shown) may coupled to the LED assembly 1100 via a second connector 1010*b* integral in the end of the LED assembly 1100. The bottom structure 1110 of the LED assembly 1100 includes a cut-out portion 1115 around the connector 1010*a*, to allow the mating linear LED assemblies adequate room to interface at the connection point. As would be recognized by a person of ordinary skill in the art, the size and shape of the cut-out portion 1115 may vary depending on the sizes and shapes of the mating assemblies.

Figure 14:
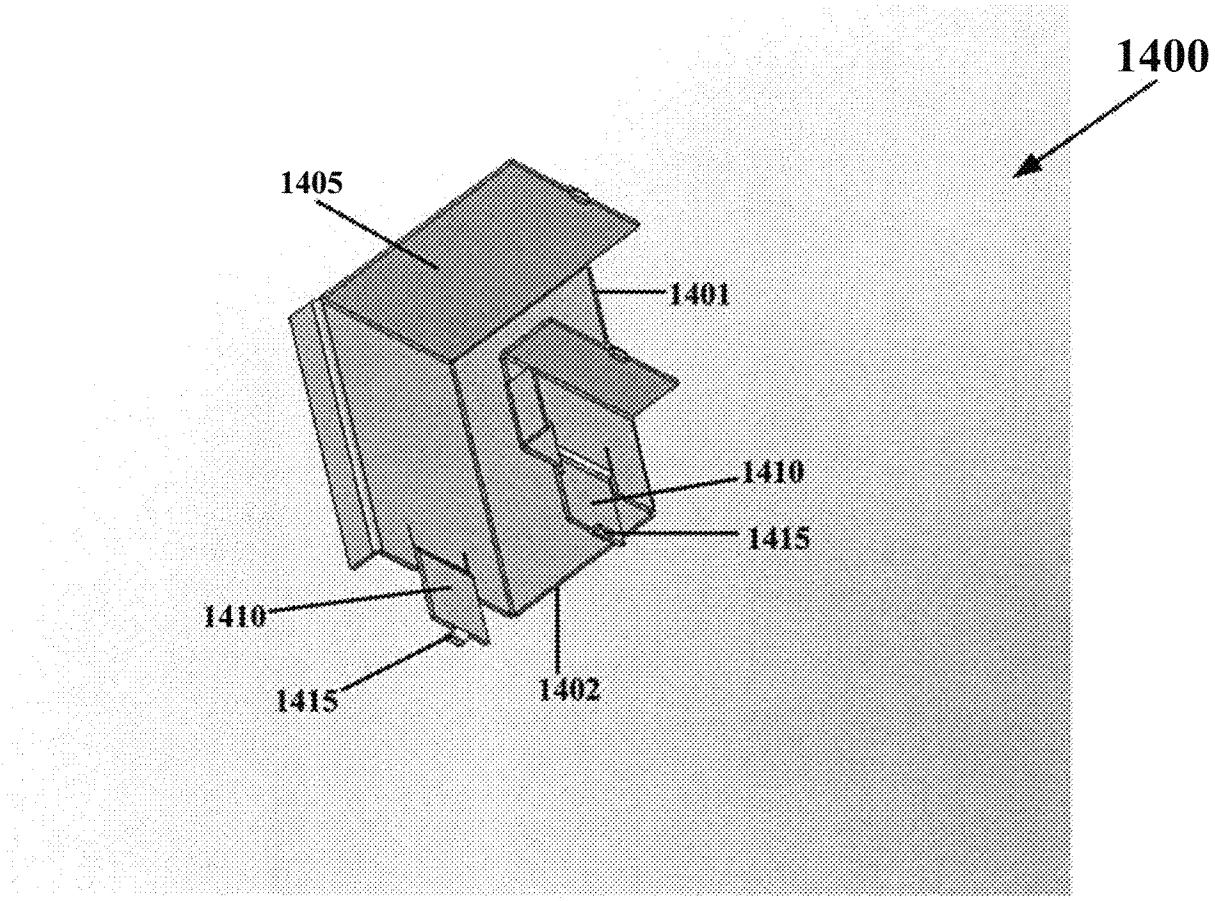
FIG. 14 is a perspective view of an alternative ninety degree connector for connecting two LED linear lighting modules in accordance with an alternative exemplary embodiment of the present invention.

FIG. 14 is a perspective view of a ninety degree connector 1400 in accordance with an exemplary embodiment. Referring to FIGS. 2 and 14, the exemplary connector 1400 includes panel walls 1405 for protecting portions of the LED linear lighting module 105 and is configured to receive two modules 105, one through a first pathway 1401 and one through a second pathway 1402. The connector 1400 also includes members 1410 extending from one or more of the walls 1405. Each member 1410 includes a tab 1415 for engaging and coupling the connector 1400 to the main body 235. For example, each tab 1415 is configured to engage the aperture 1905 or 1925 (FIG. 19) of the main body 235. While the exemplary connector 1400 presents only one pair of members 1410 and tabs 1415, another pair of members 1410 and tabs 1415 is also positionable along the walls adjacent the first pathway 1401.

Figure 15:
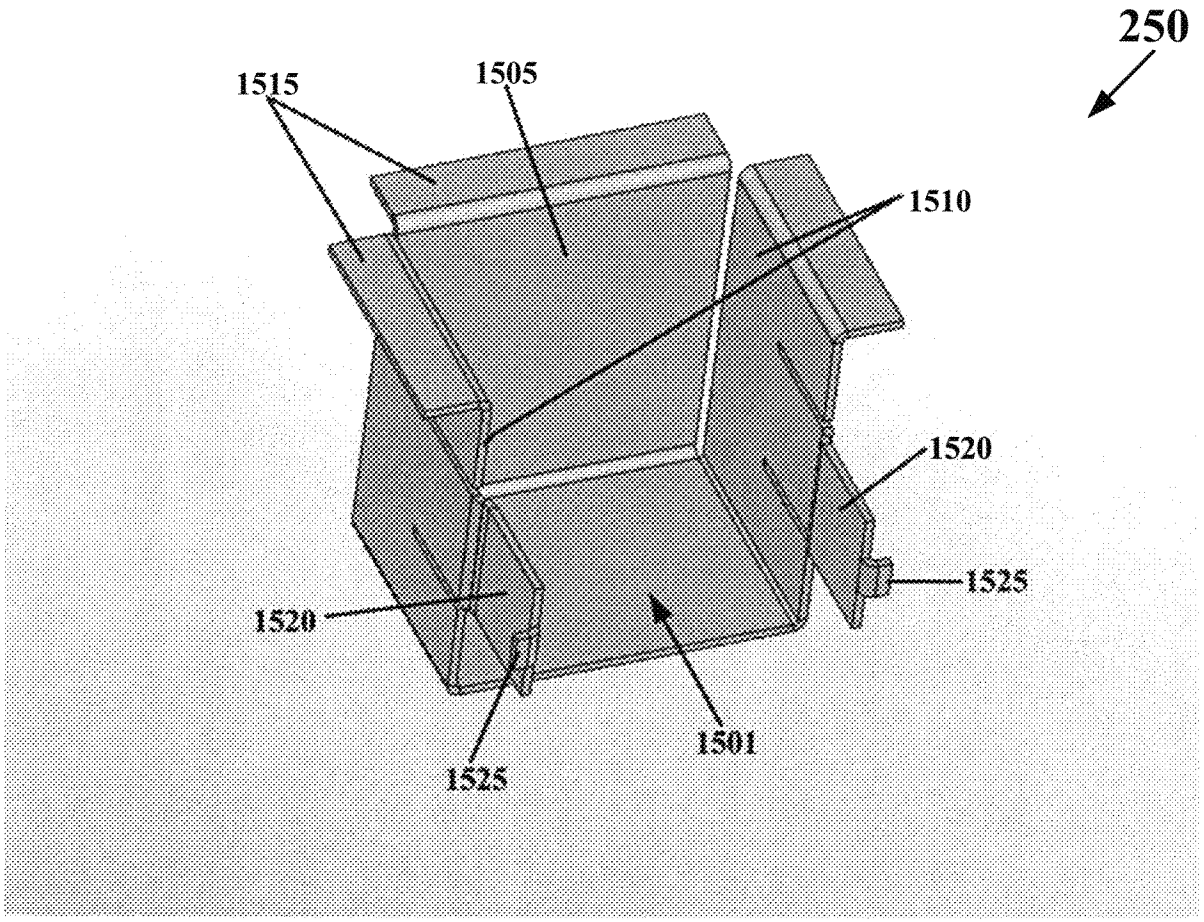
FIG. 15 is a perspective view of an end cap for the LED linear lighting module in accordance with an exemplary embodiment of the present invention.

FIG. 15 is a perspective view of an endcap 250 that is configured to be coupled to the main body 235 in accordance with an exemplary embodiment. Now referring to FIGS. 2 and 15, the exemplary endcap 250 includes a cap and three walls 1505, 1510 extending down from the cap in a generally orthogonal manner. At the bottom of each of the walls 1505, 1510 are flanges 1515 that extend outward from the walls 1505, 1510 in a generally orthogonal manner. The flanges are positioned adjacent the top surface of the ceiling tile 110 and provide structural support for the LED linear lighting module 105. The endcap 250 includes a pathway 1501 for receiving one end of the main body. The endcap also includes members 1520 extending from the walls 1510. Each member 1520 includes a tab 1525 for engaging and coupling the endcap 250 to the main body 235. For example, each tab 1525 is configured to engage the aperture 1905 or 1925 (FIG. 19) of the main body 235. An exemplary embodiment the endcap 250 coupled to an LED linear lighting module 105 is provided in FIGS. 21 and 37.

Figure 16:
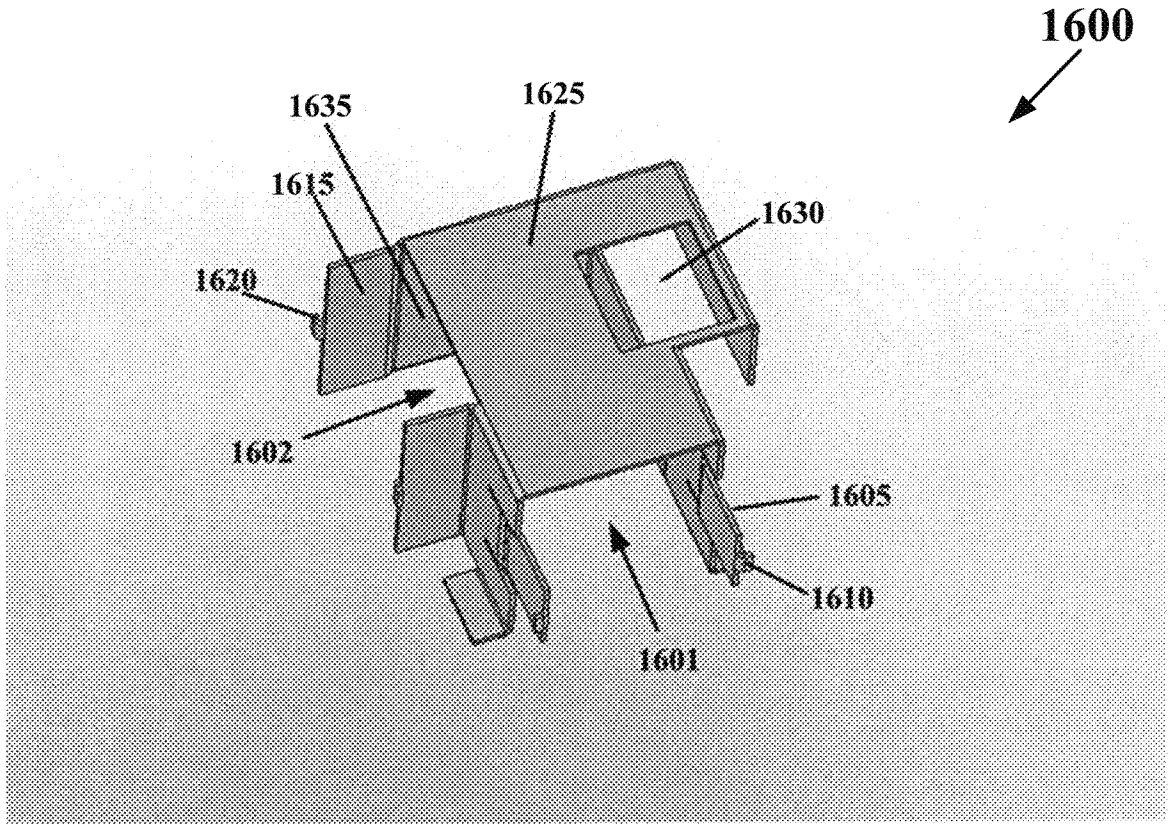
FIG. 16 is a perspective view of a ninety degree corner feed connector for connecting two LED linear lighting modules in accordance with an alternative exemplary embodiment of the present invention.

FIG. 16 is a perspective view of a ninety degree corner feed connector 1600 that is configured to receive two LED linear lighting modules 105 in accordance with an exemplary embodiment. Referring to FIGS. 2 and 16, the exemplary corner feed connector 1600 includes a cap 1625, one or more walls 1635 extending downward from the cap 1625 in a generally orthogonal manner, and an aperture 1630 in the cap 1625 for receiving and providing access to the RJ-45 connector 225 or any other class 2 wire connector. The corner feed connector 1600 also includes a first pathway 1601 for receiving a linear lighting module 105 and a second pathway 1602 for receiving another linear lighting module. The walls 1635 along each of the pathways include members 1605, 1615 extending from the walls 1635. Each member 1605, 1615 includes a tab 1610, 1620 respectively, for engaging and coupling the corner feed connector 1600 to the main body 235 of the linear lighting module 105. For example, each tab 1610, 1620 is configured to engage the aperture 1905 or 1925 (FIG. 19) of the main body 235. An exemplary embodiment the corner feed connector 1600 coupled to a pair of LED linear lighting modules is provided in FIG. 37.

Figure 17:
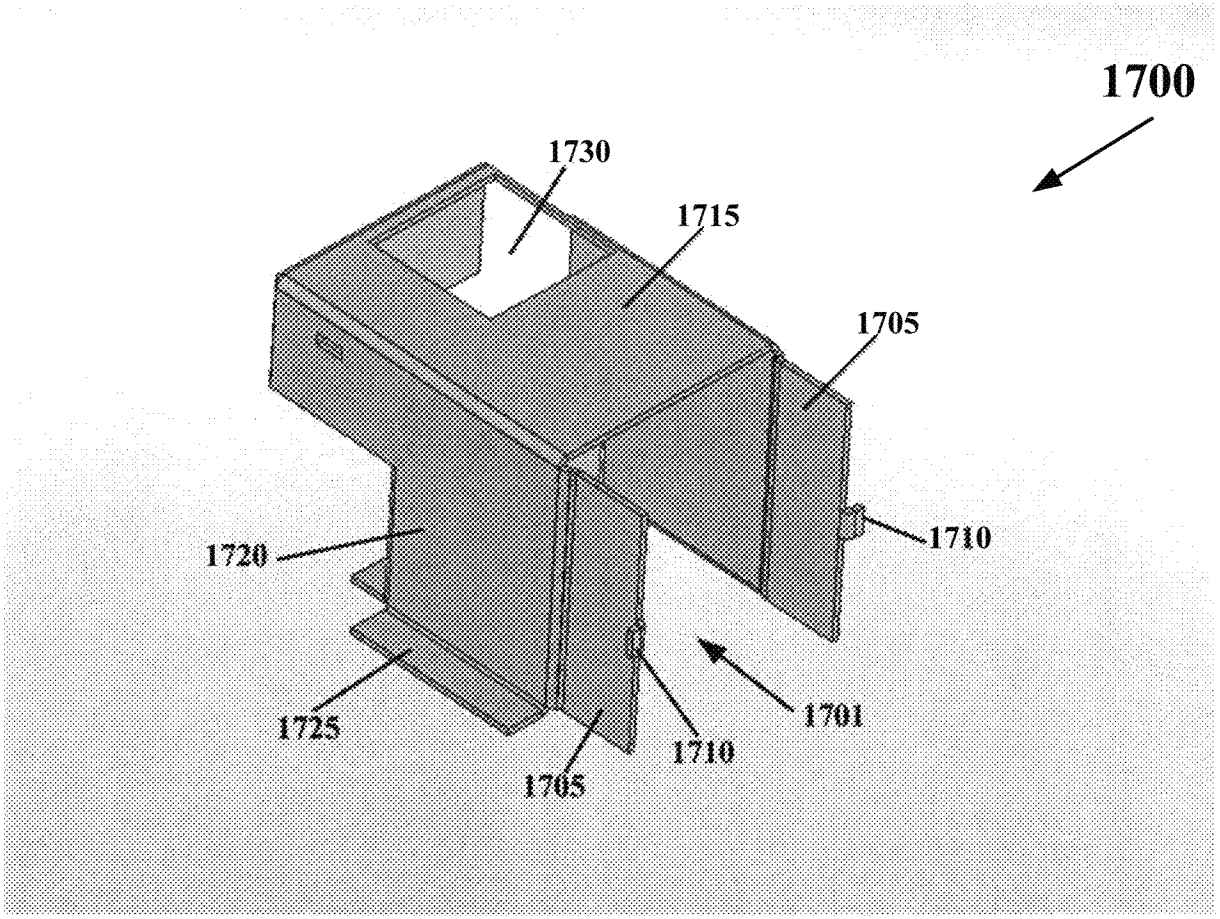
FIG. 17 is a perspective view of a straight feed end for the LED linear lighting modules in accordance with an alternative exemplary embodiment of the present invention.
Figure 21:
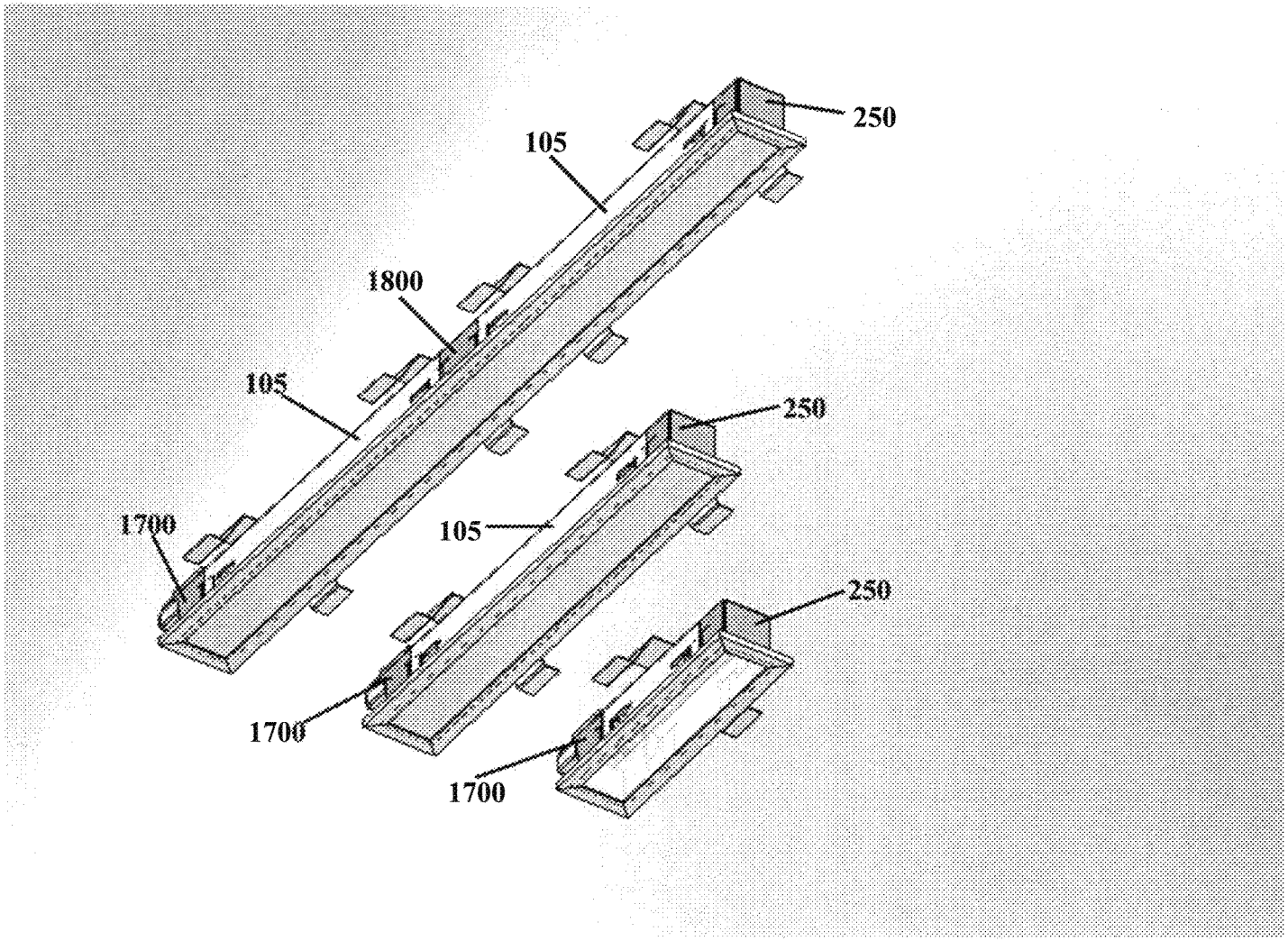
FIG. 21 is a bottom perspective view of alternative sizes of the LED linear lighting module in accordance with an exemplary embodiment of the present invention.
Figure 22:
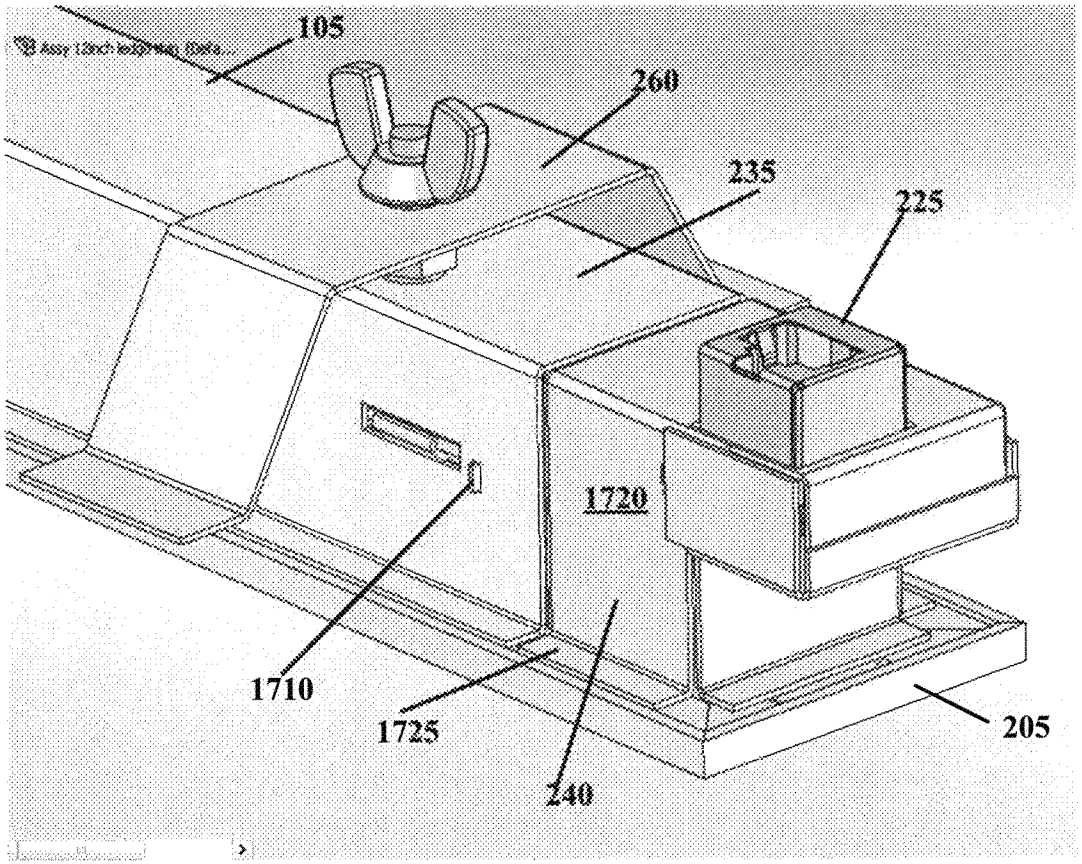
FIG. 22 is a partial perspective view of a power feed system for the LED linear lighting modules in accordance with an exemplary embodiment of the present invention.

FIG. 17 is a perspective view of a straight feed end connector 1700 that is configured to receive an LED linear lighting module 105 in accordance with an exemplary embodiment. Referring to FIGS. 2 and 17, the exemplary straight feed end connector 1700 includes a cap 1715, one or more walls 1720 extending downward from the cap 1715 in a generally orthogonal manner and an aperture 1730 in the cap 1715 for receiving and providing access to the RJ-45 connector or any other class 2 wire connector 225. The opposing end of each wall 1720 also includes a flange 1725 extending in a generally orthogonal manner from the end of the wall 1720. The flanges 1725 are positioned adjacent to and apply a force against the top surface of the ceiling tile 110 and provide structural support for the LED linear lighting module 105. The straight feed end connector 1700 includes a pathway 1701 for receiving a linear lighting module 105. The walls 1720 along the pathway 1701 include members 1705 extending from the walls 1720. Each member 1705 includes a tab 1710 for engaging and coupling the connector 1700 to the main body 235 of the linear lighting module 105. For example, each tab 1710 is configured to engage the aperture 1905 or 1925 (FIG. 19) of the main body 235. FIGS. 21 and 22 provide an exemplary view of a straight feed end connector 1700 coupled to an LED linear lighting module 105 with the RJ-45 connector or any other class 2 wire connector 225 disposed through the aperture 1730.

Figure 18:
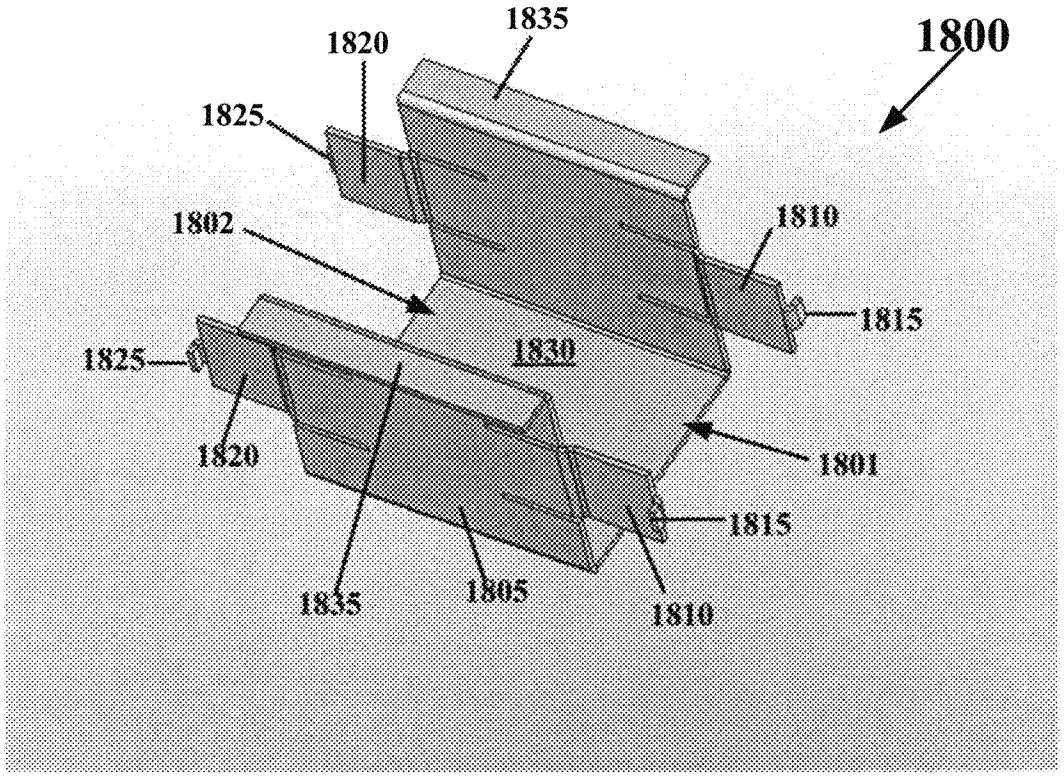
FIG. 18 is a perspective view of a splice for connecting two LED linear lighting modules in accordance with an alternative exemplary embodiment of the present invention.
Figure 19:
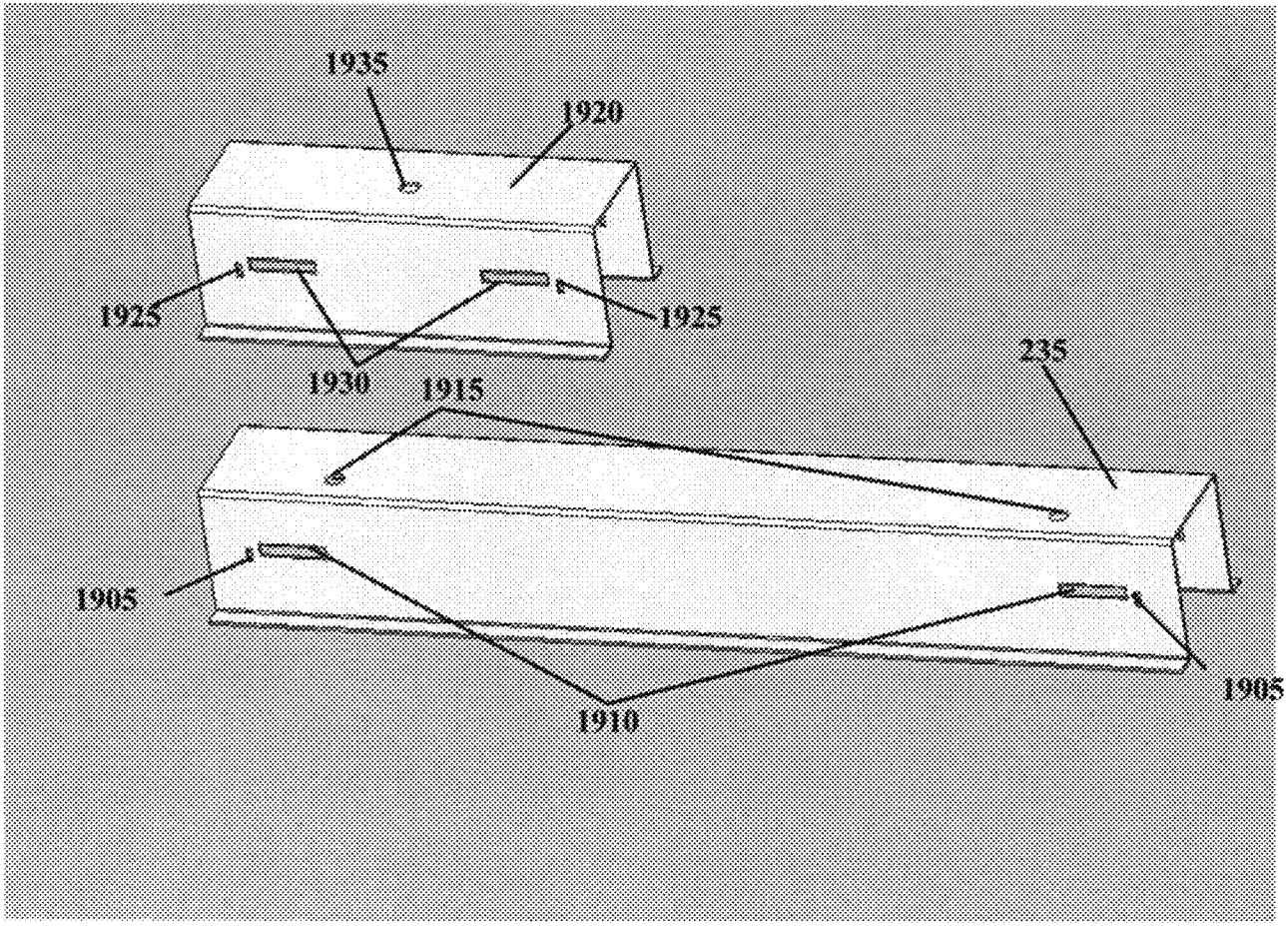
FIG. 19 is a perspective view of two alternative housing bodies for the LED linear lighting module of FIG. 2 in accordance with an exemplary embodiment of the present invention.
Figure 20:
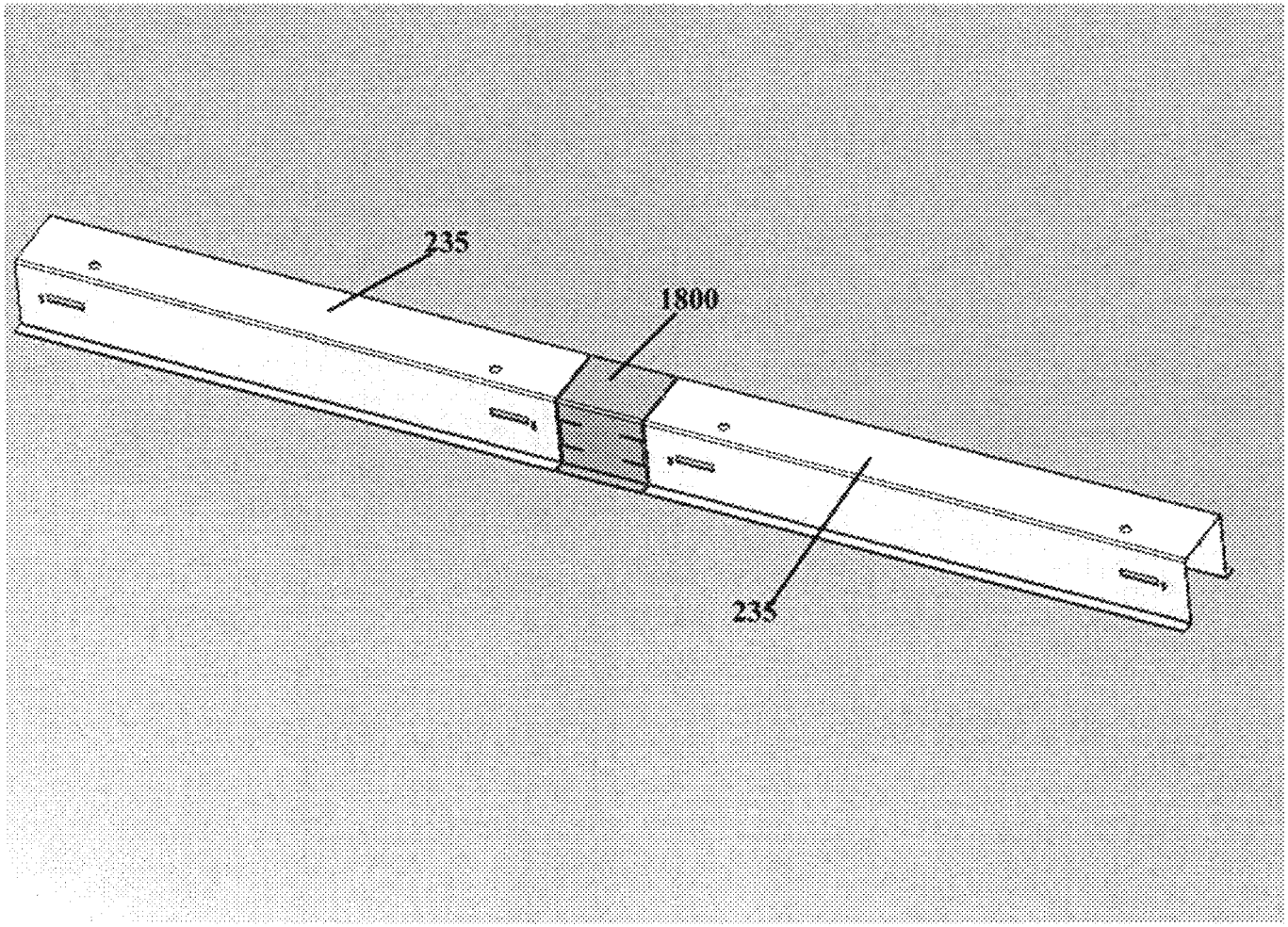
FIG. 20 is a perspective view presenting two LED linear lighting modules of FIG. 2 coupled together with a splice of FIG. 18 in accordance with an exemplary embodiment of the present invention.

FIG. 18 is a perspective view of a splice connector 1800 for connecting two LED linear lighting modules 105 in accordance with an exemplary embodiment. Referring to FIGS. 2 and 18, the splice connector 1800 includes a cap 1830 and a pair of walls 1805 extending down from the cap 1830 in a generally orthogonal manner. The opposing end of each wall 1805 also includes a flange 1835 extending in a generally orthogonal manner from the end of the wall 1805 and positioned adjacent to and applying a force against the top surface of the ceiling tile 110 to provide structural support of the LED linear lighting module 105. The splice 1800 includes a first pathway 1801 for receiving a first LED linear lighting module 105 and a second pathway 1802 for receiving a second LED linear lighting module 105. Splicing together individual LED linear lighting modules 105 creates a longer straight section of the LED luminaire then the individual LED linear lighting modules 105. For example, while individual LED linear lighting modules 105 of the exemplary embodiment are generally dimensioned at six inches and twelve inches, as shown in FIGS. 19 and 21, by using multiple LED linear lighting modules 105 and multiple splices 1800 a luminaire having the appearance of a single unified body can extend for up to 150 feet or more. The length of the connected modules 105 is generally only restricted by the number of power supplies and the amount of power that can be provided at the installation site. The walls 1805 of the splice 1800 along each of the pathways 1801, 1802 include members 1810, 1820 extending from the walls 1805. Each member 1810, 1820 includes a tab 1815, 1825 for engaging and coupling the splice connector 1800 to the main body 235 of the linear lighting module 105. For example, each tab 1815, 1825 is configured to engage the aperture 1905 or 1925 (FIG. 19) of the main body 235. An example of two main bodies 235 coupled together with a splice 1800 is shown in FIG. 20. Another example of two LED linear lighting modules 105 coupled together with a splice 1800 is presented in FIG. 21.

While the exemplary embodiments of FIGS. 14-18 present splices and connectors that are either straight or change the direction of the linear modules 105 at ninety degree angles, it should be understood that the angle of adjustment for the right corner of FIG. 14 and the corner feed of FIG. 16 is adjustable anywhere between 1 and 359 degrees and modifying these embodiments to achieve those angles is within the knowledge and skill of those of ordinary skill in the art of lighting manufacturing. Accordingly, virtually any shape and length can be created using the LED linear lighting modules 105 and the connectors and splices described above, including those shapes presented in FIGS. 21, 27, 29, and 34-38.

Figure 29:
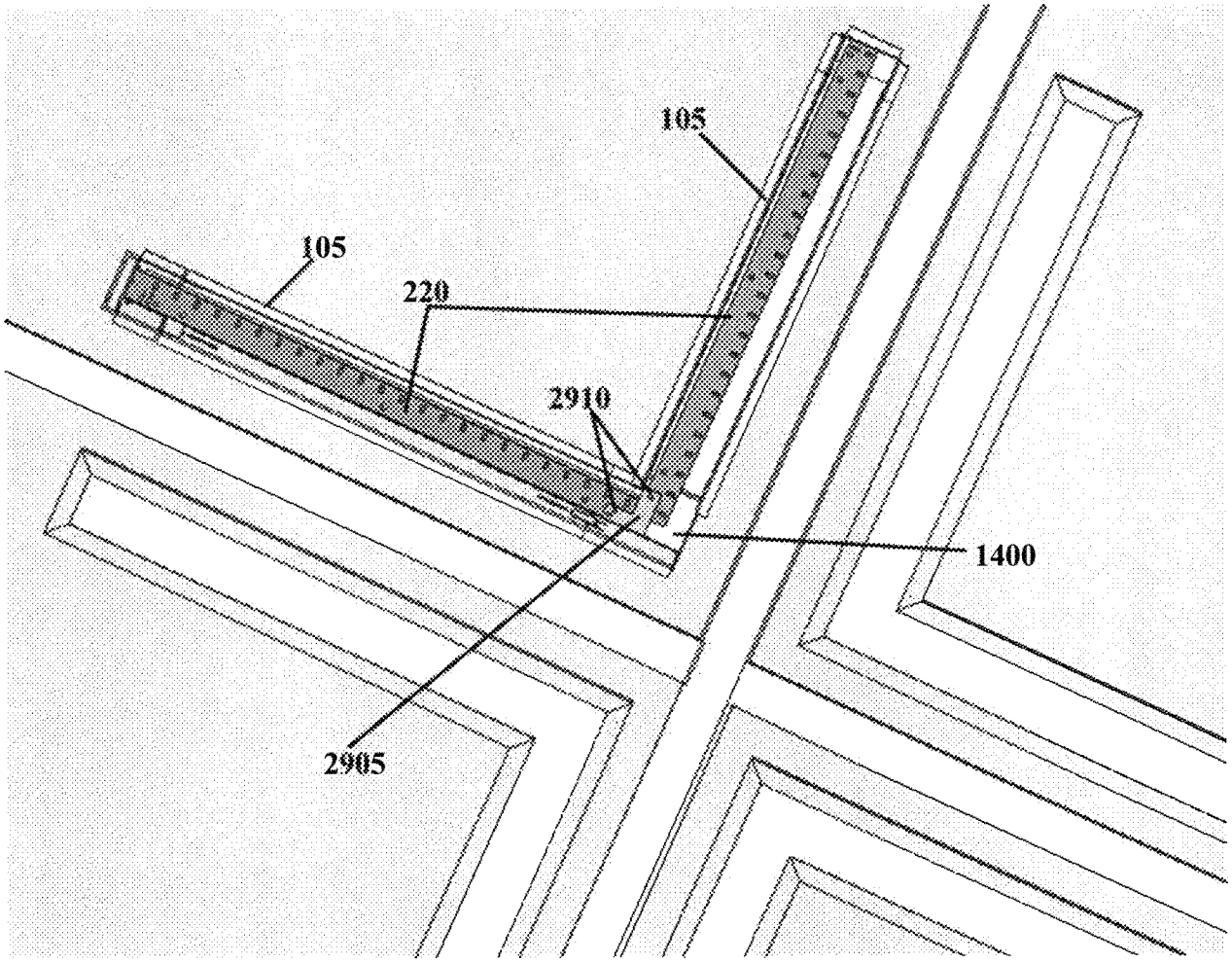
FIG. 29 is a top plan view of an alternative power coupling between two LED linear lighting modules in accordance with an alternative exemplary embodiment of the present invention.

Further, in conjunction with each of the connectors of FIGS. 9-18 that connect two separate LED linear lighting modules 105 or assemblies 220, power can be transmitted from the linear LED assemblies 220 of one module 105 to the linear LED assemblies 220 of the second module 105, as shown in the exemplary embodiment of FIGS. 9-11 and 29. Referring to FIG. 29, two LED linear lighting modules 105 are connected together with a ninety degree right corner connector 1400 (of FIG. 14). In addition, the linear LED assemblies 220 of each module 105 are electrically coupled with an FR-4 board 2905 that includes traces for transmitting power from one linear LED assembly 220 to the other. In the exemplary embodiment, the FR-4 board 2905 includes two plastic pins 2910 each extending orthogonally out from the board 2905. Each pin 2910 is configured to slidably engage one of the linear LED assemblies 220 so that the traces on the FR-4 board 2905 make electrical contact with the traces on each linear LED assembly 220 and an electrical path between the assemblies 220 is created. In alternative embodiments, a jumper wire or other conventional electrical connector are used to electrically couple the two LED linear lighting modules 105.

Figure 30:
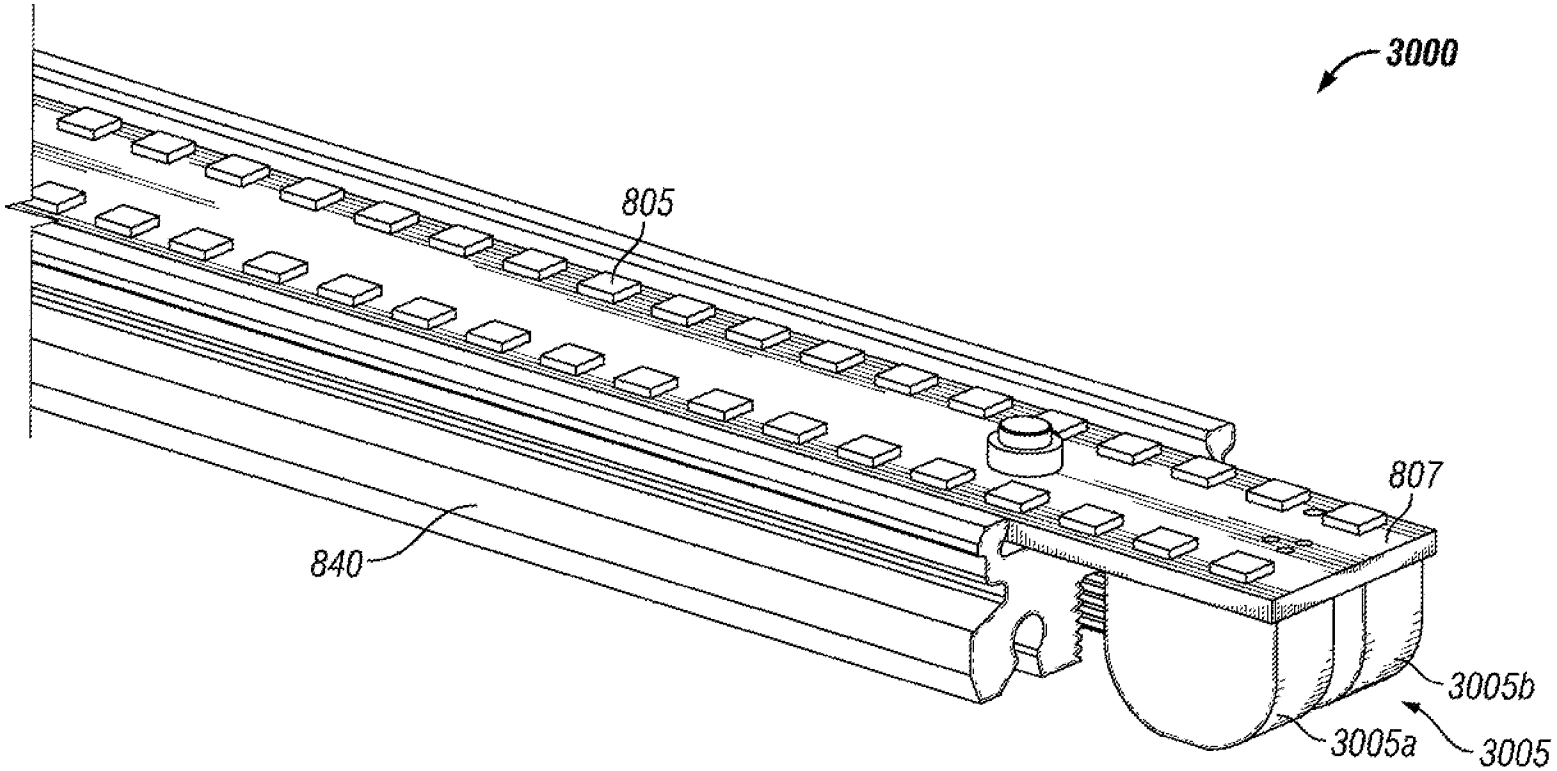
FIG. 30 is a perspective view of an alternative linear LED assembly in accordance with an alternative exemplary embodiment of the present invention.

FIG. 30 is a perspective view of an another alternative linear LED assembly 3000 in accordance with certain additional alternative exemplary embodiments. The linear LED assembly 3000 is similar to assembly 220 described above in FIG. 8, except that one or more magnets or conductive metals 3005*a* and 3005*b* couple the assembly 3000 (including LED modules 105 and member 840) to a desired surface. For example, the surface of the ceiling tile 110 may include a track system (not shown) or segments of tracks of any length that are configured to be magnetically coupled thereto. The tracks can provide an easy to use, toolless mechanical connection of the assembly 3000 to the desired mounting surface. In addition, in certain embodiments, the tracks also provide electrical power to the assembly 3000 when coupled to the tracks.

In certain exemplary embodiments, the track system has two tracks that are made of conductive magnets. Alternatively, the tracks are made of a conductive material that is suitably attracted to magnets, such as steel or another metal that is attracted to a magnet. Whether the tracks are magnetic or made of a conductive material, in certain exemplary embodiments, one of the tracks carries a positive electrical charge and the other track carries a negative electrical charge. For example, the track system can be coupled to the bottom surface of the ceiling tile 110. Low voltage DC power can be provided to the track through the tile 110 by way of a feed wire 3915 from the power control box (as discussed with reference to FIGS. 23 and 39), from another LED module having dual class 2 wire jacks (as discussed with reference to FIG. 42), or from a master LED module having multiple class 2 wire connection points (as discussed with reference to FIG. 44. In addition, one or more of the tracks, such as in a two or three track system could also provide data or control signals (either separately or through power line control signals) for operatively controlling the linear LED assembly 3000.

The magnets or conductive metals 3005*a* and 3005*b* are coupled to the bottom side of the substrate 807 via an adhesive, one or more screws, a rivet, pin, or other fastening means. When the members 3005*a* and 3005*b* are magnets, the magnets 3005*a* and 3005*b* may have the same or opposite polarity. Electrical contacts on the substrate 807 provide an electrical path between the magnets or conductive metal 3005*a* and 3005*b* and the LEDs 805 on the substrate. When the magnets 3005*a* and 3005*b* contact the tracks, the magnets 3005*a* and 3005*b* electrically couple the linear LED assembly 3000 to the tracks, which powers the LEDs 805. The magnets can be insulated, e.g., by being coated with an anodized material, to electrically isolate the magnets 3005*a* and 3005*b* with respect to one another. Thus, power may be provided to the LED's 805 via the magnets 3005*a* and 3005*b* without the need for additional wires or other electrical connectors. In certain alternatives of this embodiment, the member 840 can be made of a non-conductive material to limit the possibility of power being transmitted through the member 840 if it were to come into contact with the powered track.

Figure 31:
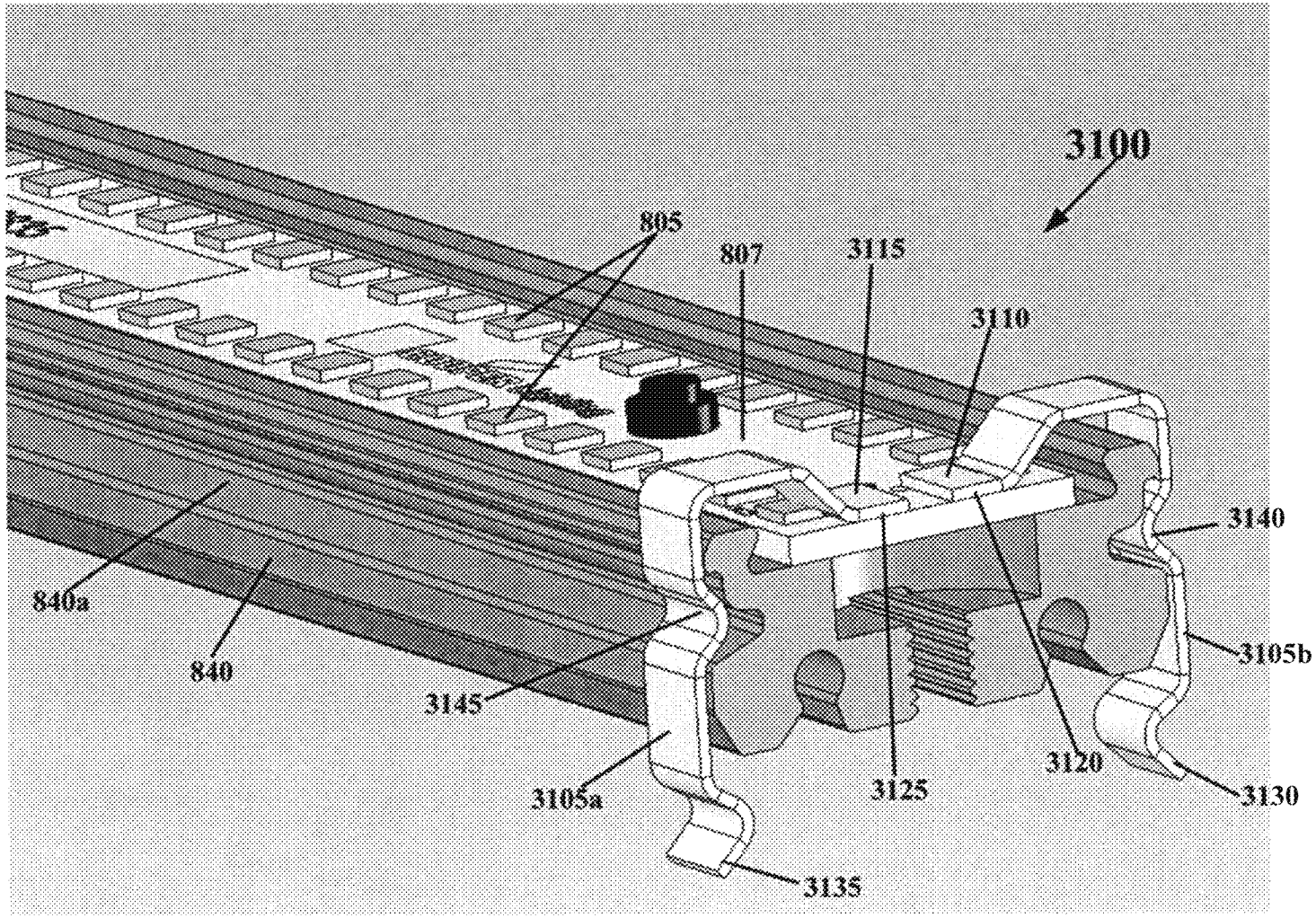
FIG. 31 is a perspective view of another alternative linear LED assembly in accordance with an alternative exemplary embodiment of the present invention.

FIG. 31 is a perspective view of a linear LED assembly 3100, in accordance with certain additional alternative exemplary embodiments. The linear LED assembly 3100 is similar to assembly 3000 described above, except that, instead of magnets mechanically and/or electrically coupling the assembly 3000 to a track, track system, or one or more magnetic and/or conductive members, clips 3105*a* and 3105*b* mechanically or mechanically and electrically couple the linear LED assembly 3100 to the desired surface. Like the magnets 3005*a* and 3005*b*, in certain exemplary embodiment, the clips 3105*a* have different polarities that allow power to be provided to the LEDs 805 on the substrate 807 without the need for additional wires or other electrical connectors. For example, first ends 3130 and 3135 of the clips 3105*a* and 3105*b* can contact a powered surface and/or can engage a mating surface for holding the linear LED assembly 3100 mechanically in place. Opposing ends 3110 and 3115 of the clips 3105*a* and 3105*b*, respectively, rest on and engage a conductive top surface and/or contacts 3120 and 3125 respectively on the top side of the substrate 807. In this exemplary embodiment, current flows through a circuit, which includes the clips 3105*a* and 3105*b*, the conductive contacts 3120 and 3125 on the top surface of the substrate 807, and a power source (not shown), such as those power source options described above with reference to FIG. 30, to which the clips 3105*a* and 3105*b* are coupled. As discussed, the clips 3105*a* and 3105*b* may receive power by being coupled to a powered surface, such as a rail or track system.

Figure 32:
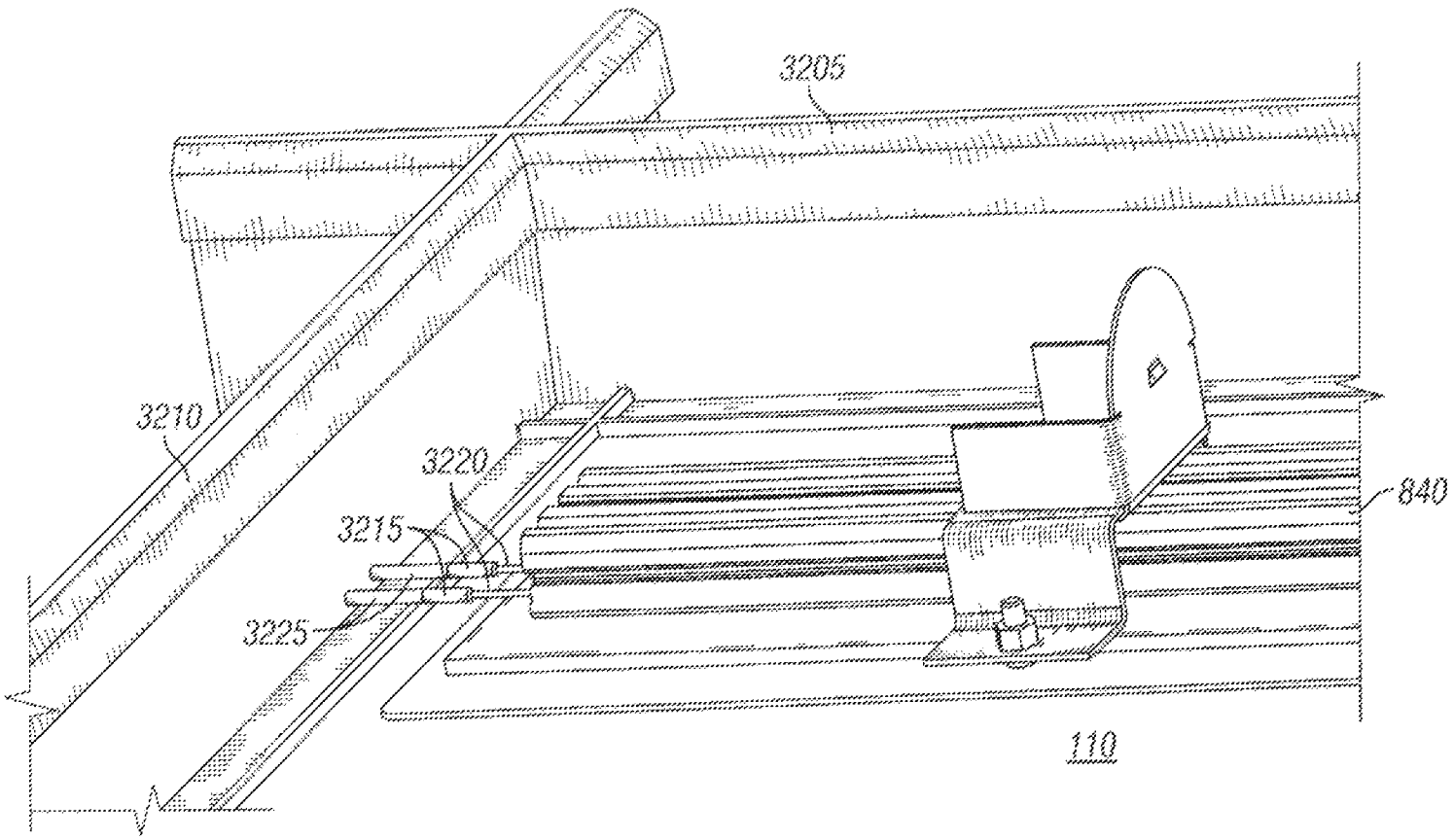
FIG. 32 is a perspective view of yet another alternative linear LED assembly in accordance with an alternative exemplary embodiment of the present invention.
Figure 33:
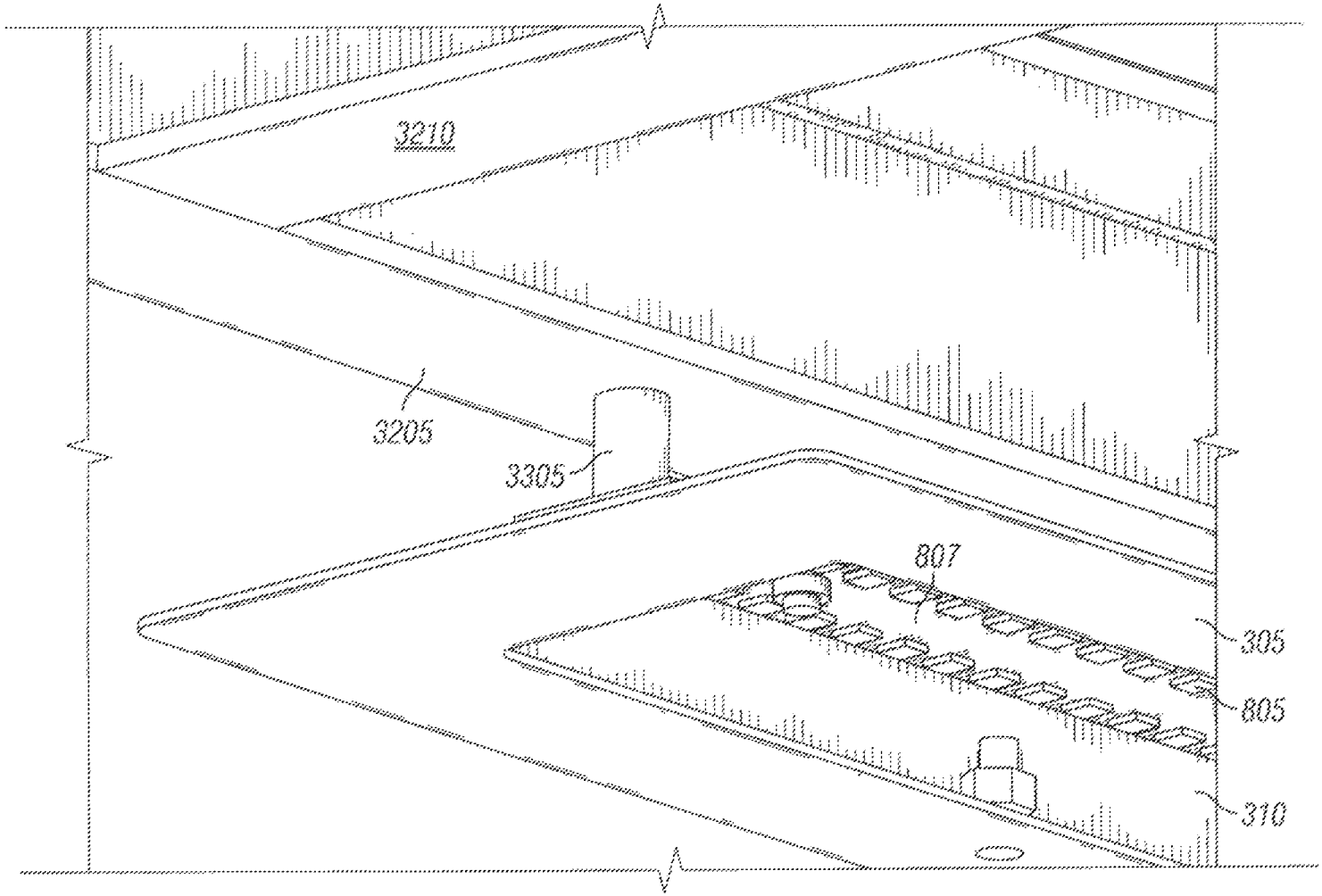
FIG. 33 is a perspective view of another alternative linear LED assembly in accordance with an alternative exemplary embodiment of the present invention.
Figure 34:
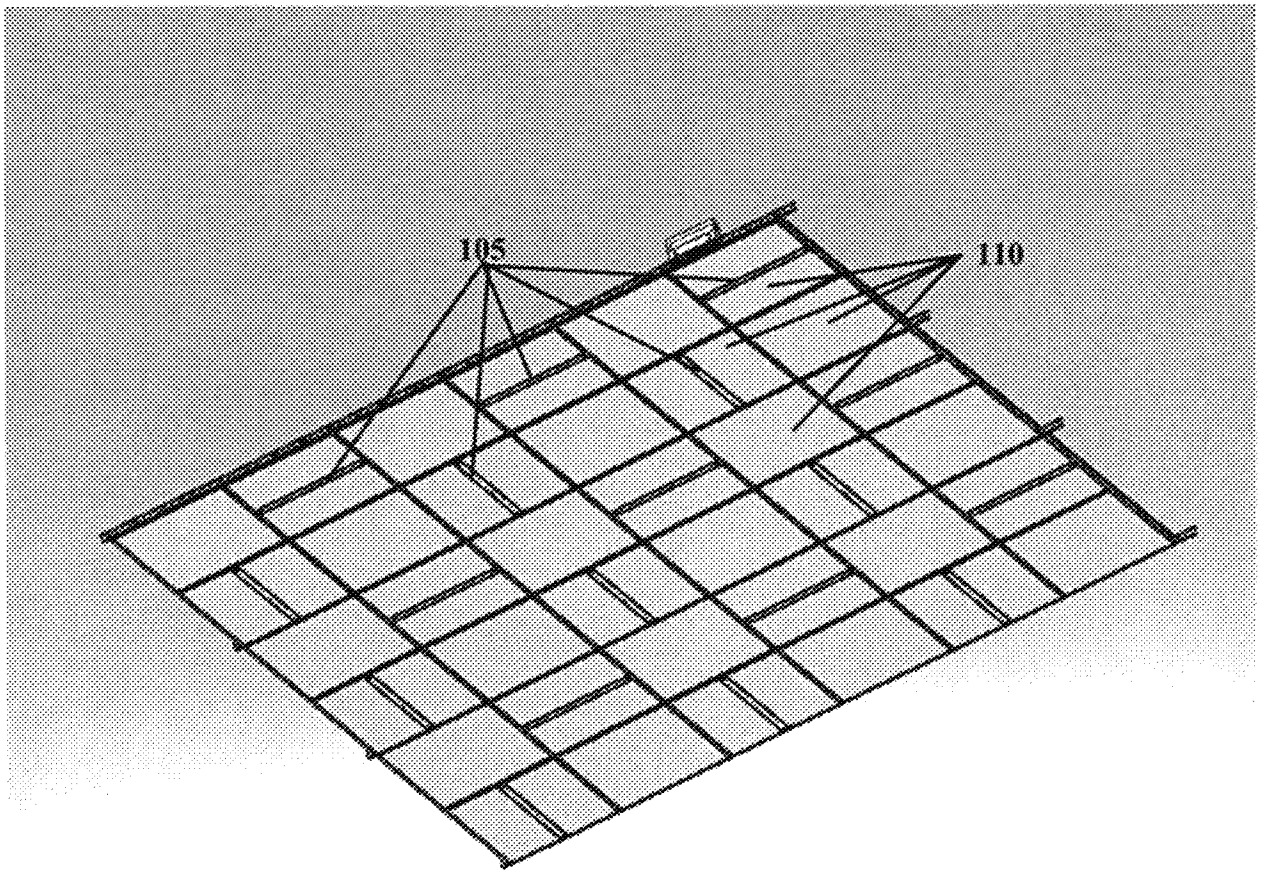
FIGS. 34-38 are different combinations that can be created with the LED linear lighting module, feeds, connectors, and splices in accordance with an exemplary embodiment of the present invention.
Figure 35:
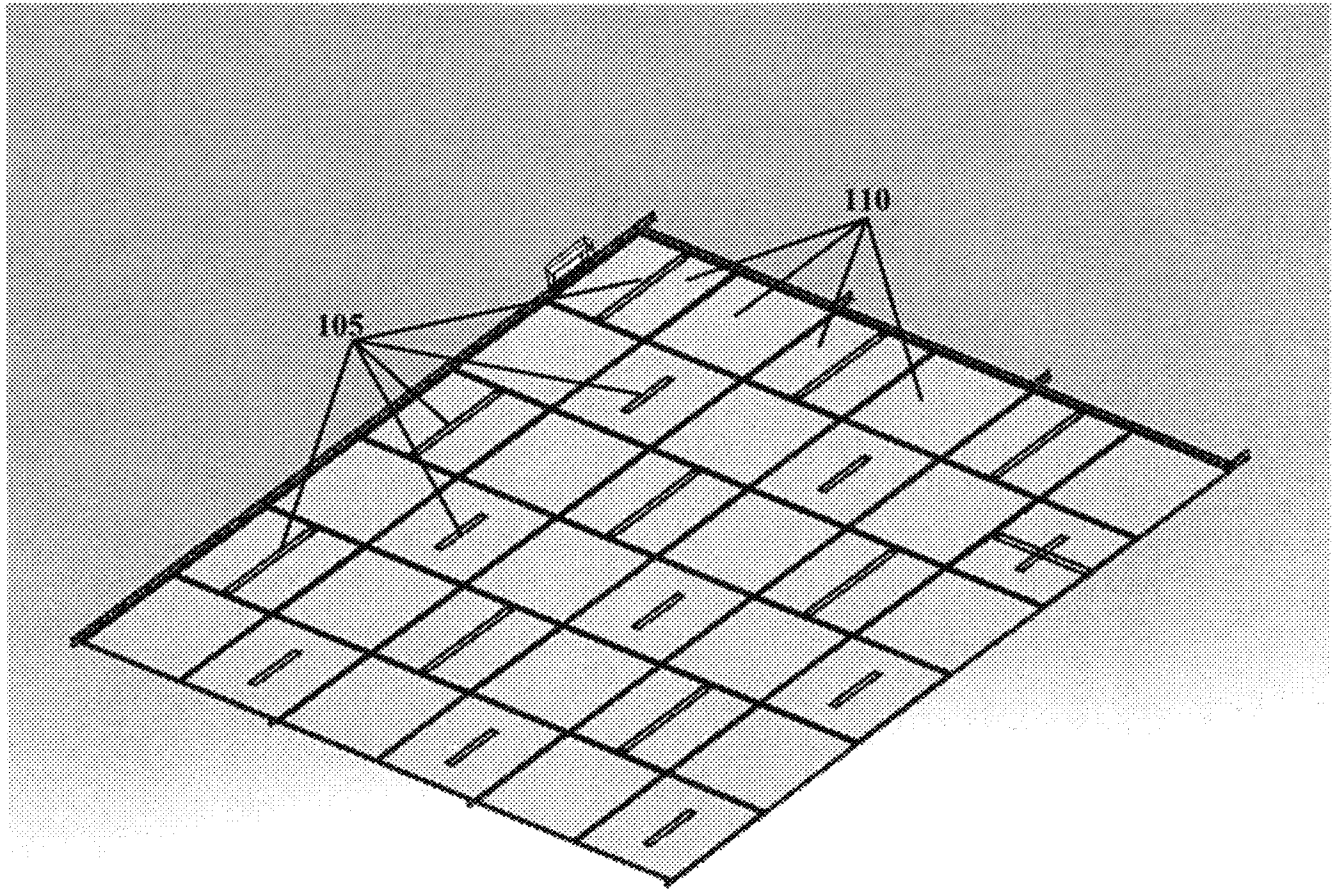
Figure 36:
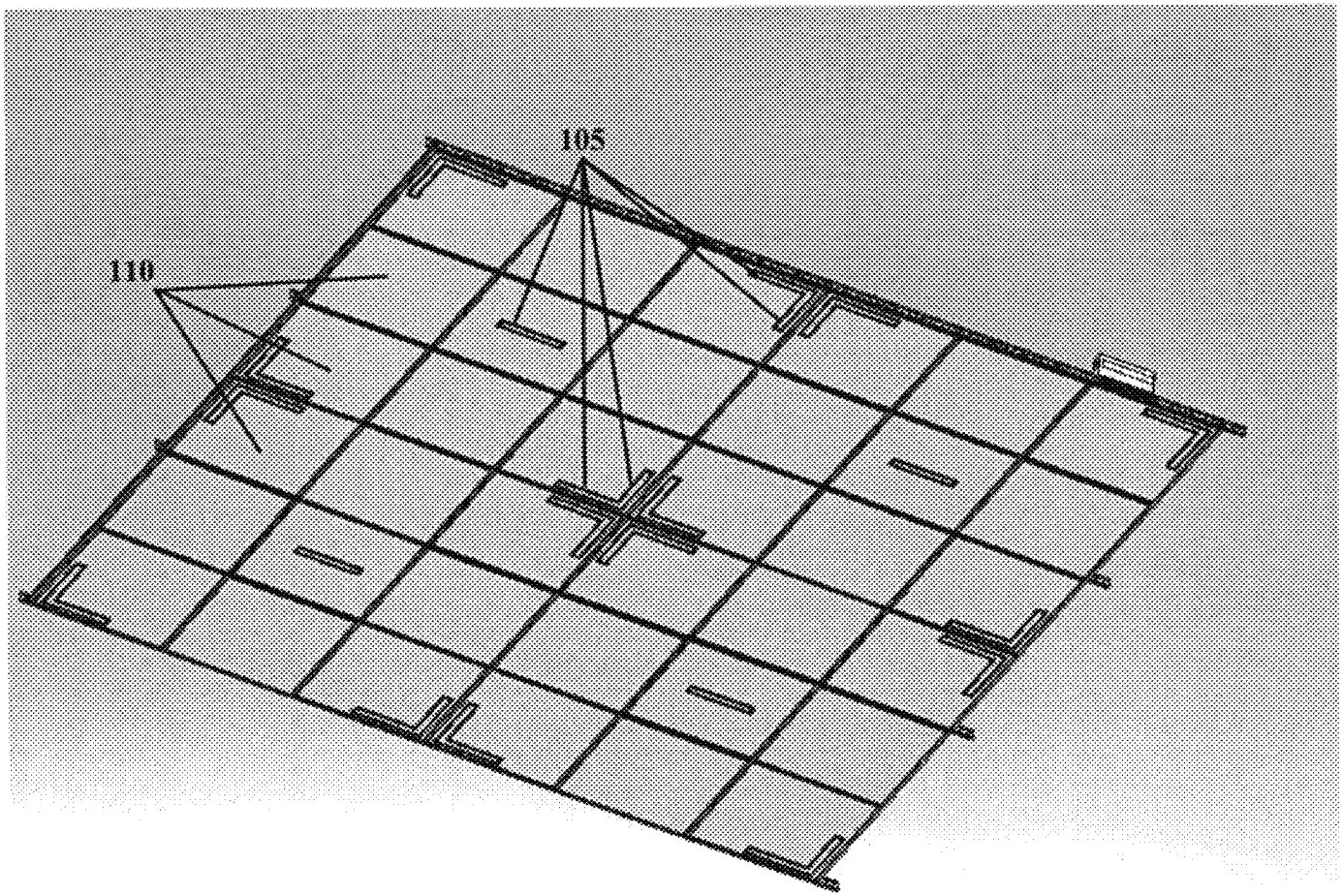
Figure 37:
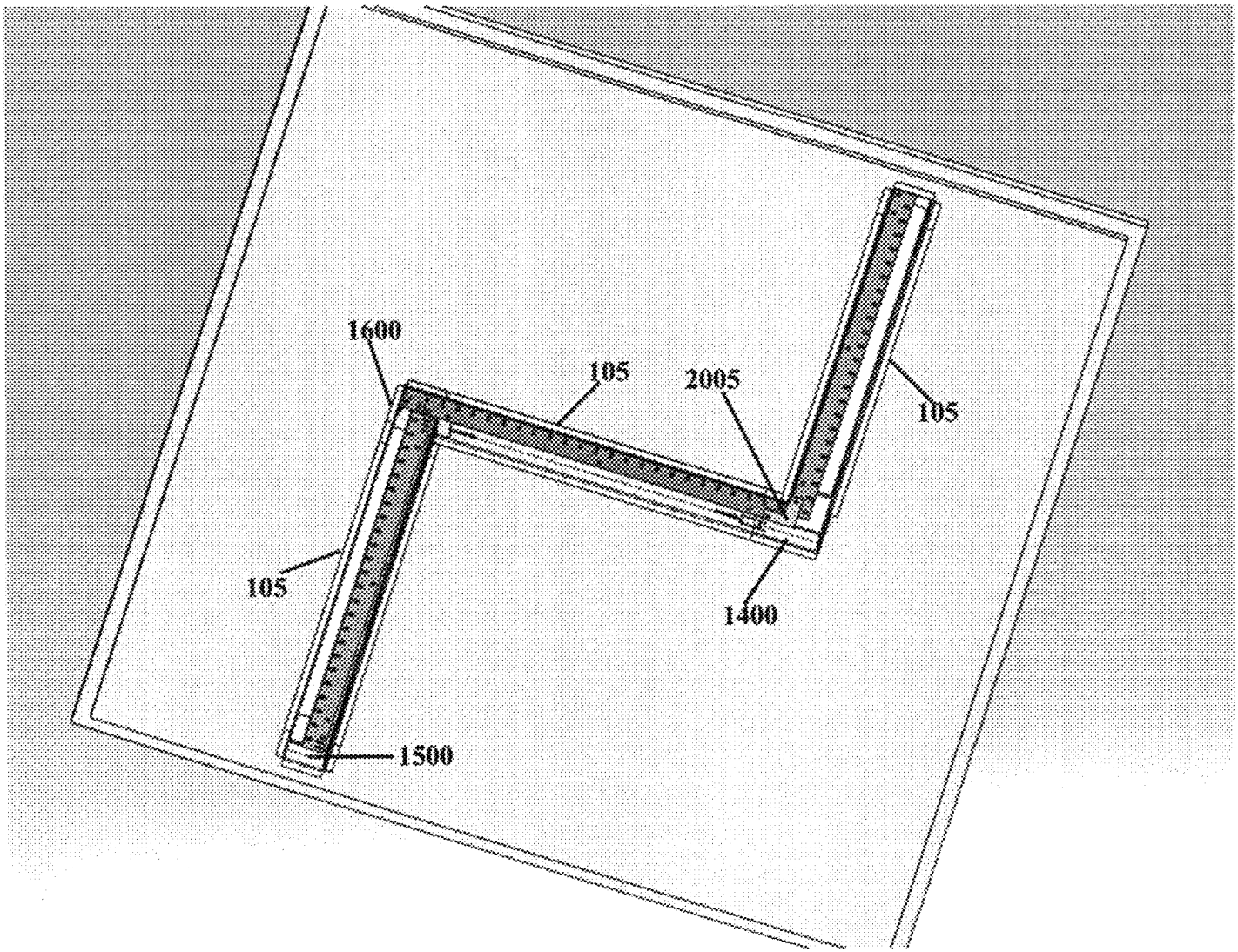
Figure 38:
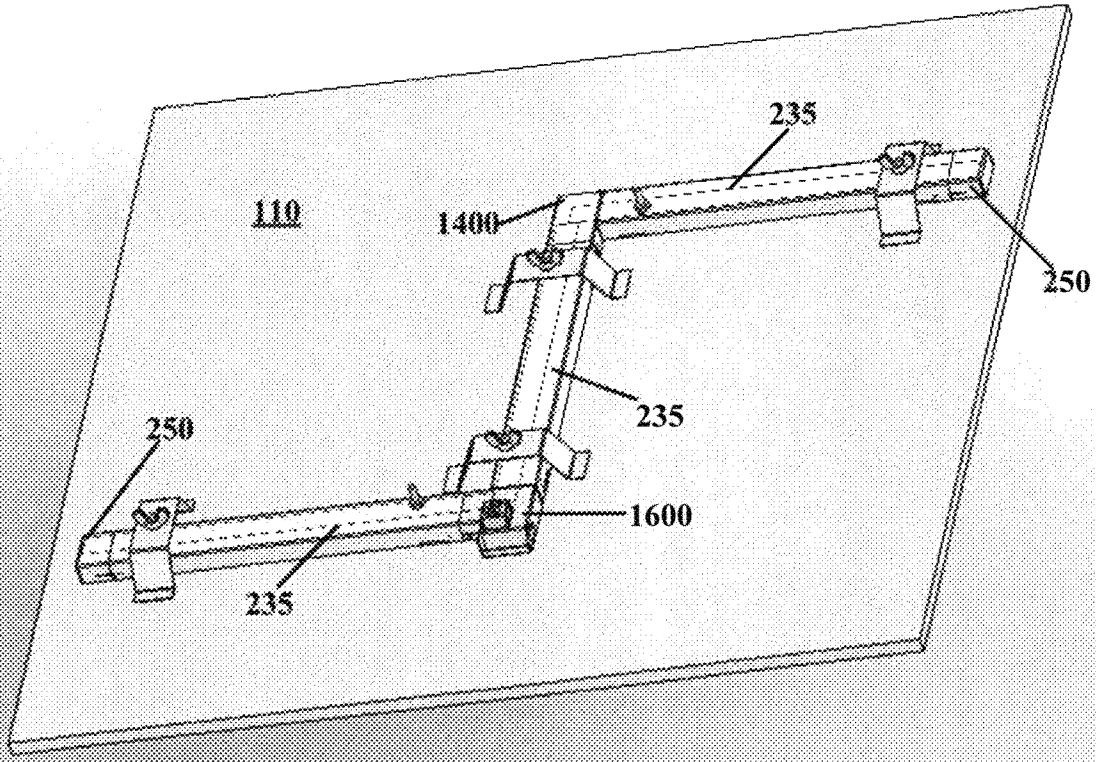

FIGS. 32 and 33 provide perspective views of a linear LED assemblies that are configured to be electrically or both electrically and mechanically connected to a powered T-grid system. Referring now to FIGS. 32 and 33, the exemplary embodiment includes a T-grid similar to those that are typically used in drop-ceiling systems. The T-grid includes intersecting members 3205 and 3210. One or more of the intersecting T-grid members 3205 and 3210 is a powered surface, similar to track system described with regard to FIGS. 30 and 31 above. The T-grid members 3205 and 3210 provide low voltage DC power to which linear LED assemblies can couple to power the LEDs 805 on the substrate 807. In certain exemplary embodiments, one or more wires 3220 that are electrically coupled along one end to the substrate 807 and electrically coupled on the distal end to a connector 3215 that is configured to engage and or mate-up with an electrical connector 3225 on the T-grid member 3210. In certain exemplary embodiments, instead of wires, clips (similar to those in FIG. 31) or magnets (similar to those in FIG. 30) may be used instead to electrical couple the linear LED assembly to the powered T-grid members 3205 and 3210.

For example, FIG. 33, illustrates an LED module with a magnet 3305 that is electrically coupled to the substrate 807 to power the LEDs 805. The magnet 3305 is also mechanically coupled to the LED module. In certain embodiments, the magnet is coupled to the substrate 807 similar in manner to that shown in FIG. 30. When the magnet 3305 contacts one or more of the powered T-grid members 3205 and 3210, electrical power flows from the T-grid member through the magnet, to the substrate 807. In certain embodiments, the magnet 3305 or multiple magnets are of sufficient strength, that the magnets also mechanically support or hold the LED module to the T-grid members 3205 and 3210. Thus, the T-grid members 3205 and 3210 are capable of providing both mechanical and electrical support for the LED module.

FIG. 19 presents perspective views of two alternative housings 235, 1920. In the exemplary embodiment, the first housing 235 has a linear length of about twelve inches and the second housing 1920 has a linear length of about six inches. However, additional lengths from less than an inch up to ten feet are capable and within the scope and spirit of the present disclosure. Each housing 235, 1920 includes a first set of apertures 1905, 1925 disposed along its walls for receiving tabs from connectors, such as those described with reference to FIGS. 14-18 above. Each housing 235, 1920 also includes a second set of apertures 1910, 1930 disposed along its walls for receiving tabs of vertical clips 220 to hold the lens frame 205 in place. Each housing 235, 1920 also includes at least one aperture 1915, 1935 in the cap area for receiving the machine screws 227 therethrough.

Figure 23:
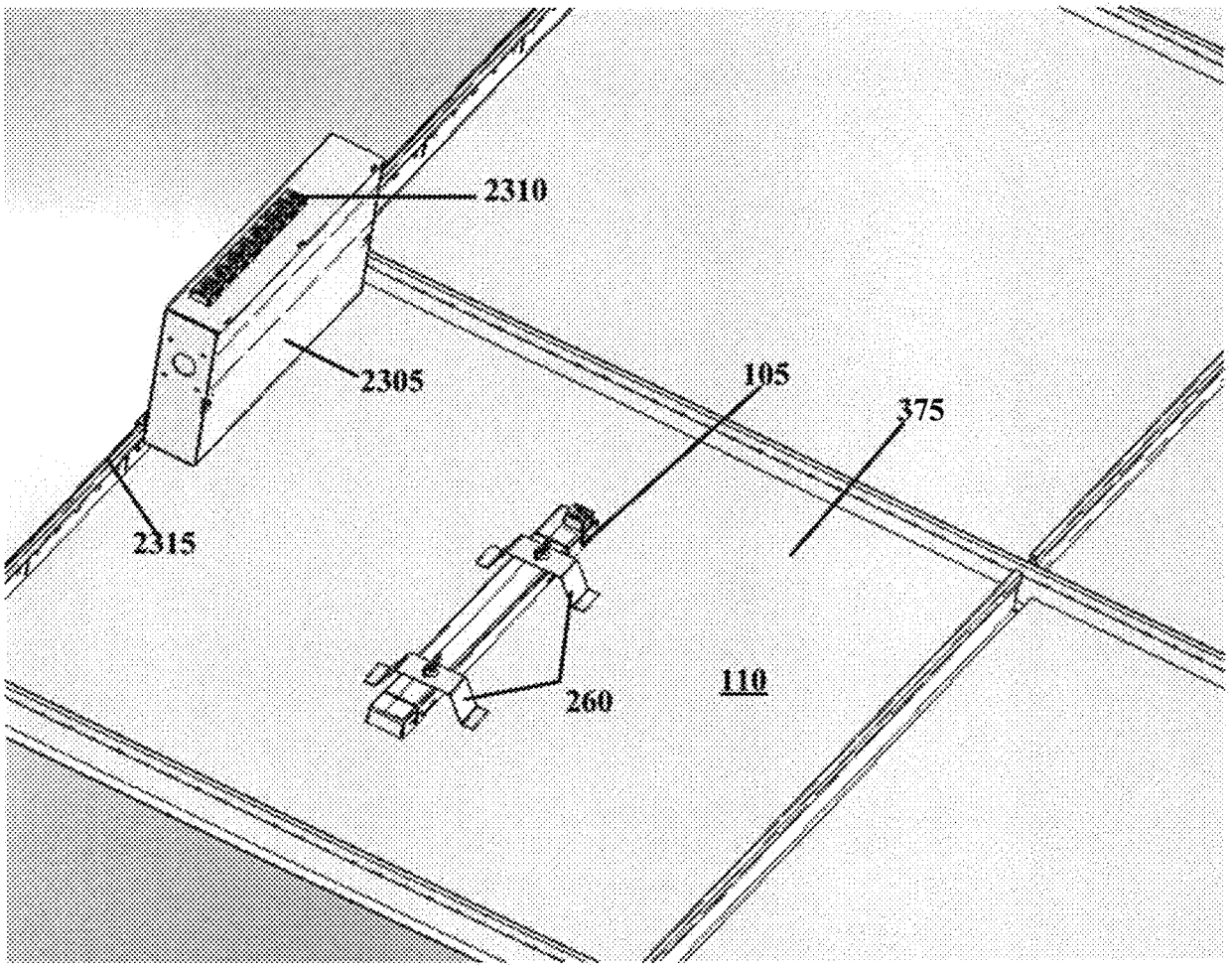
FIG. 23 is top-side perspective view of the LED linear lighting module and power control box in accordance with an exemplary embodiment of the present invention.
Figure 24:
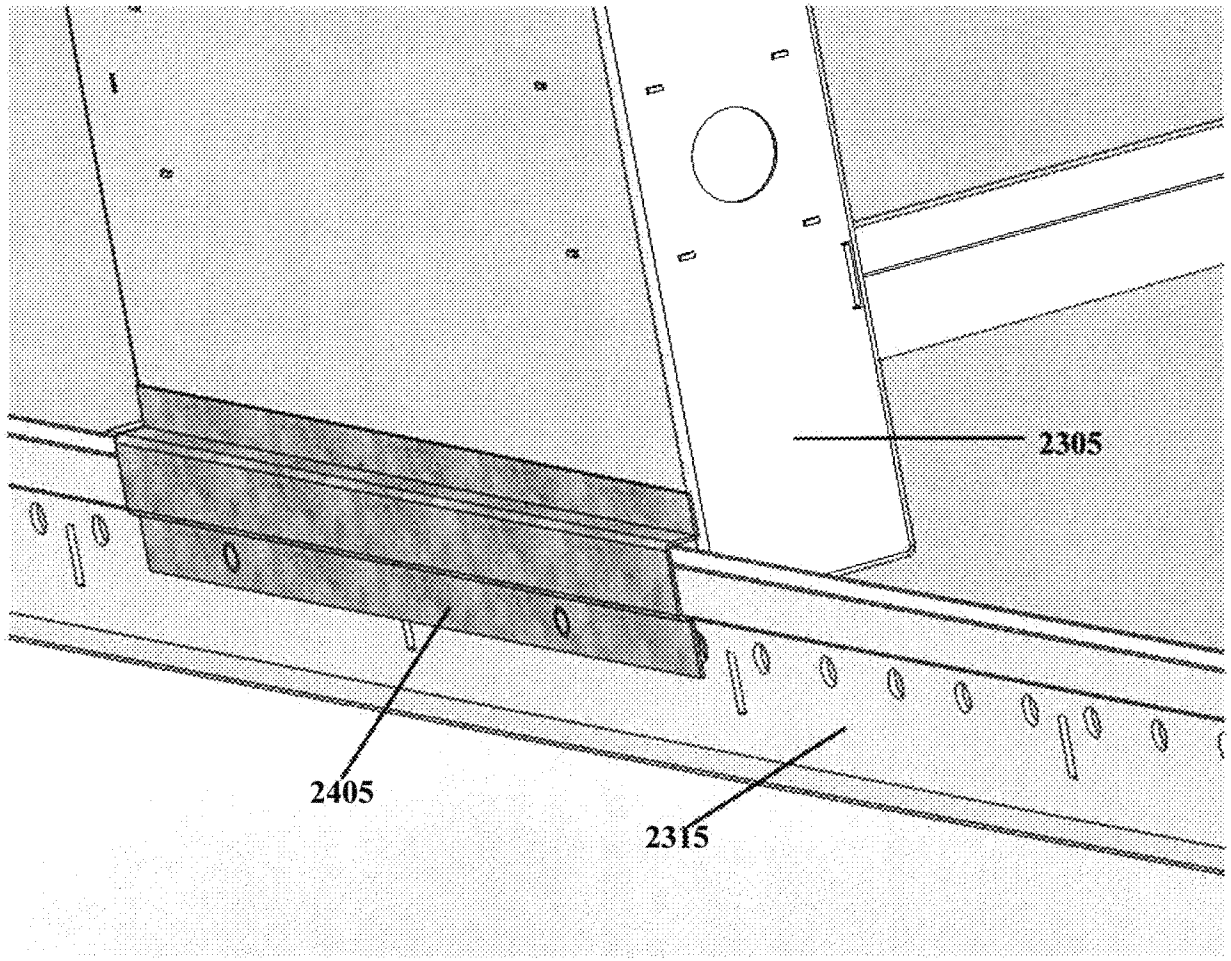
FIGS. 24 and 25 are partial perspective views of the attachment plates for the control box in accordance with an exemplary embodiment of the present invention.
Figure 25:
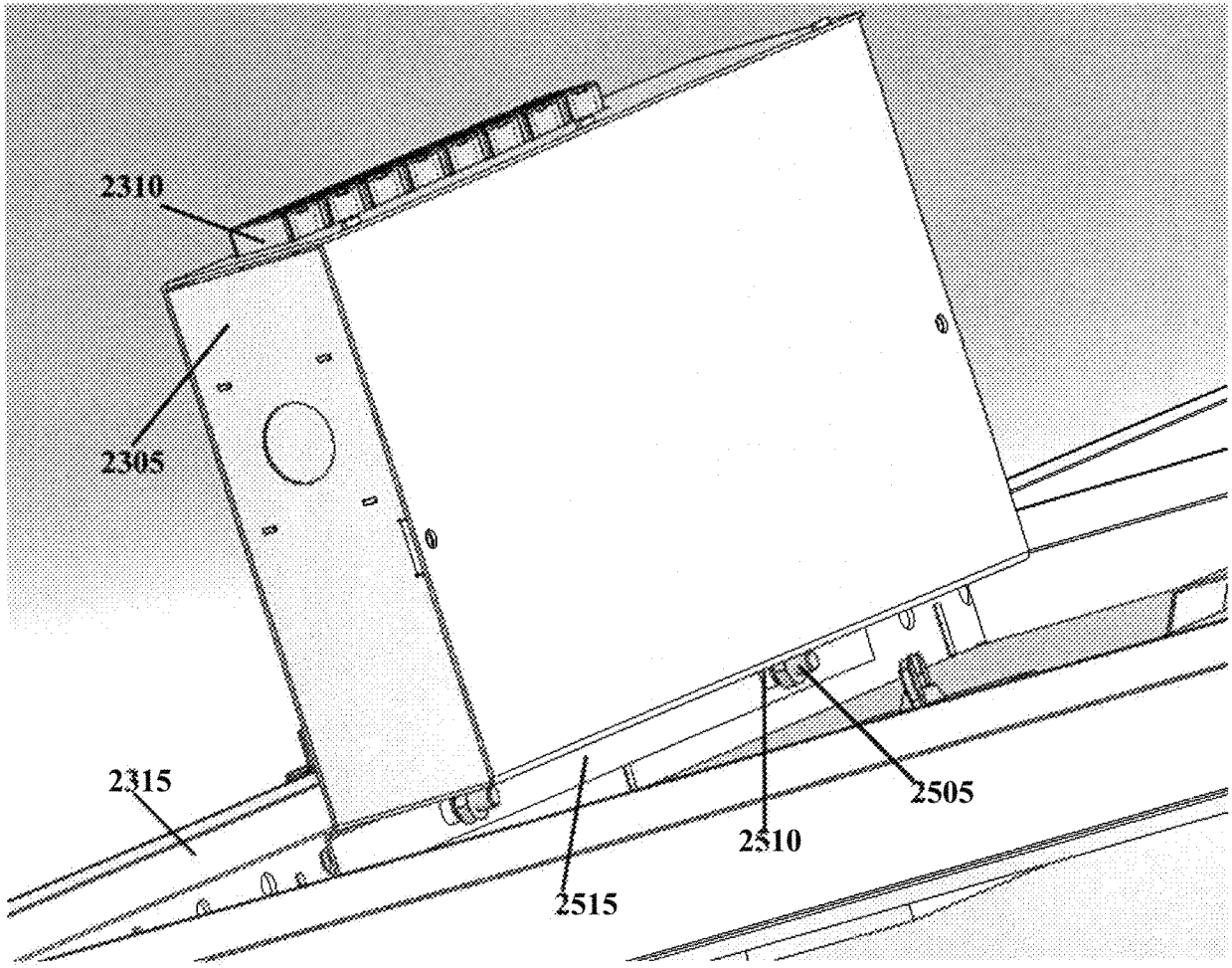

FIG. 23 presents a top-side perspective view of the LED linear lighting module 105 and a power control box 2305 in accordance with the exemplary embodiment. Now referring to FIG. 14, the LED linear lighting module 105 is shown coupled to a top side 375 of a ceiling tile 110. A power control box 2305 is coupled to a T-grid framing member 2315. As shown in FIGS. 24 and 25, a mounting member 2405 is coupled to one side of the power control box 2305 and positioned adjacent the T-grid framing member 2315. In certain exemplary embodiments, the mounting member 2405 includes apertures that align with the apertures on the T-grid framing member 2315. A second mounting member 2515 or an extension of the back wall of the box 2305 extends along the opposing side of the T-grid framing member 2315. In certain exemplary embodiments, the second mounting member 2515 also includes apertures 2510 that align with the apertures of the T-grid framing member 2315. To attach the power control box 2305 to the T-grid framing member 2315, a coupling device 2505, such as a bolt, screw, nail or rivet, is positioned through the aperture of the first mounting member 2405, the T-grid framing member 2315, and the second mounting member 2515 and held in place. While the exemplary embodiment presents the power control box 2305 as being attached to a T-grid framing member 2315, alternatively the power control box 2305 can be coupled to any other surface or disposed within a wall surface remote from the ceiling housing the LED linear lighting modules 105. Further, while the exemplary embodiment presents the power control box 2305 adjacent the lighting module 105 the distance between the two components is restricted only by the length of cable an installer desires to run between the two components.

Figure 39:
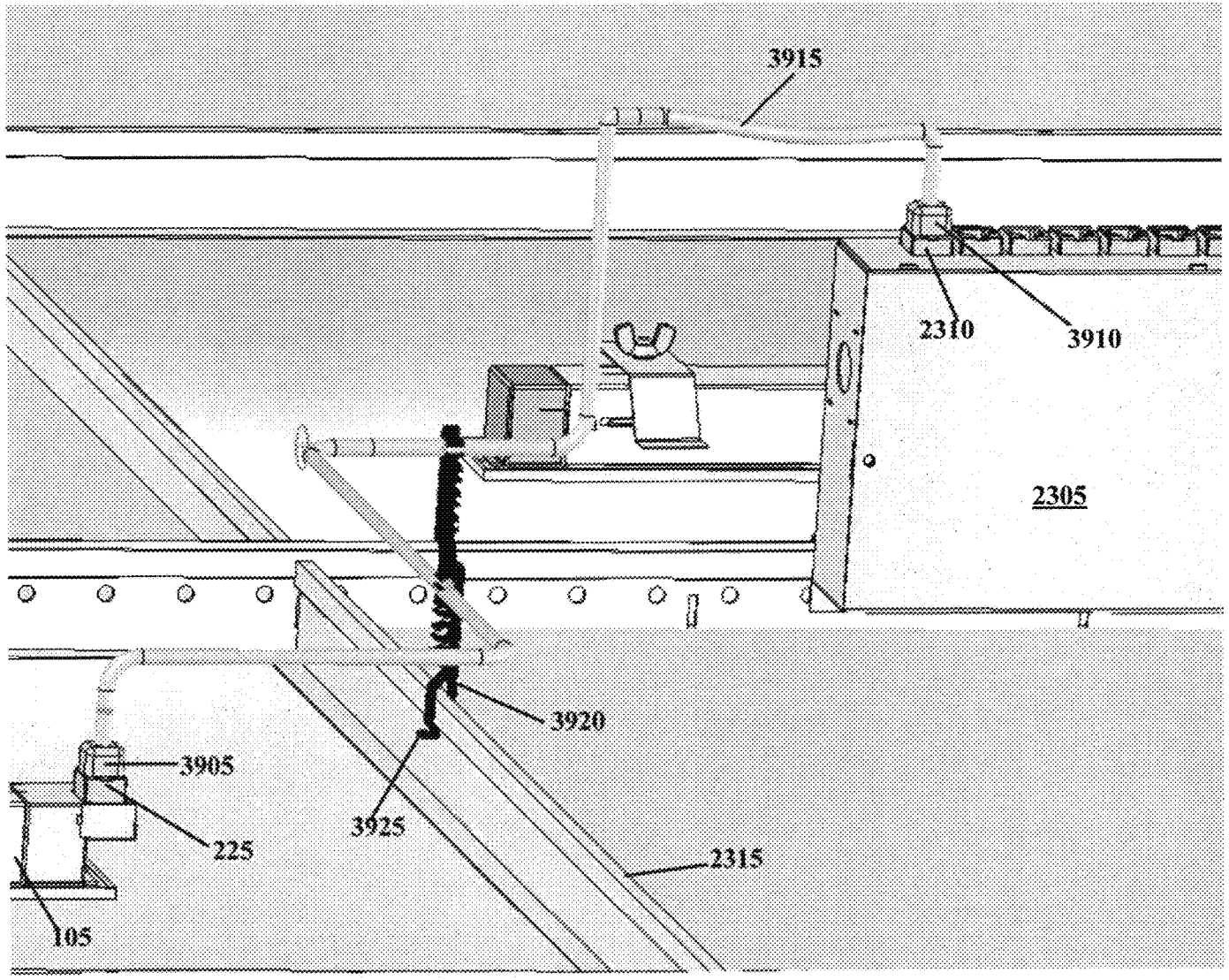
FIGS. 39-41 are views of a wire management system used in conjunction with the LED linear lighting modules and the control box in accordance with an exemplary embodiment of the present invention.
Figure 40:
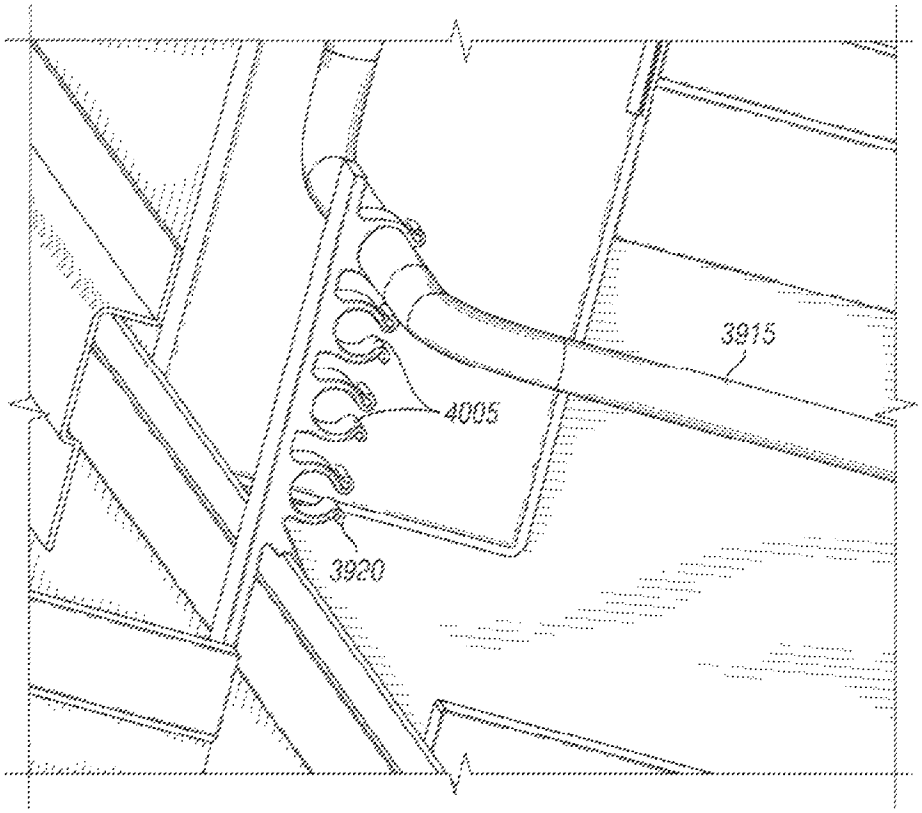
Figure 41:
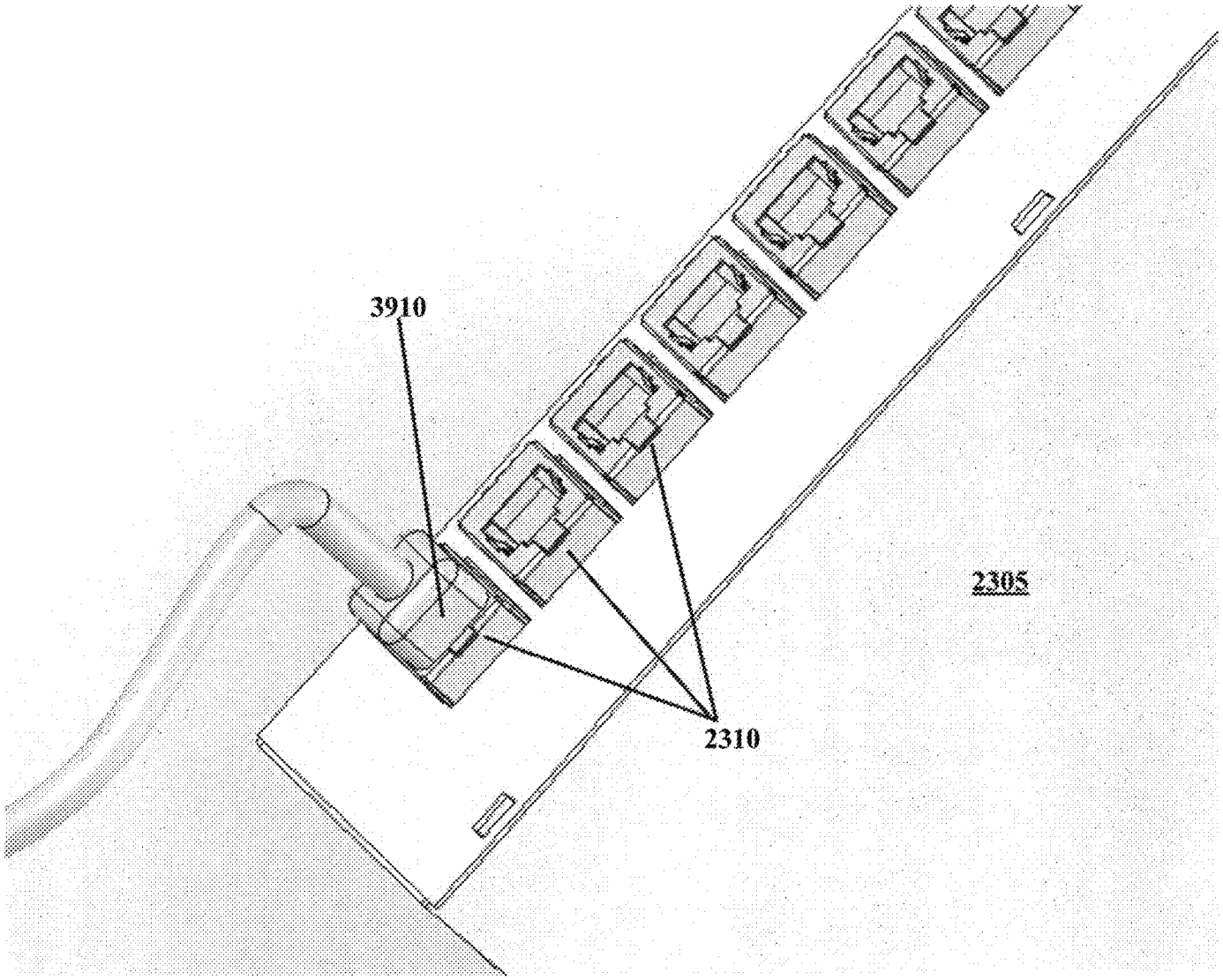

The power control box 2305 is configured to provide both power and control signals for several LED linear lighting modules 105. The exemplary power control box 2305 of FIG. 14 includes 8 class 2 wire jacks 2310, such as, for example, RJ-45 jacks, for receiving a cable from and providing an electrical and communication pathway between the class 2 wire jack 1410 on the LED linear lighting module 105. An example of a cable run between the power control box 2305 and the module 105 is presented in FIGS. 39-41. As shown in FIGS. 39-41, the cable 3915, for example any class 2 cable, includes a first class 2 wire connector 3905 at one end of the cable 3915 and a second class 2 wire connector 3910 at the opposing end. The first class 2 wire connector 3905 is inserted into the jack 225 and the second class 2 wire connector 3910 is inserted into one of the jacks 3910 at the power control box 2305. When long runs of cable 3915 are necessary, the system further includes a wire management member 3920. The wire management member 3920 includes a spring-loaded tab 3925 for slidably coupling the wire management member 3920 to the T-grid framing member 2315. The wire management member 3920 also includes one or more wire holders 4005. In one exemplary embodiment, each wire holder 4005 has two curved members formed in a generally C-shaped form that are spring-loaded and have a gap between the two members that is less than the diameter of the cable 3915.

Figure 42:
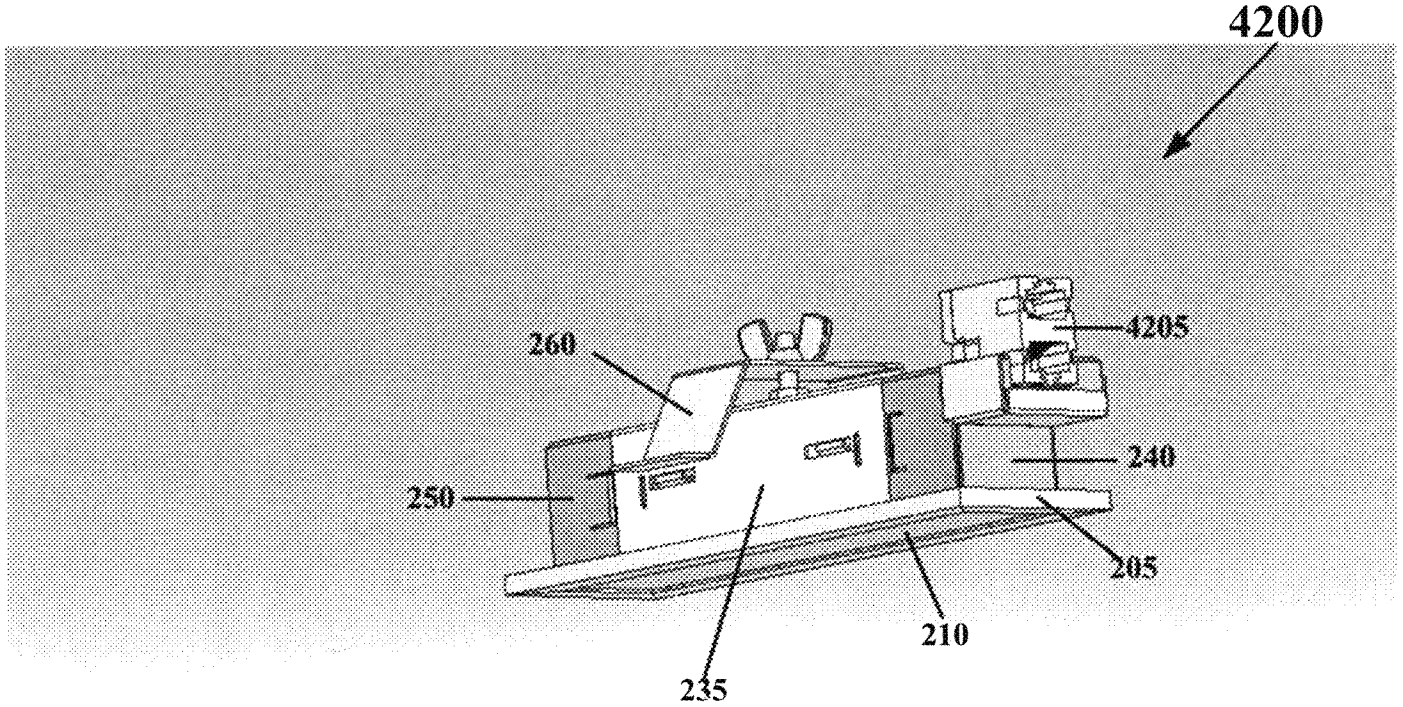
FIG. 42 is a perspective view of an alternative LED linear lighting module with dual cable jacks in accordance with an alternative embodiment of the present invention.

In an alternative embodiment where the LED linear lighting modules 105 are being driven by constant voltage, the power control box 2305 could have only one or two class 2 wire jacks 3910. For this alternative embodiment, as shown in FIG. 42, each LED linear lighting module includes at least a pair of class 2 wire jacks 4205 and each LED linear lighting module 105 would be linked from fixture to fixture. For example, one jack 4205 would receive the cable running from the power control box 2305 and the other jack 4205 would have a cable extending to the next LED linear lighting module 105. The limitation on the number of linked LED linear lighting modules 105 would be generally dependent on the wattage of the driver in the power control box 2305.

Figure 26:
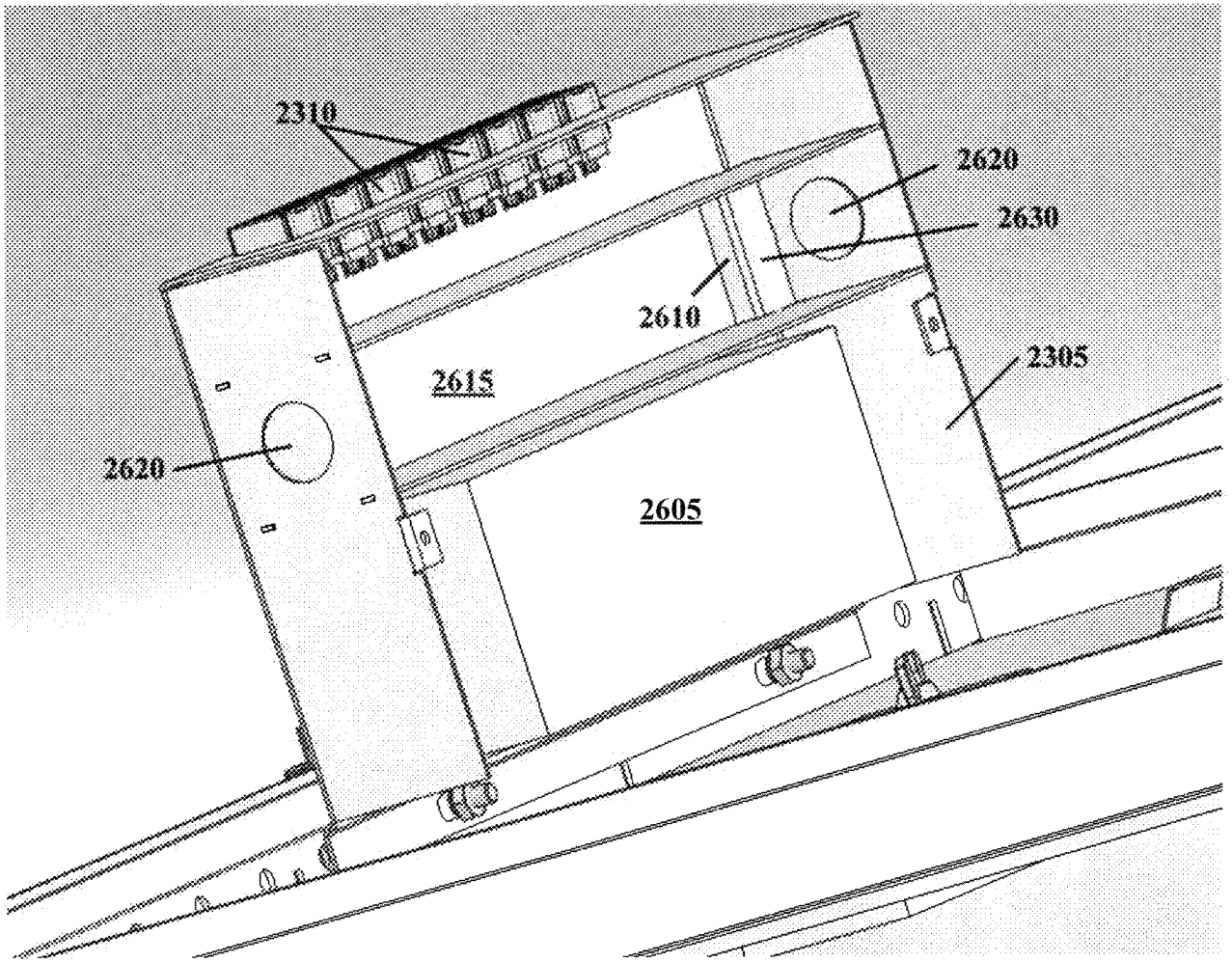
FIG. 26 is a perspective view of the internal components of the control box in accordance with an exemplary embodiment of the present invention.
Figure 27:
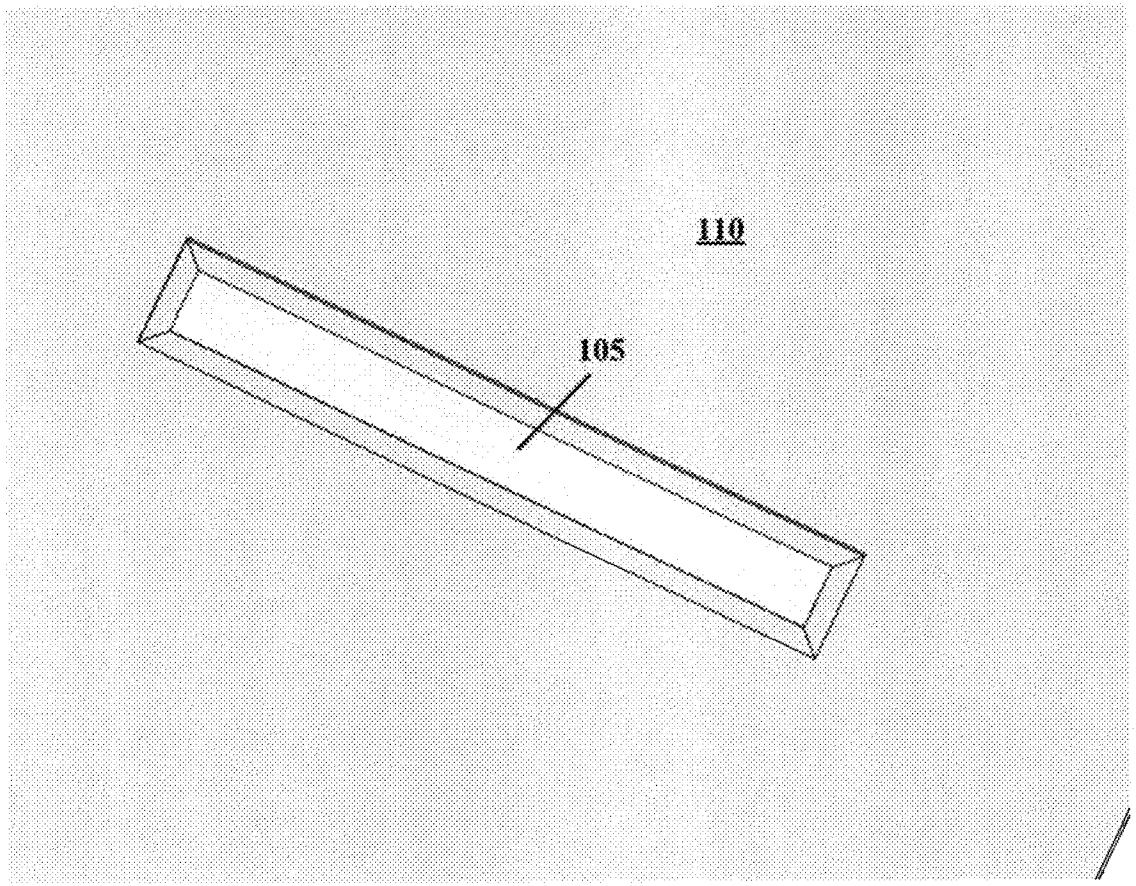
FIG. 27 is a perspective view of the LED linear lighting module in a roof tile in accordance with an exemplary embodiment of the present invention.

As shown in FIG. 26, the power control box 2305 includes an LED driver 2605, one or more conduit knockouts 2620, and a separator panel 2610. The separator panel 2610 separates a portion of the power control box 2305 into a high voltage area 2615 and a low voltage area 2620 to separate the high voltage electrical wires from the low voltage electrical wires. In one exemplary embodiment, electrical power is provided from a power source to the LED driver 2605. The LED driver 2605 is electrically coupled to and transmits electrical power to the class 2 wire jacks 2310, which can be electrically coupled to the LED linear lighting modules 105. Alternatively, the class 2 wire jacks 2310 can be eliminated from the system and the LED driver 2605 is electrically coupled to the LED linear lighting modules 105 in a more direct manner. The power source providing electrical power to the LED driver 2605 can be a conventional power source, such as is found in most residential and/or industrial settings. However, because the LED linear lighting modules are a low voltage solution. the power source providing power can be an either on-grid or off-grid power source. Exemplary power sources include wind, solar, bio-fuel and other alternative energy sources. Electrical energy provided by these sources can be off-grid, such as individualized energy generating systems, or on-grid from a mass energy generating system.

Figure 45:
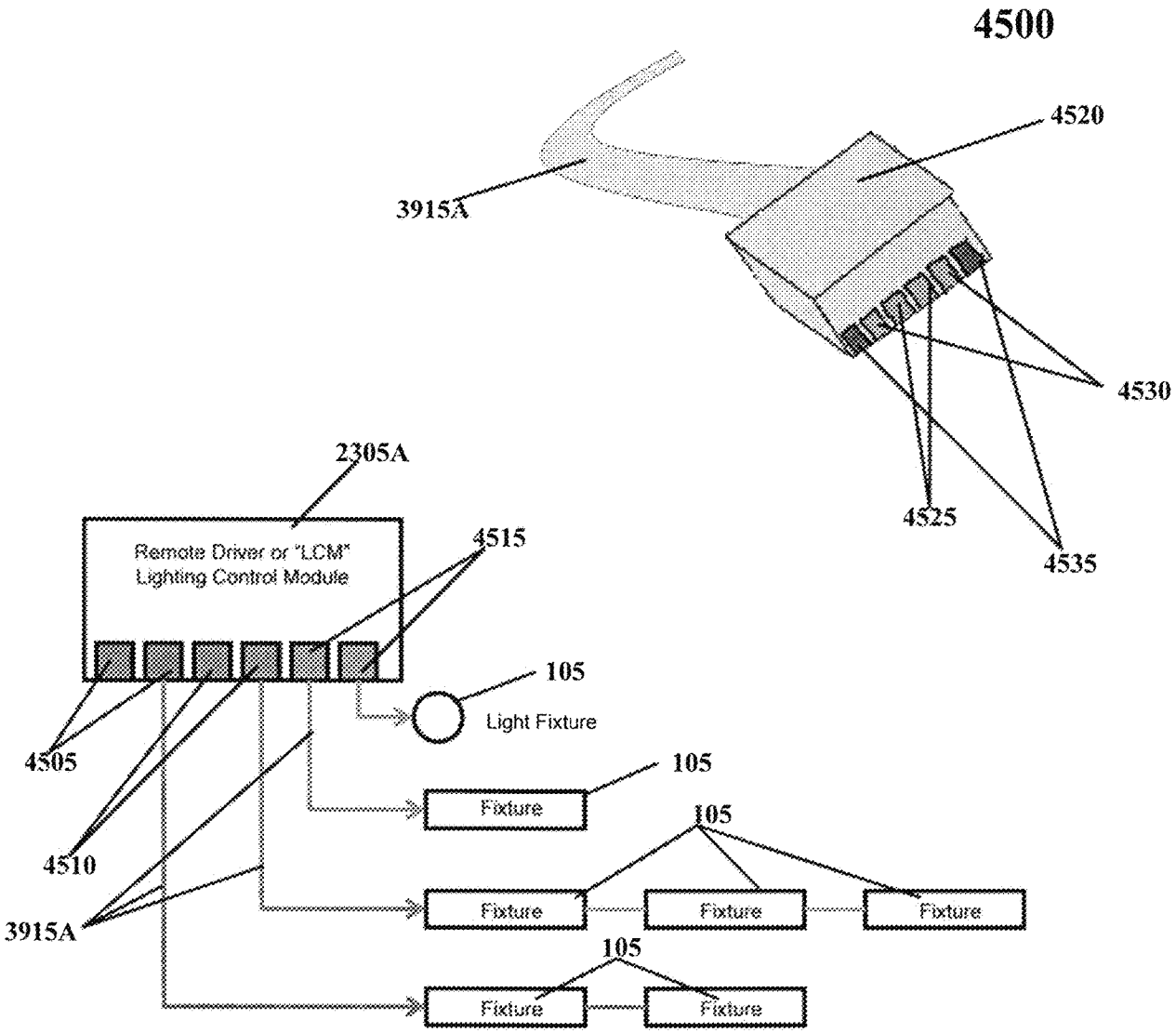
FIG. 45 is a schematic of a modular wiring and power system for the LED linear lighting modules in accordance with an exemplary embodiment of the present invention.

One problem that can occur with some remote power systems, such as the remote driver 2605 in the power control box 2305 placed remotely from the LED modules 105 is that precise coordination is typically required to properly size the remote driver to the specific power needs of the remote modules 105. For example, if the driver is suited to power 30 modules 105 but only two are actually electrically coupled (directly or indirectly) to and powered by the driver, the unused portion of the power can create total harmonic distortion (THD). THD issues within the building create noise within the power lines and can affect the operation of the electronic equipment. In conventional systems, this problem can be overcome by using multiple driver types/wattage outputs to fit a particular lighting layout or modifying the particular lighting layouts to fit the standard driver sizes. In order to overcome these potential problems, FIG. 45 illustrates a modular driver system 4500 in accordance with an exemplary embodiment.

The modular driver system 4500 includes a modular power control box 2305A, having a modular driver (not shown), and modular connectors 4505-4515. In certain exemplary embodiments, the modular driver is positioned within the modular power control box 2305A. The modular driver can be bifurcated and can include one or more drivers each having the ability to provide different power/wattage levels depending on the amount of power and the number of modules 105 and/or other fixtures that an installer wants to use in a particular lighting layout.

The modular connectors 4505-4515 are can each be provided with a unique color that corresponds to the amount of available power and/or number of modules 105 that should be connected to that particular connector. In the exemplary embodiment of FIG. 45, connectors 4505 are red and provide a visual color indication that, for example, two modules 105 should be connected to that connector 4505 to ensure peak performance and minimum THD. Exemplary connectors 4510 are green and provide a visual color indication that, for example, three modules 105 should be connected to that connector 4510 to ensure peak performance and minimum THD. Exemplary connectors 4515 are blue and provide a visual color indication that, for example, one module 105 should be connected to that connector 4515 to ensure peak performance and minimum THD. Of course, the number of colors provided for the connectors 4505-4515 and the number of modules that should be coupled to each connector 4505-4515 is exemplary only. More or different colors of connectors can be provided and the number of fixtures they are designed to work optimally with can be greater or less. Further, the optimal number can be a range rather than a specific number of modules 105 or can be based on a range of the total amount of power that will be drawn by the modules 105, when in use.

A modular low voltage cable and connector system 3915A can be used in conjunction with the modular control box 2305A. The exemplary cable system 3915A includes a connector 4520 with color-coordinated terminals 4525-4535. For example, the connector 4520 includes blue terminals 4525, green terminals 4530, and red terminals 4535. The connector 4520 is configured to electrically engage the connectors 4505-4515 on the box 2305A. For example, when the connector 4520 is coupled to one of the red connectors 4505, only the red terminals 4535 will be engaged as part of the electrical coupling and a sufficient amount of power to drive two modules 105 will be provided through the cable 3915A. Similar mechanical/electrical connections will occur when the cable 3915A is coupled to a green connector 4510 (with the green terminals 4530) or coupled to a blue connector 4515 (with the blue terminals 4525).

Figure 28:
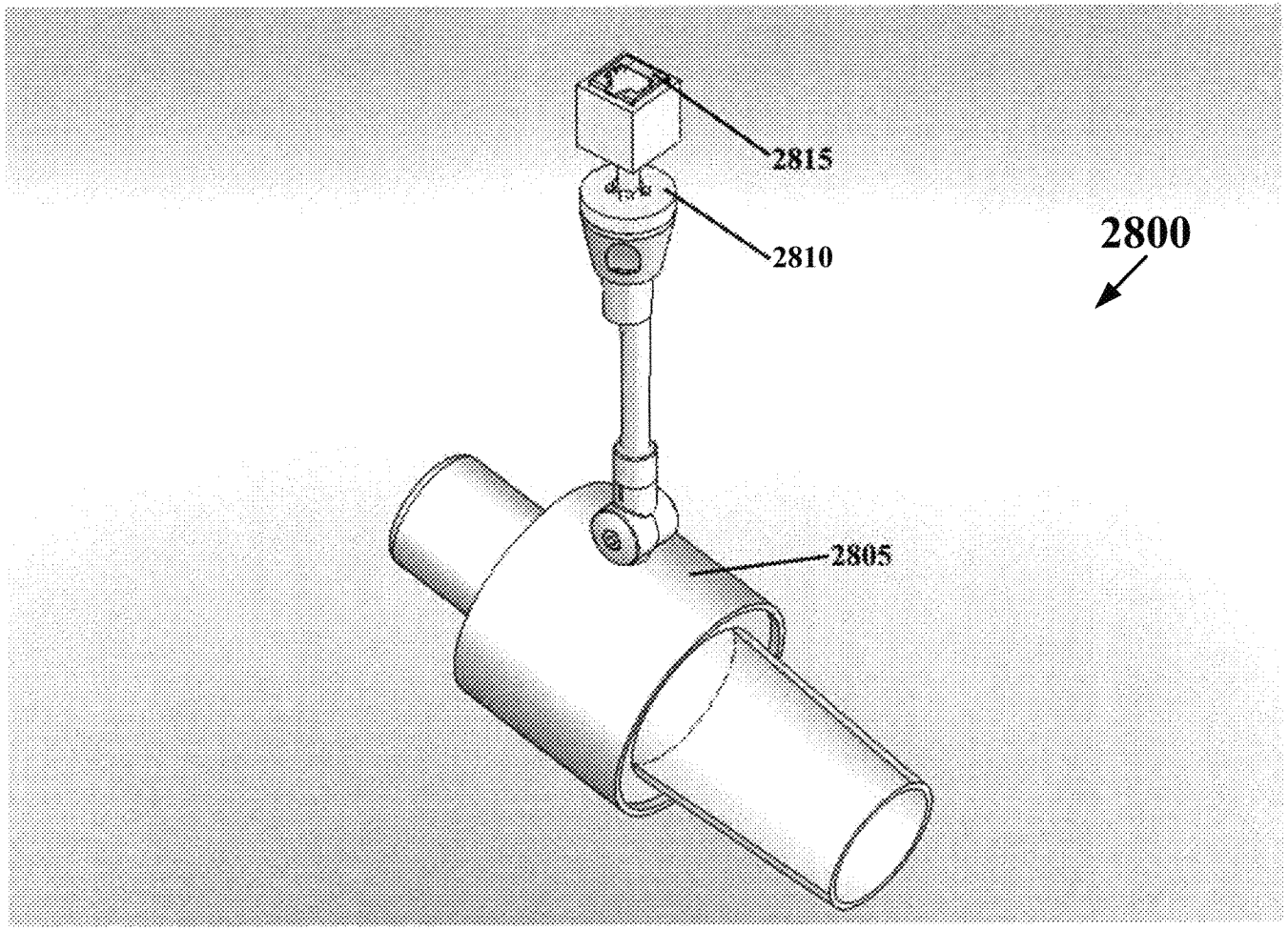
FIG. 28 is a perspective view of an alternative pendant light system for use in conjunction with the LED linear lighting module and/or control box in accordance with an alternative exemplary embodiment of the present invention.

FIG. 28 presents a perspective view of another pendant light system 2800 for use alone or in conjunction with the LED linear lighting module 105 and/or the control box 2305. The pendant light 2800 includes a luminaire 2805 a pendant mounting system 2810 coupled to the luminaire 2805 and an class 2 wire jack 2815 coupled to the pendant mounting system 2810 and electrically coupled to the luminaire 2800. In the exemplary embodiment of FIG. 28, the luminaire 2805 includes a housing and a reflector disposed within the housing and extending out from the housing to direct emitted light to a desired location. The pendant mounting system 2800 extends down from a ceiling tile 110 or other mounting surface and the class 2 wire jack 2815 is disposed above the ceiling and can be connected by cable to the power control box 2305. Alternatively, the pendant light 2800 could include the dual class 2 wire jacks as described with reference to FIG. 42. Further, while the exemplary embodiment describes a pendant light system, similar modifications can be made to downlights, can lights, and track lights and are within the scope and spirit of this disclosure.

Figure 43:
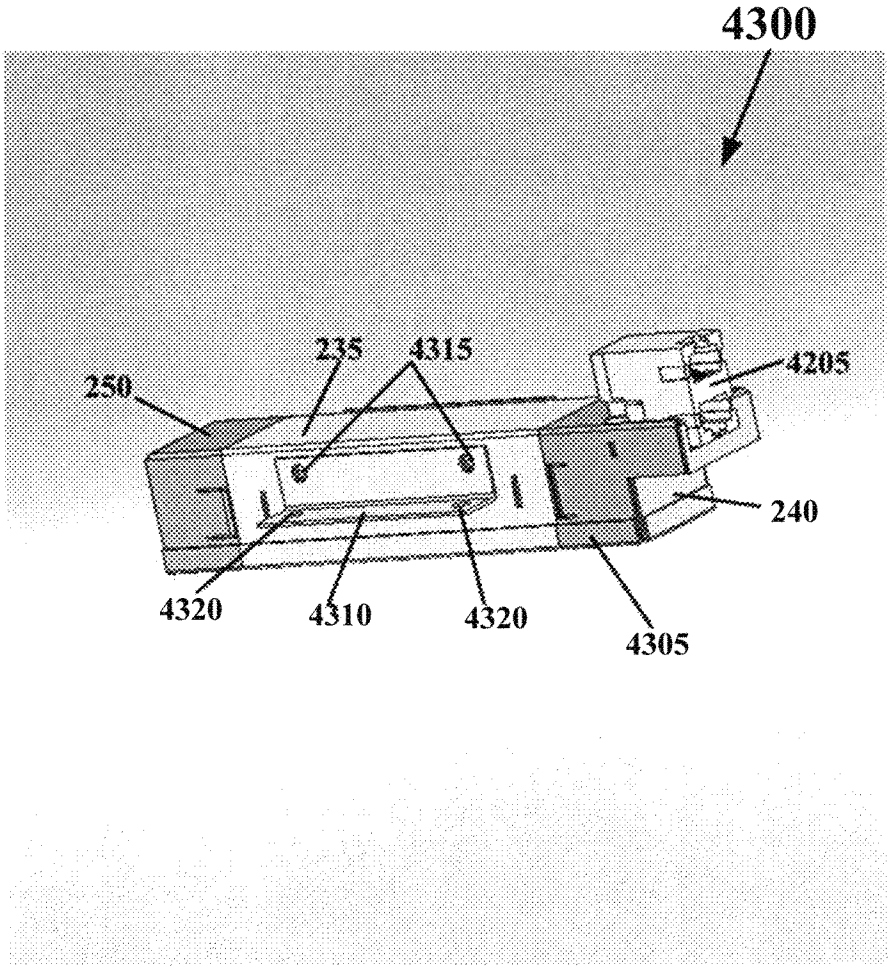
FIG. 43 is a perspective view of a flangeless LED linear lighting module in accordance with another alternative exemplary embodiment of the present invention.

FIG. 43 presents a perspective view of a flangeless LED linear lighting module 4300 in accordance with another alternative exemplary embodiment. Referring to FIG. 43, the exemplary flangeless module 4300 includes an angled member 4310 having two elongated members joined at a substantially orthogonal angle. The first elongated member includes a first pair of apertures 4315 and the second elongated member includes a second pair of apertures 4320. The angled member 4310 is adjustable between a first position and a second position. In the first position, the first elongated member rests alongside the wall of the housing 235 and is coupled to the housing 235 with known coupling means (not shown) through the apertures 4315. The second elongated member extends from the bottom of the first elongated member and orthogonally outward from the wall of the housing 235 and rests along the top side 375 of the ceiling tile 110 to dispose the lens frame 4305 a first distance below the top of the ceiling tile 110. In the second position, the second elongated member rests alongside the wall of the housing 235 and is coupled to the housing 235 with known coupling means through the aperture 4320. The first elongated member extends from the bottom of the second elongated member and orthogonally outward from the wall of the main body and rests along the top side 375 of the ceiling tile 110 to dispose the lens frame 4305 a second distance below the top of the ceiling tile 110. In one exemplary embodiment, the first distance is three-eighths of an inch and the second distance is one-half inch. The different distances are intended to provide for ceiling tiles or ceilings having difference thicknesses. In alternative embodiments, the first and second distances are anywhere between one-eighth of an inch to move than six inches. Unlike the lens frame of FIG. 2, the lens frame 4305 does not include a flange and the flangeless module is configured to be flush with the bottom of the ceiling tile 110.

Figure 44:
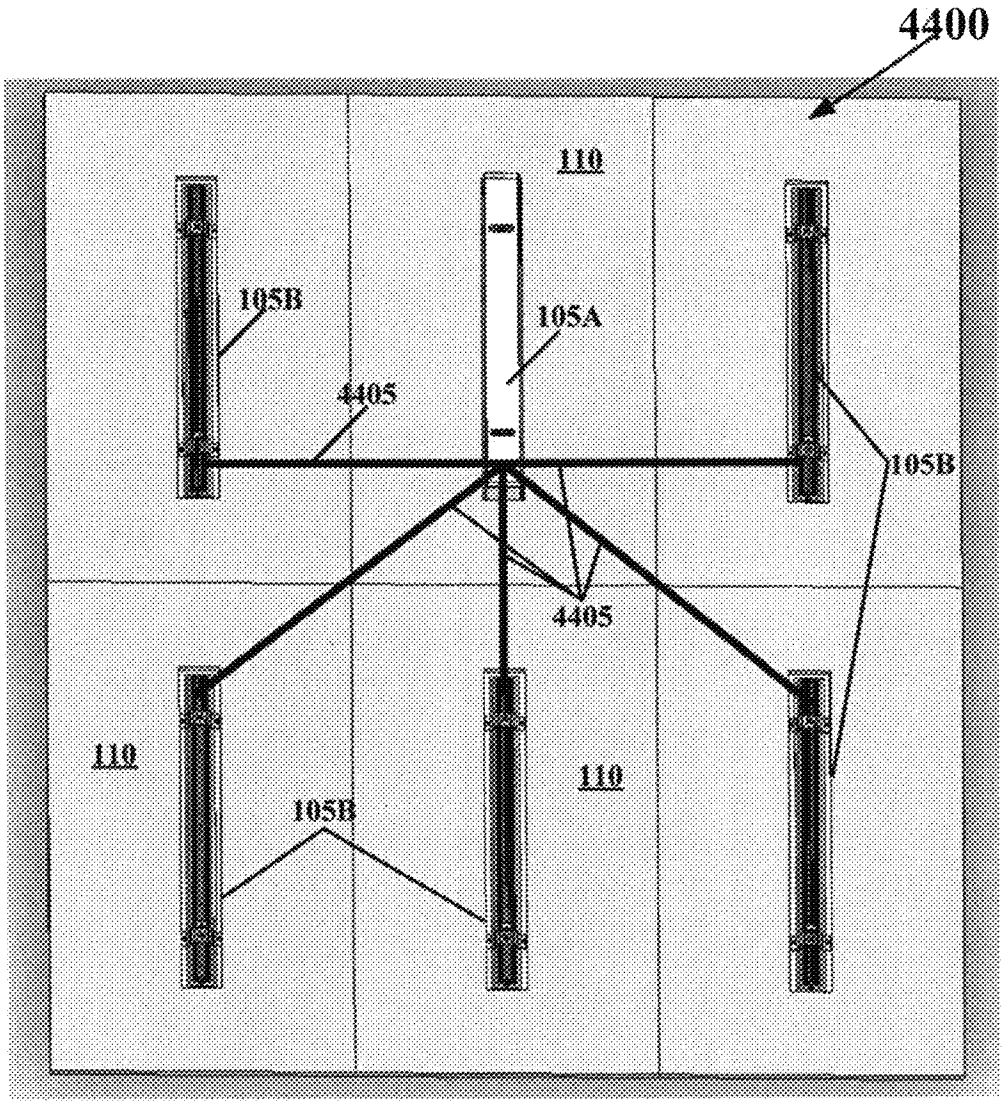
FIG. 44 is a plan view of a master/slave luminaire system using the LED linear lighting modules in accordance with an exemplary embodiment of the present invention.

FIG. 44 presents a plan view of a master/slave luminaire control system 4400 in accordance with an exemplary embodiment. Referring to FIG. 44, the system 440 includes a ceiling system having multiple ceiling tiles 110. One linear LED module, such as the module 105A of FIG. 3A can include a driver 325. The linear LED module 105A also includes multiple power output connections for powering additional linear LED modules. For example, the module 105A of FIG. 44 includes five power output connections for providing electrical power via feed lines 4405 to other linear LED modules, such as modules 105B of FIG. 4. In certain exemplary embodiments, the power output connections are class 2 wire connections. In certain exemplary embodiments, the "master" LED module 105A provides both power and control signals to the other LED modules 105B that are electrically coupled to the module 105B. Thus, power and control instructions provided to module 105B can be used to power and control many additional modules 105B. While the exemplary embodiment of FIG. 44 illustrates five "slave" modules coupled to the master module 105A, those of ordinary skill in the art will recognize that any number of slave modules, including a range from 1-50 slave modules, could be electrically and/or controllably coupled to the master module 105A. In the exemplary embodiment of FIG. 44, the master module 105A includes the driver while the slave modules 105B do not include a driver. Alternatively, the master module 105A does not include a driver but still provides multiple power and/or control connections, such as class 2 power connections, for powering the slave modules.

Although the inventions are described with reference to preferred embodiments, it should be appreciated by those skilled in the art that various modifications are well within the scope of the invention. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is not limited herein.

We claim:

1. An illumination system, comprising:

a power control module comprising a sidewall and a cavity, wherein at least a portion of the power control module defines a mounting member that is configured to mount the power control module to a mounting surface, and wherein the power control module further comprises:

a plurality of electrical output interfaces disposed on the sidewall; and a power supply disposed in the cavity of the power control module and electrically coupled to at least one of the plurality of electrical output interfaces;

a first electrical device comprising:

a first light source that emits light of a first wavelength;

a second light source that emits light of a second wavelength, wherein the first light source and the second light source are separately controlled by the power control module; and a first electrical input interface electrically coupled to the first light source and the second light source, wherein the first electrical input interface is configured to be electrically coupled to an electrical output interface of the plurality of electrical output interfaces of the power control module via a first cable having connectors on either end to provide power and control signals to the first electrical device; and a second electrical device comprising a second electrical input interface, wherein the second electrical input interface is configured to be electrically coupled to another electrical output interface of the plurality of electrical output interfaces of the power control module via a second cable having connectors on either end to provide power and control signals to the second electrical device.

2. The illumination system of claim 1, wherein the first electrical input interface, the second electrical input interface, and the plurality of electrical output interfaces each comprise a class 2 connector, and wherein the first cable and the second cable are class 2 cables.

3. The illumination system of claim 1, wherein the first electrical device comprises an integral connector, and wherein the first electrical device is mechanically coupleable to one or more lighting modules.

4. The illumination system of claim 1, wherein the power supply is a modular power supply that is bifurcated and comprises one or more power supply units, and wherein each power supply unit of the one or more power supply units is configured to provide a different power level.

5. The illumination system of claim 1, wherein the electrical output interface provides a first amount of power and wherein the another electrical output interface provides a second amount of power that is different from the first amount of power.

6. The illumination system of claim 5, wherein the electrical output interface has a first color and wherein the another electrical output interface has a second color.

7. A modular LED driver system, comprising:

a modular LED driver;

a first modular connector and a second modular connector electrically coupled to the modular LED driver, wherein the first modular connector is electrically couplable to a lighting device, the lighting device comprising a first light source that emits light of a first wavelength and a second light source that emits light of a second wavelength, wherein the second modular connector is electrically couplable to at least one electrical device via a modular cable, and wherein the first modular connector outputs a first amount of power and the second modular connector outputs a second amount of power, and the modular cable comprising a cable connector having multiple sets of terminals, wherein the cable connector is configured to electrically engage any one of the first modular connector and the second modular connector such that, when the cable connector is coupled to the first modular connector, a first set of the multiple sets of terminals of the cable connector is electrically engaged to provide the first amount of power, and when the cable connector is coupled to the second modular connector, a second set of the multiple sets of terminals of the cable connector is electrically engaged to provide the second amount of power.

8. The modular LED driver system of claim 7, wherein the modular LED driver is configured to output power at two or more power levels.

9. The modular LED driver system of claim 7, wherein the first modular connector and the second modular connector are color coded representing a first power rating for the first modular connector and a second power rating for the second modular connector.

10. The modular LED driver system of claim 7, wherein each set of the multiple sets of terminals of the cable connector is designated by a color and configured to be electrically coupled to one of the first modular connector and the second modular connector having a matching color.

11. The modular LED driver system of claim 7, wherein the modular LED driver provides control signals to the lighting device and the at least one electrical device.

12. The modular LED driver system of claim 7, wherein at least one of the first modular connector and the second modular connector is capable of providing power from the modular LED driver to a plurality of lighting modules.

13. The modular LED driver system of claim 7, wherein the modular LED driver is remotely located from the at least one lighting device and the at least one electrical device.

14. An illumination system comprising:

a first light emitting diode (LED) module comprising:

a first LED that emits light of a first wavelength;

a second LED that emits light of a second wavelength;

a power supply electrically coupled to the first LED and the second LED;

a first wire connector receptacle and a second wire connector receptacle electrically coupled to the power supply;

a second LED module without a power supply, the second LED module comprising:

a third LED;

a fourth LED; and a third wire connector receptacle electrically coupled to the third LED and the fourth LED, wherein the third wire connector receptacle of the second LED module is electrically coupled to the first wire connector receptacle of the first LED module via a first wire having connectors on each end of the first wire; and an electrical device comprising a fourth wire connector receptacle, wherein the fourth wire connector receptacle of the electrical device is electrically coupled to the second wire connector receptacle of the first LED module via a second wire having connectors on each end of the second wire.

15. The illumination system of claim 14, wherein the first LED module provides control signals to the second LED module and the electrical device.

16. The illumination system of claim 14, wherein the first wire connector receptacle provides a first amount of power and the second wire connector receptacle provides a second amount of power.

17. The illumination system of claim 14, wherein each of the first wire connector receptacle and the second wire connector receptacle has a color designating an amount of power provided by the power supply.

18. The illumination system of claim 14, wherein the first wire connector receptacle and the second wire connector receptacle comprise at least one power output connection.

19. The illumination system of claim 14, wherein the first LED module provides power to the second LED module and the electrical device.

20. The illumination system of claim 14, wherein the first wire and the second wire comprise a Class 2 wire.

* * * * *